US012635819B2

(12) United States Patent
Xu

(10) Patent No.: US 12,635,819 B2
(45) Date of Patent: May 26, 2026

(54) DETACHABLE SHOE COVER ADAPTED TO BE DISPENSED BY A DISPENSER DEVICE

(71) Applicant: OTO Industry (Wuhan) Co., Ltd., HanChuan (CN)

(72) Inventor: Liang Jie Xu, HanChuan (CN)

(73) Assignee: OTO Industry (Wuhan) Co., Ltd., HanChuan (CN)

( * ) Notice: Subject to any disclaimer, the term of this patent is extended or adjusted under 35 U.S.C. 154(b) by 322 days.

(21) Appl. No.: 18/108,611

(22) Filed: Feb. 11, 2023

(65) Prior Publication Data

US 2023/0263326 A1 Aug. 24, 2023

Related U.S. Application Data

(60) Continuation-in-part of application No. 17/844,678, filed on Jun. 20, 2022, now Pat. No. 11,992,139, which is a division of application No. 17/489,784, filed on Sep. 30, 2021, now Pat. No. 11,478,098.

(51) Int. Cl.

| | |
|---|---|
| ***A47G 25/90*** | (2006.01) |
| ***A43B 3/10*** | (2006.01) |
| ***A43B 3/16*** | (2022.01) |
| ***B65D 73/00*** | (2006.01) |
| ***B65D 83/08*** | (2006.01) |

(52) U.S. Cl.

CPC ..... *A47G 25/90* (2013.01); *A43B 3/106* (2013.01); *A43B 3/163* (2013.01); *B65D 73/00* (2013.01); *B65D 83/08* (2013.01); *B65D 83/0894* (2013.01)

(58) Field of Classification Search

CPC ..... A47G 25/90; A43B 3/106; A43B 3/163; B65D 73/00; B65D 83/08; B65D 83/0894

USPC ..... 221/191

See application file for complete search history.

(56) References Cited

U.S. PATENT DOCUMENTS 3,775,793 A * 12/1973 Casavant ..... A43D 11/003 12/1 R
6,219,938 B1 * 4/2001 Anderson ..... A43B 3/163 36/7.1 R (Continued)

FOREIGN PATENT DOCUMENTS

CN 206166541 U * 5/2017 ..... A47G 25/80

*Primary Examiner* — Rakesh Kumar

(74) *Attorney, Agent, or Firm* — David & Raymond Patent Firm; Raymond Y Chan

(57) ABSTRACT

A detachable shoe cover assembly includes a plurality of detachable shoe covers each of which is configured for being installed along two installation arms of an installation assembly of a dispenser device, guided to move to an dispenser arrangement of the installation assembly and dispensed from the dispenser arrangement of the installation assembly by detaching from the two installation arms. Each of the detachable shoe covers comprises a shoe cover main body having a receiving cavity, an elastic opening edge portion defining an opening, and an interconnection arrangement arranged for interconnecting the plurality of detachable shoe covers one-by-one in series and held along the two installation arms of the installation assembly of the dispenser device, wherein the interconnection arrangement is configured to be separated by a separator of the dispenser device such that the detachable shoe cover is detached from the installation arms of the dispenser device.

22 Claims, 62 Drawing Sheets

(56) References Cited

U.S. PATENT DOCUMENTS 6,339,888 B1 * 1/2002 Brunson ..... A43B 3/163 36/7.1 R
6,666,479 B1 * 12/2003 Maddaleni ..... A63C 3/12 280/825
7,108,154 B1 * 9/2006 Thompson ..... A43B 3/163 221/56
7,440,816 B1 * 10/2008 He ..... A43B 3/16 223/111
7,634,862 B2 * 12/2009 Cockman ..... A47G 25/905 36/138
7,669,351 B1 * 3/2010 Ghotbi ..... A43B 3/163 36/7.1 R
2002/0020031 A1 * 2/2002 Gultekin ..... A47G 25/80 12/142 R
2007/0163912 A1 * 7/2007 Chen ..... B65B 67/1266 221/312 A
2007/0204568 A1 * 9/2007 Chen ..... A47G 25/80 53/473
2008/0000035 A1 * 1/2008 Levine ..... A43B 3/16 12/1 R
2008/0237277 A1 * 10/2008 Xu ..... A43D 999/00 222/526
2009/0071989 A1 * 3/2009 He ..... A43D 999/00 223/111
2009/0152312 A1 * 6/2009 Li ..... A47G 25/80 223/111
2010/0288800 A1 * 11/2010 Xu ..... A43B 3/106 221/36
2011/0186589 A1 * 8/2011 Lee ..... A61B 42/50 221/36
2011/0186590 A1 * 8/2011 Lee ..... A61B 50/30 600/528
2011/0272440 A1 * 11/2011 Heller ..... A47G 25/907 223/113
2012/0286471 A1 * 11/2012 Grauzer ..... A63F 1/12 273/148 A
2015/0272365 A1 * 10/2015 Heller ..... A43B 3/106 223/113
2017/0088339 A1 * 3/2017 Xu ..... A43B 3/163
2018/0317686 A1 * 11/2018 Howard ..... A61B 42/50
2023/0263326 A1 * 8/2023 Xu ..... A43B 3/106 221/191

* cited by examiner

DETACHABLE SHOE COVER ADAPTED TO BE DISPENSED BY A DISPENSER DEVICE

CROSS REFERENCE OF RELATED APPLICATION

This application is a Continuation-In-Part application that claims the benefit of priority under 35U.S.C. § 120 to a non-provisional application, application Ser. No. 17/844,678, filed Jun. 20, 2022, which is a Divisional application that claims the benefit of priority under 35U.S.C. § 120 to a non-provisional application, application Ser. No. 17/489,784, filed Sep. 30, 2021, which is a non-provisional application that claims the benefit of priority under 35U.S.C. § 119 to a Chinese application, application number CN202110003068.5, filed Jan. 20, 2021, which are incorporated herewith by reference in their entirety.

BACKGROUND OF THE PRESENT INVENTION

Field of Invention

The present invention relates to detachable shoe covers adapted to be dispensed by a dispenser device, wherein the dispenser device and the shoe covers being stored and dispensed by the dispenser device are configured to allow each of the shoe covers being easily and conveniently detached from the dispenser device without detorting and causing damage to the shoe cover in a safe and reliable manner.

Description of Related Arts

With the development of science and technology, the manufacturing of some products must be completed in a dust-free workshop. Therefore, people must wear dust-free clothing and clean disposable shoe covers before entering the dust-free workshop to avoid any pollution to the dust-free workshop. Besides, shoe cover assembly and shoe cover dispenser device are widely used in furniture, factories, model houses, hospitals, dust-free workshops and other places that require environmental cleanliness.

Traditional shoe cover dispensers are complicated and difficult in operation. During the wearing of some shoe covers, user is required to manually pull the shoe covers out which is inconvenient for wearing the shoe covers. U.S. Pat. Nos. 9,764,889, 9,771,207, 9,834,368, and U.S. Ser. No. 11/478,098, invented by the inventor of the present invention, disclose shoe cover dispenser devices which are convenient for people to wear the shoe covers, facilitate the integration storage of multiple pairs of shoe covers and automatically open the shoe cover in turn for wearing.

In order to allow the perforations of each shoe cover passing from the upper portions to the end portions of the installation arms of the dispenser machine, the first end portions of the installation arms are respectively locked by the first locking member and then the second end portions of the installation arms can be free end portions and are released from the second locking member and removed from the second end portions, so that the plurality of shoe covers can be ready for dispensing from the second end portions of the installation arms. Nevertheless, the first and second locking members of the locking assembly have to be configured as simple as possible in a reliable manner and the installation of the first and second locking members by the user must be precise and rigid to ensure smooth dispensing operation. Accordingly, it will be a desired innovative improvement to configure the dispenser machine to be capable of smoothly dispensing shoe covers without the relatively complicated locking and releasing operation of the locking assembly.

The dispenser machines as disclosed in the above related patents require each row of two front perforation portions of a rear shoe cover passes through a row of two rear joint perforations of an adjacent front shoe cover to expose the row of two front joint perforations that allows each of the connecting rods to pass through the front joint perforations, so that a plurality of the shoe covers are connected and joined by the two connecting rods in series. It is a good arrangement since the installation of the shoe covers on the two connecting rods only requires the two connecting rods to pass through the row of the rear joint perforations. However, during the shoe cover is being pulled out by a pulling force, the interconnecting of the shoe covers with respect to the locking assembly may become holding on the installation arms tighter and tighter and produce resistance for the shoe covers to move along the installation arms. Therefore, occasionally, when one shoe cover is not run smoothly on the installation arms without any resistance to be removed from the installation arms, or even being pulled to be broken, the user has to halt the dispenser machine to remove the stuck or broken shoe cover and reset the dispenser machine to function.

SUMMARY OF THE PRESENT INVENTION

The invention is advantageous in that it provides detachable shoe covers adapted to be dispensed by a dispenser device which installation arms are rigidly mounted to the frame without locking assembly while allowing the detachable shoe covers smoothly moving along the installation arms for dispensing.

Another advantage of the invention is to provide a detachable shoe cover configured to be installed to a dispenser device configured to hold multiple pairs of the detachable shoe covers in an orderly manner, thereby facilitating the integration storage of multiple pairs of the detachable shoe covers.

Another advantage of the invention is to provide a detachable shoe cover configured to be installed along a pair of installation arms of a dispenser arrangement of an installation assembly of the dispenser device without a requirement of the locking assembly while smoothly guiding the dispensing shoe cover to an open state for wearing.

Another advantage of the invention is to provide detachable shoe covers configured to be installed in series along the installation arms of the installation assembly of the dispenser device such that the detachable shoe covers can be feeding smoothly and be dispensing one by one without complicated locking and releasing mechanism and the hazard of being stuck or broken during the dispensing operation.

Another advantage of the invention is to provide detachable shoe covers configured to be installed in the installation assembly of the dispenser device that significantly reduces the difficulty of installing shoe covers.

Another advantage of the invention is to provide detachable shoe covers which are interconnecting with each other while installing in the dispenser device and each of which is configured to be detached from the dispenser device by simply pulling out after being worn on the shoe of the user.

Another advantage of the invention is to provide detachable shoe covers configured to be installed in the dispenser device in such a manner that after one shoe cover is detached, the subsequent shoe cover will not retract and be operated to the open state for being ready to be worn on the user's shoe.

Another advantage of the invention is to provide a detachable shoe cover, wherein a configuration of the detachable shoe cover is able to be detached from the installation arms of the installation assembly of the dispenser device and the subsequent shoe cover simply by pulling towards a direction from the subsequent shoe cover, or by separating from the subsequent shoe cover by a separator arranged at the end portions of the installation arms.

Another advantage of the invention is to provide detachable shoe covers adapted to be installed in a dispenser device in such a manner that the detachable shoe covers are interconnecting with each other through a detachable interconnection arrangement that allows the shoe cover being detached from the adjacent shoe cover while maintaining the elastic configuration for wearing and holding the shoe cover to cover the user's shoe.

Another advantage of the invention is to provide detachable shoe covers adapted to be installed in a dispenser device that enables the multiple pairs of the shoe covers to be adjacently connected to each other, so as to ensure that after one shoe cover is dispensed, an adjacent shoe cover is driven to be pulled to enlarge its opening, so there is no need to separately open the subsequent shoe cover. In other words, the shoe cover dispenser device can automatically open the shoe cover in turn, thereby facilitating wearing the shoe covers.

Another advantage of the invention is to provide detachable shoe covers configured to be installed in the dispenser device that is convenient to install a plurality of the shoe covers thereon, so as to reduce the difficulty of installing shoe covers.

Another advantage of the invention is to provide detachable shoe covers configured to be installed in the dispenser device, wherein after one shoe cover is taken out, the subsequent shoe cover will not retract due to elastic contraction force.

Additional advantages and features of the invention will become apparent from the description which follows and may be realized by means of the instrumentalities and combinations particular point out in the appended claims.

According to the present invention, the foregoing and other objects and advantages are attained by a detachable shoe cover assembly including a plurality of detachable shoe covers each of which is configured for being installed along two installation arms of an installation assembly of a dispenser device, guided to move to an dispenser arrangement of the installation assembly and dispensed from the dispenser arrangement of the installation assembly by detaching from the two installation arms, wherein each of the detachable shoe covers comprises:

- a shoe cover main body having a receiving cavity, an elastic opening edge portion defining an opening; and
- an interconnection arrangement arranged for interconnecting the plurality of detachable shoe covers one-by-one in series and held along the two installation arms of the installation assembly of the dispenser device, wherein the interconnection arrangement is configured to be separated by a separator of the dispenser device such that the detachable shoe cover is detached from the installation arms of the dispenser device.

In one embodiment, the detachable shoe cover can be broken away from the installation assembly while moving frontwards away from the installation assembly, such that the dispensing operation for the user is as simple as "step in" and "move out".

In one embodiment, the interconnection arrangement of the detachable shoe cover, which comprises a front portion of the shoe cover main body, a rear portion of the shoe cover main body, two front joint perforations provided in the front portion, and two rear joint perforations provided in the rear portion, is configured for interconnecting each of the plurality of detachable shoe covers of the detachable shoe cover assembly with another adjacent detachable shoe cover of the plurality of detachable shoe covers of the detachable shoe cover assembly along the two installation arms so as to installed in the installation assembly of the dispenser device.

In one embodiment, the shoe cover main body of each detachable shoe cover further provides a detachable connection arrangement at the elastic opening edge portion thereof for interconnecting with a subsequent detachable shoe cover.

In one embodiment, the shoe cover main body of each detachable shoe cover is interconnected with another detachable shoe cover by an interconnection member connected therebetween.

In one embodiment, the interconnection arrangement of the detachable shoe cover further comprises two interconnection members connected to the rear portion of the opening edge portion and the two rear joint perforations are formed in the two interconnection members respectively.

In one embodiment, a detachable line is extended from the joint perforation to an edge of the interconnection member, wherein the detachable line can be made to have a plurality of tiny perforations formed in the interconnection member or a thinner thickness than that of the interconnection member.

In one embodiment, each of the detachable shoe covers further comprises a ring shape elastic element provided around an open edge of the elastic opening edge portion to provide an elastic effect for being stretch to open the opening for wearing on a shoe of a user and to retracted to reduce a size of the opening for holding on the shoe of the user, wherein the front joint perforations are formed below the elastic element and the interconnection members are also connected to a position below the elastic element.

In one embodiment, the ring shape elastic element is provided below the front and rear joint perforations of the interconnection arrangement of the detachable shoe cover.

In one embodiment, the two rear joint perforations are formed in the rear portion of the shoe cover main body and positioned below the ring shape elastic element provided around the opening edge. In addition, a sealing portion is formed between the opening edge and each of the front and rear joint perforations of the detachable shoe cover, and a detachable line is formed and extended from the opening edge to each of the front and rear joint perforations.

In one embodiment, the detachable shoe cover comprises two front interconnection members spacedly connected to the front portion of the shoe cover main body and two rear interconnection members spacedly connected to the rear portion of the shoe cover main body, wherein the two front interconnection members have two front joint perforations formed therein respectively and the two rear interconnection members have two rear joint perforations formed therein respectively.

In one embodiment, the interconnection member is connected between the rear portion of a detachable shoe cover and the front portion of a subsequent adjacent detachable shoe cover of the detachable shoe cover assembly. In addition, a detachable line may be formed across the interconnection member.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

As shown in FIG. 1 to FIG. 4, a dispenser device for detachable shoe covers 90 according to a preferred embodiment is illustrated. The dispenser device comprises an installation assembly 10, a frame 20 and a separator 30.

Figure 11:
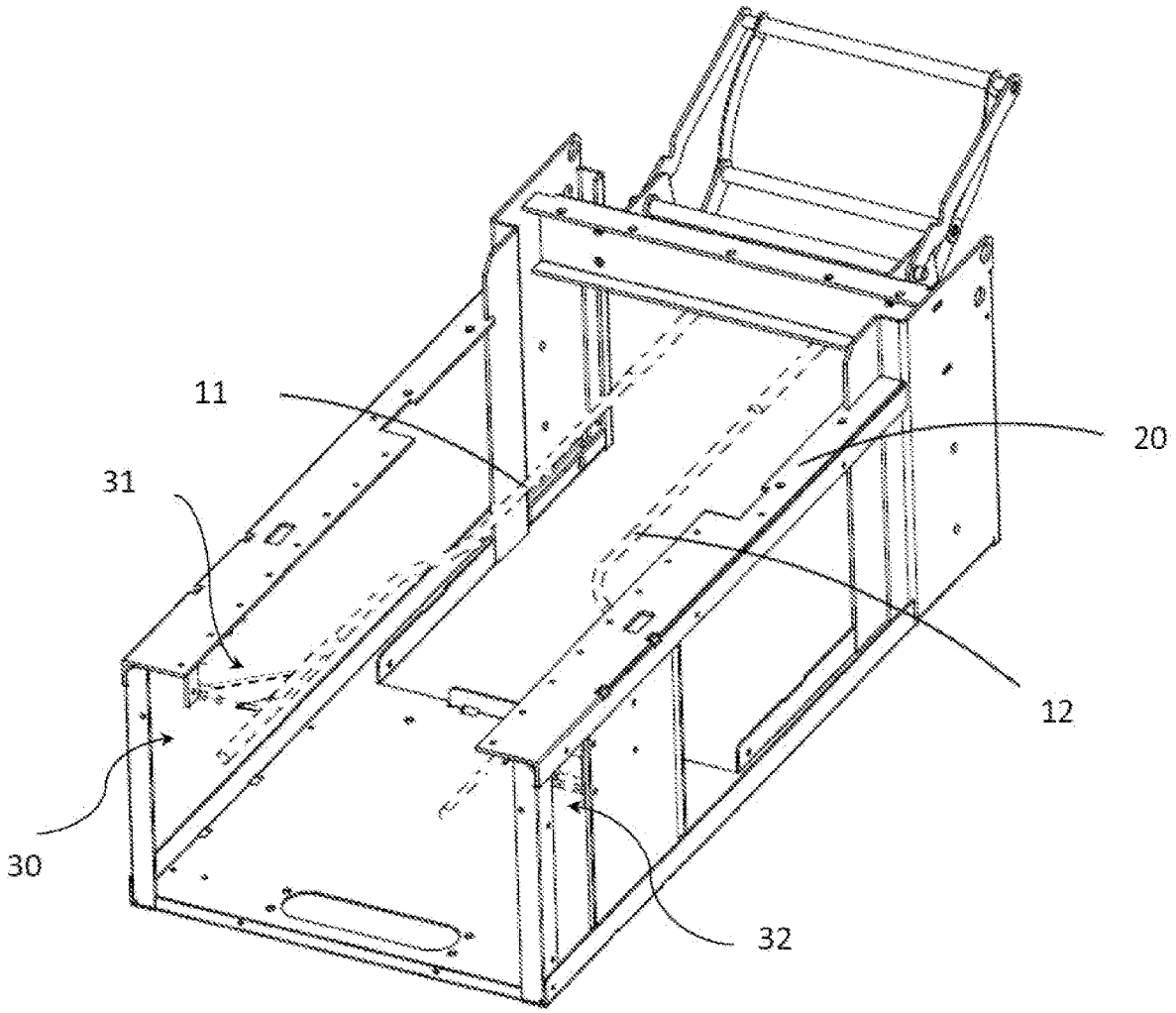
FIG. 11 is a perspective view of the frame of the dispenser device for installing the pair of linear installation arms as shown in FIG. 10A according to the above preferred embodiment of the present invention.

The installation assembly 10 is installed in the frame 20, as shown in FIG. 11, and comprises a pair of elongated installation arms 11, 12 for installing the detachable shoe covers 90, wherein the two installation arms 11, 12 are arranged and configured to provide a dispenser arrangement 101 at end portions 111, 112 of the installation arms 11, 12 for guiding a frontmost detachable shoe cover 901 of the detachable shoe covers 90 installed in the installation assembly 10 to be dispensed in an open state for wearing. The separator 30 arranged at the end portions 111, 121 of the installation arms 11, 12 for separating the frontmost detachable shoe cover 901 from the installation arms 11, 12 after being worn on a shoe of a user.

The frame 20, as shown in FIG. 11, is a structure configured to support the pair of installation arms 11, 12 extending from a rear end to a front end of the frame 20 in parallel manner to define an installation arrangement 102, a transition arrangement 103 and the dispenser arrangement 101 of the installation assembly 10.

In particular, the two installation arms 11, 12 are parallelly extended to have a predetermined length and an installation distance ID therebetween for the plurality of detachable shoe covers 90 to be stacked together one-by-one in series and held therealong to form the installation arrangement 102. In other words, the longer the installation arrangement 102, the more detachable shoe covers 90 can be received and carried for dispensing. The two installation arms 11, 12 are parallelly and frontwardly extended to have a dispenser distance DD therebetween at the front end portions 111, 121 thereof to form the dispenser arrangement 101, wherein the dispenser distance DD is wider than the installation distance ID. The two installation arms 11, 12 are gradually extended from the installation arrangement 102 to the dispenser arrangement 101 frontwardly and outwardly in a symmetrical manner to form the transition arrangement 103.

Figure 5A:
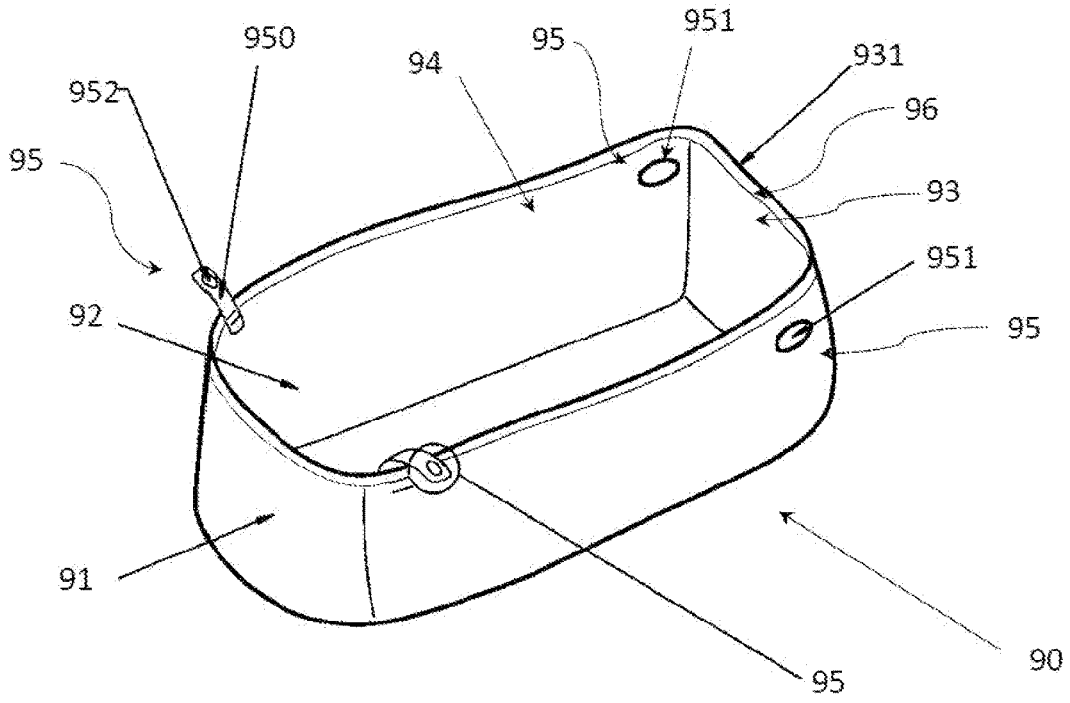
FIG. 5A is a perspective view of a detachable shoe cover in an open state according to the above preferred embodiment of the present invention.

Referring to FIG. 5A, each of the detachable shoe covers 90 comprises a shoe cover main body 91 having a receiving cavity 92 and an elastic opening edge portion 93 defining an opening 94, and an interconnection arrangement 95 arranged for interconnecting the detachable shoe covers 90 to be installed in the dispenser device. The interconnection arrangement 95 includes a front portion of the shoe cover main body 91, a rear portion of the shoe cover main body 91, two front joint perforations 951 provided in the front portion, and two rear joint perforations 952 provided in the rear portion, for interconnecting each of the plurality of detachable shoe covers 90 with another adjacent detachable shoe cover 90 of the plurality of detachable shoe covers 90 along the two installation arms 11, 12 so as to be installed in the dispenser device.

Figure 5C:
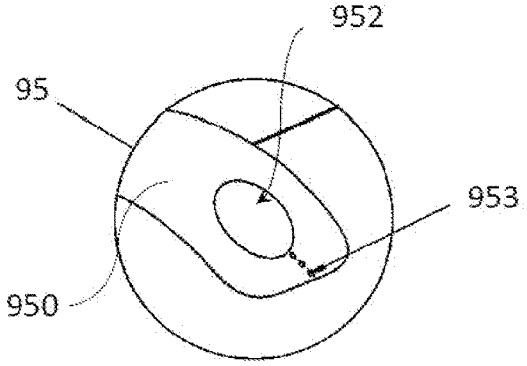
FIG. 5C is an enlarged view of a connection member of the detachable shoe cover according to the above preferred embodiment of the present invention.
Figure 5B:
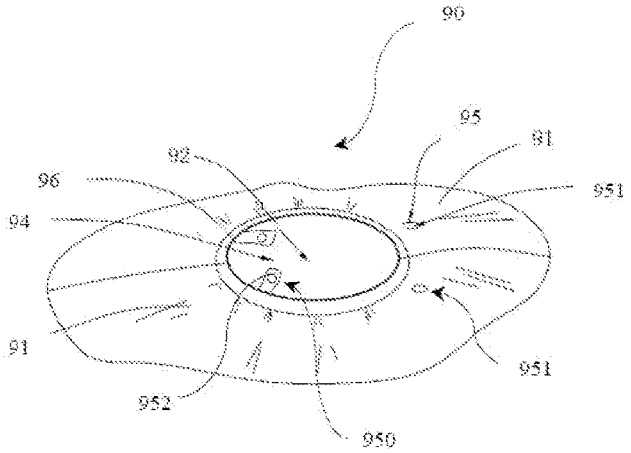
FIG. 5B is a perspective view of the detachable shoe cover in a normal state according to the above preferred embodiment of the present invention.

The interconnection arrangement 95 of the detachable shoe cover 90 can be embodied as various modes. Referring to FIG. 5A and FIG. 5B, the interconnection arrangement 95 of the detachable shoe cover 90 further comprises two interconnection members 950 integrally connected to the rear portion of the elastic opening edge portion 93 and the two front joint perforations 951 formed in a front portion of the elastic opening edge portion 93, the two rear joint perforations 952 are formed in the two interconnection members 950 respectively. Referring to FIG. 5C, according to the preferred embodiment, to facilitate the detachable shoe cover 90 to be detached from the installation assembly 10 upon pulling force, a detachable line 953 is extended from the joint perforation 952 to an edge of the interconnection member 950. The detachable line 953 can be embodied to have a plurality of tiny perforations formed in the interconnection member 950, a thinner thickness than that of the interconnection member 950, and etc.

According to the preferred embodiment of the present invention, each of the detachable shoe covers 90 further comprises a ring shape elastic element 96 provided around an opening edge 931 of the elastic opening edge portion 93 to provide an elastic effect for being stretched to open the opening 94 for wearing on a shoe of a user and to retracted to reduce a size of the opening 94 for holding on the shoe of the user. The front joint perforations 951 are formed below the elastic element 96 and the interconnection members 950 are also connected to a position below the elastic element 96.

Figure 1:
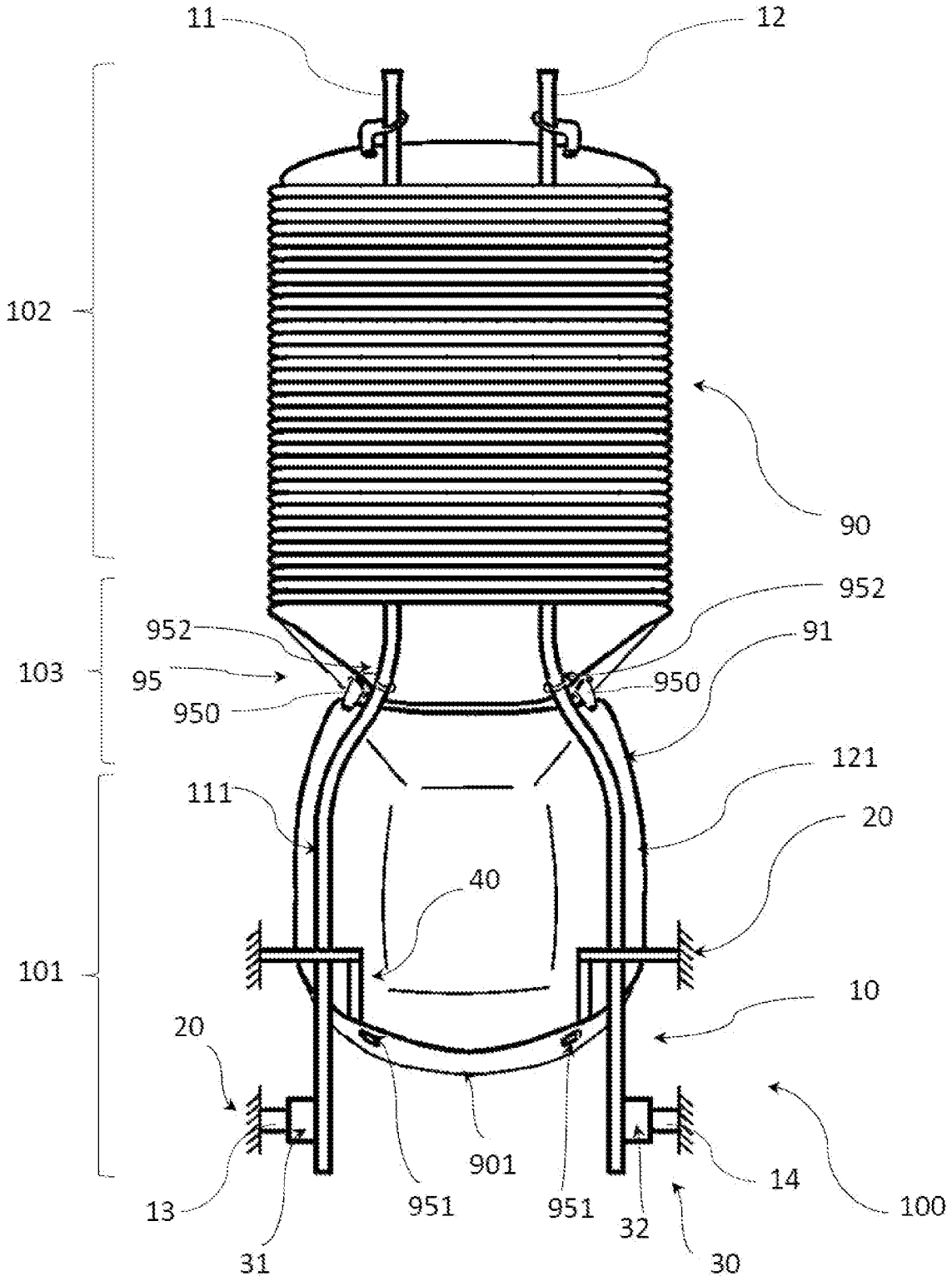
FIG. 1 is a schematic view of a dispenser device for detachable shoe covers according to a preferred embodiment of the present invention.
Figure 2:
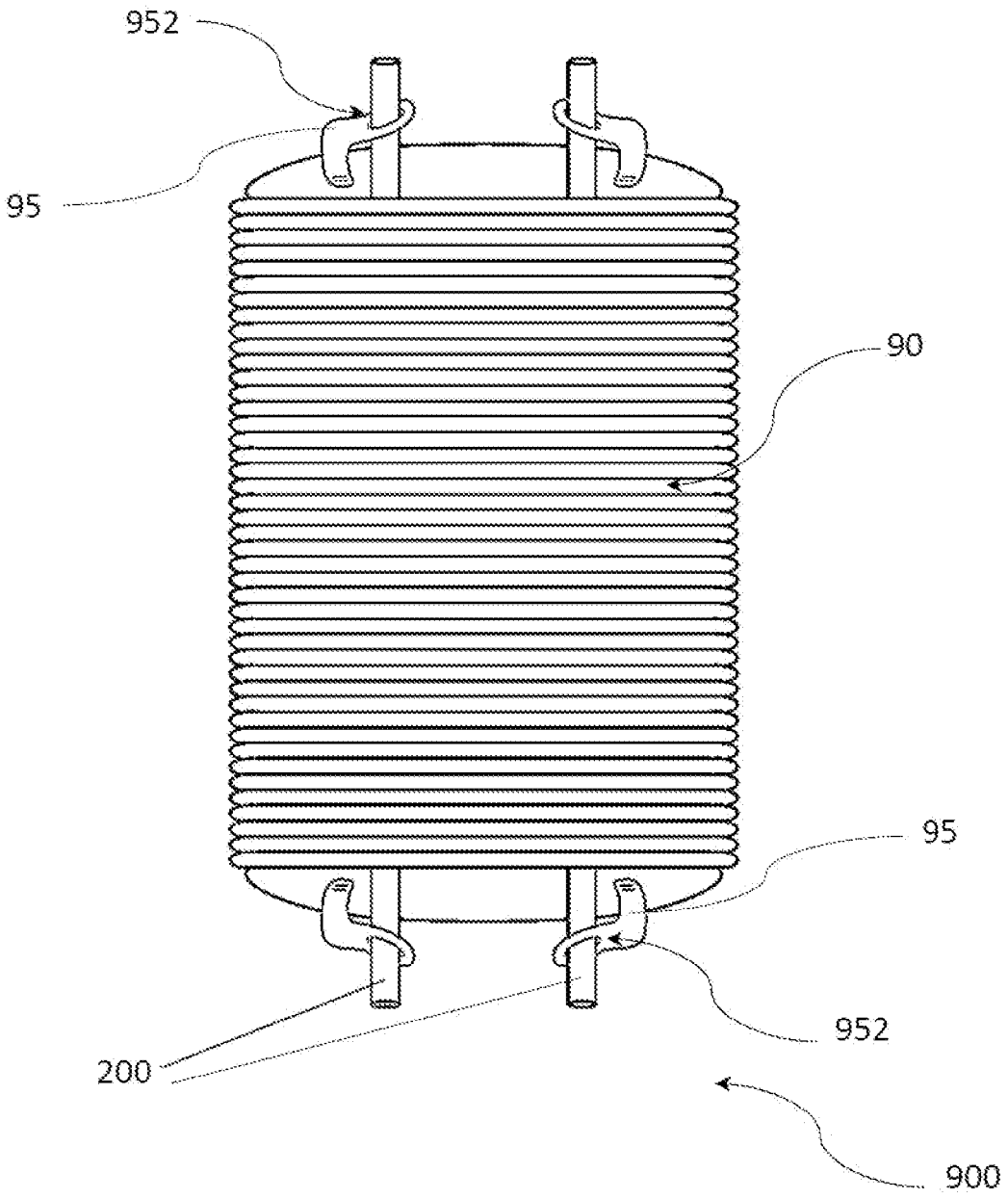
FIG. 2 is a schematic view of a shoe cover assembly of the detachable shoe covers configured for being dispensed by the dispenser device according to the above preferred embodiment of the present invention.
Figure 6:
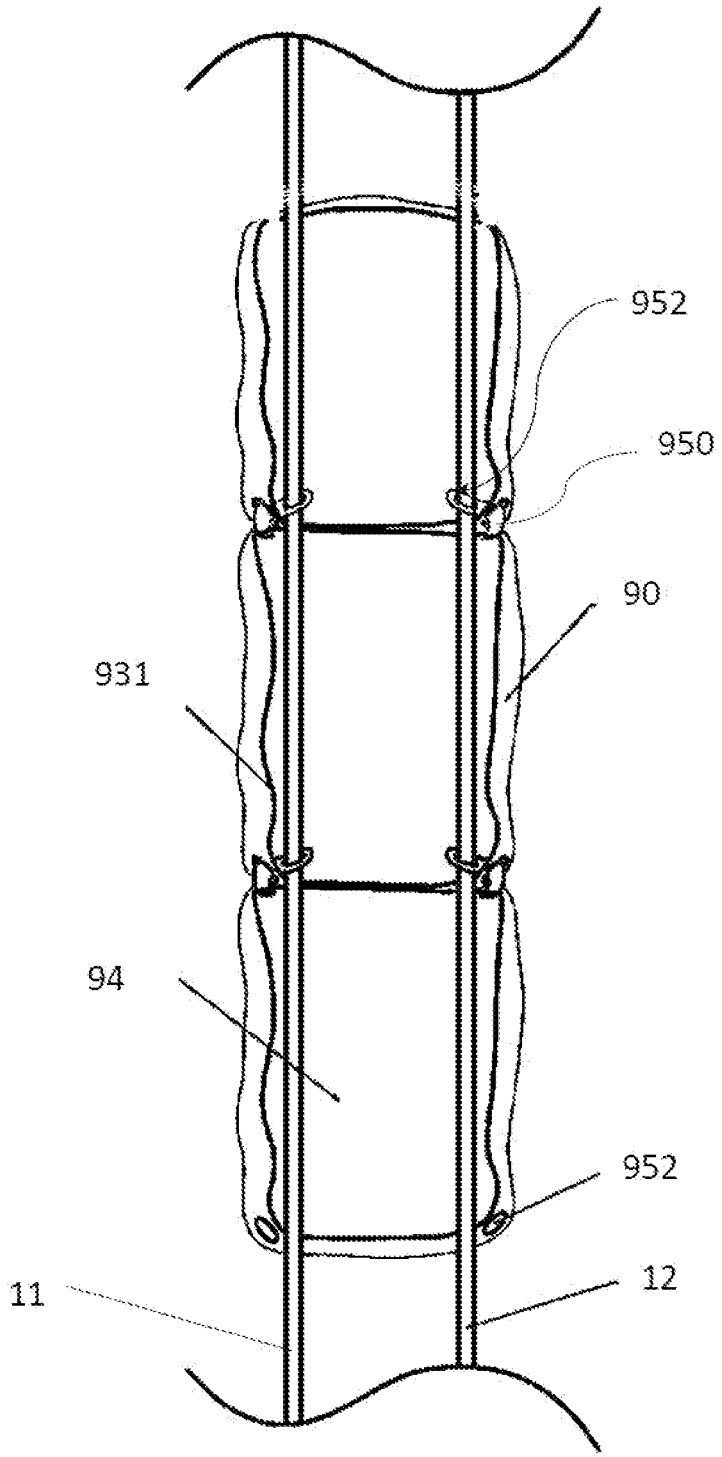
FIG. 6 is a schematic view illustrating the installation arrangement of the detachable shoe covers and the dispenser device according to the above preferred embodiment of the present invention.

Referring to FIG. 6, to interconnecting the detachable shoe covers 90 one-by-one in series with the two installation arms 11, 12, the two interconnection members 950 of each of the detachable shoe covers 90 are penetrated through the two front joint perforations 951 of an adjacent detachable shoe cover 90 from outer side to inner side respectively. Then, the two interconnection members 950 are hanged to the two installation arms 11, 12 respectively by penetrating the two installation arms 11, 12 through the two rear joint perforations 952 of the two interconnection members 950 respectively, such that the plurality of detachable shoe covers 90 are installed along the two installation arms 11, 12 of the installation assembly 10. For illustration purpose, the detachable shoe covers 90 are stretched to open state as shown in FIG. 6 to illustrate the interconnecting configuration between the interconnection members 950, the front and rear joint perforations 951, 952 and the two installation arms 11, 12. Normally, as shown in FIG. 1, the plurality of detachable shoe covers 90 installed in the installation arrangement 102 of the installation assembly 10 is stacked one-by-one in series along the two installation arms 11, 12 of the installation assembly 10 to maximize the storage capacity of the detachable shoe covers 90.

Figure 4:
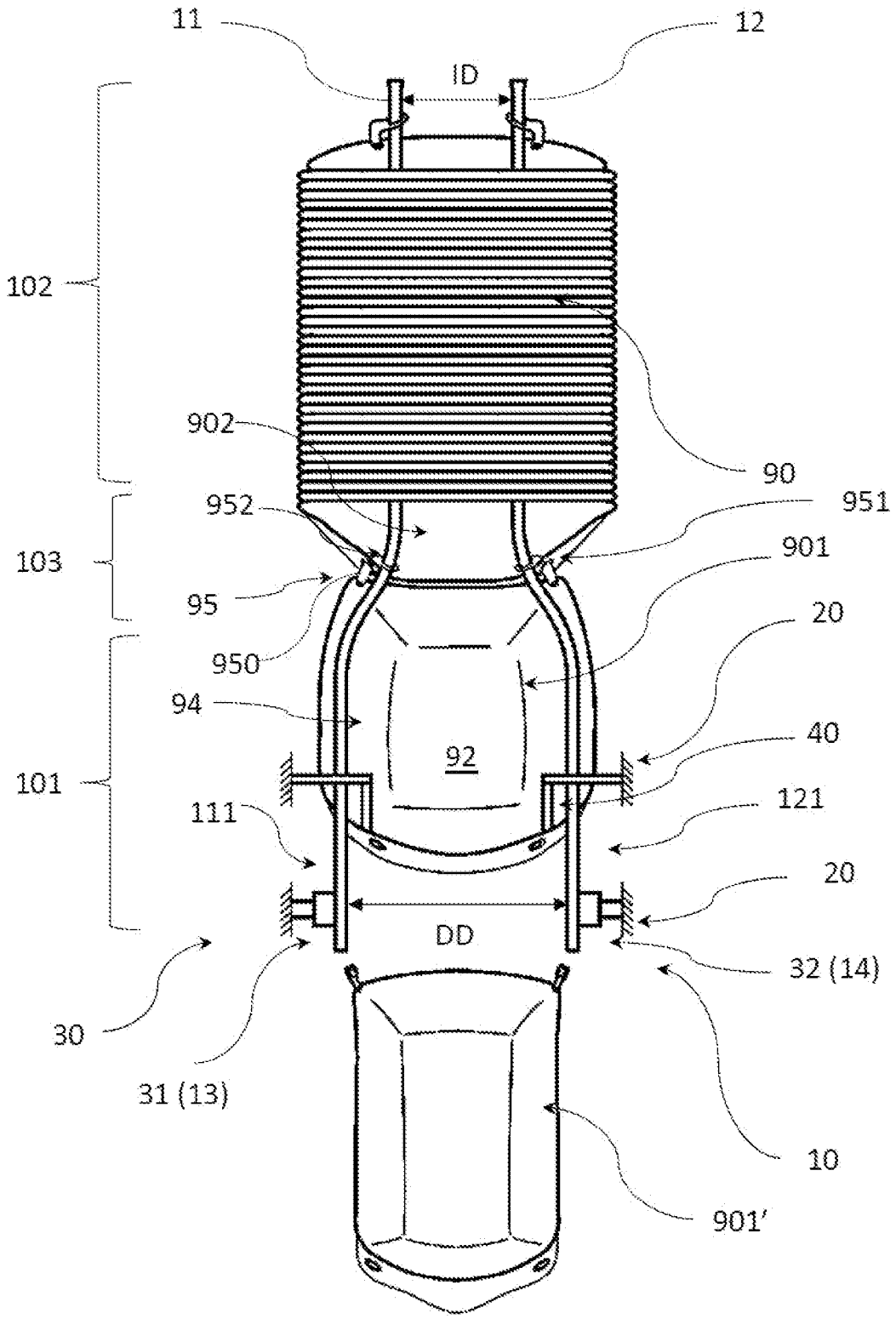
FIG. 4 is a schematic view of the dispenser device installed with the detachable shoe covers during dispensing of a frontmost detachable shoe cover from a subsequent detachable shoe cover according to the above preferred embodiment of the present invention.

Referring to FIG. 4 and FIG. 5A, a first distance between the two interconnection members 950 is generally equal to a second distance between the two front joint perforations 951, wherein each of the first distance and the second distance is generally equal to the dispenser distance DD between the two parallel installation arms 11, 12 in the dispenser arrangement 101 of the installation assembly 10, so that each of the detachable shoe covers 90 can be stretched out to the open state by the two installation arms 11, 12 in the dispenser arrangement 101 of the installation assembly 10. Also, the elastic element 96 is configured to normally contract and reduce a size of the opening 94, that is the first distance between the two interconnection members 950 and the second distance between the two front joint perforations 951 are reduced correspondingly to match the installation distance ID between the two parallel installation arms 11, 12 in the installation arrangement 102 that is narrower than the dispenser distance DD, as shown in FIG. 4.

To facilitate the installation of the plurality of detachable shoe covers 90 in the installation assembly 10, the plurality of shoe covers 90 are pre-installed to a pair of tubular connection rods 200 to form a shoe cover package 900, as shown in FIG. 3, wherein a length of the connection rod 200 is embodied shorter or equal to a length of the portion of the installation arms 11, 12 of the installation arrangement 102 of the installation assembly 10, a distance between the two connection rods 200 is equal to the installation distance ID of the two installation arms 11, 12, and a diameter of the tubular hole of the connection rod 200 is preferred to be slightly larger than a diameter of the installation arm 11, 12.

Figure 3A:
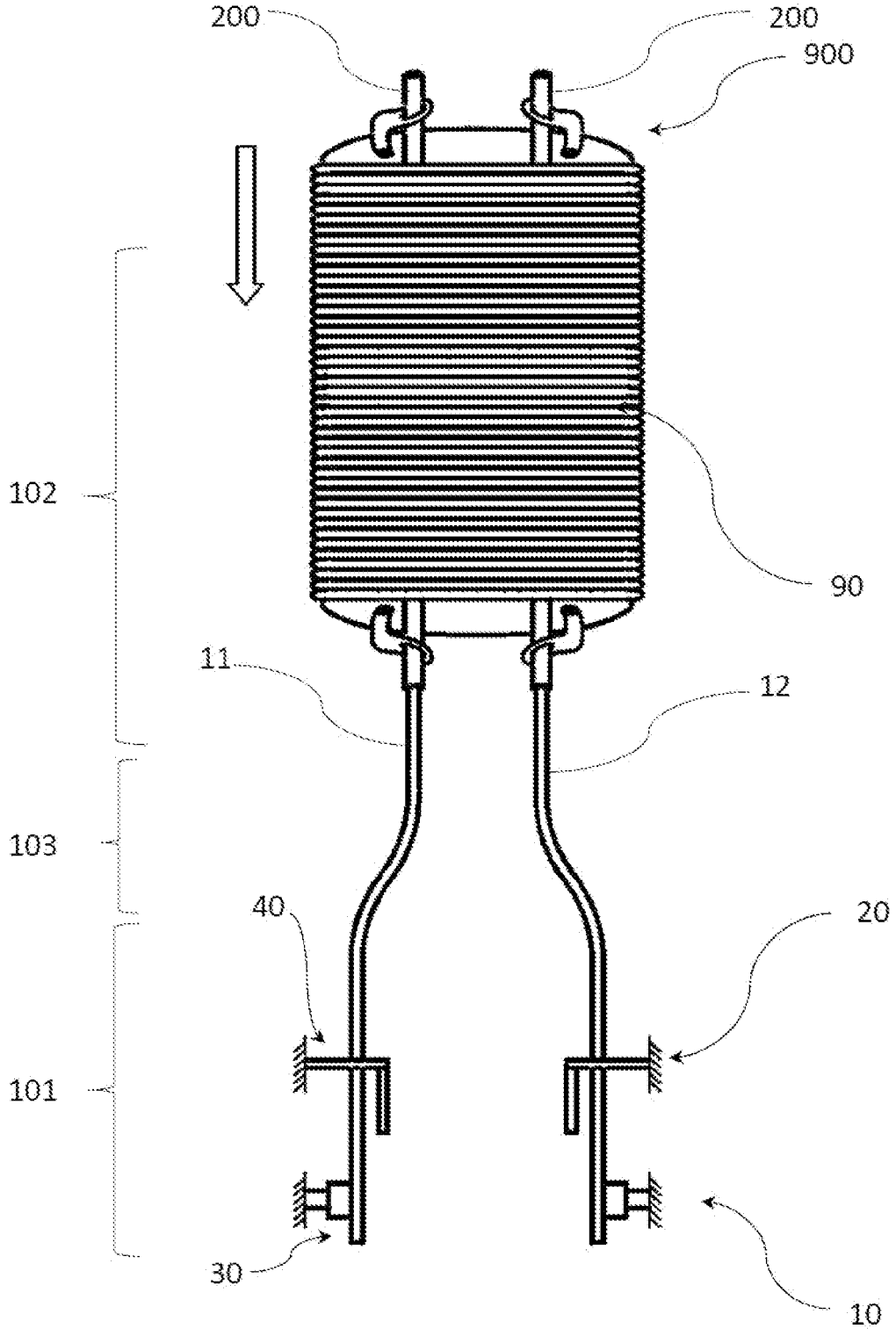
FIG. 3A and FIG. 3B are schematic views illustrating the operation of installing the detachable shoe covers of the shoe cover assembly to the installation assembly according to the above preferred embodiment of the present invention.

It is appreciated that the shoe cover package 900 can be pre-assembled in the supplier or seller thereof for ease of storage and transportation. In addition, the shoe cover package 900 further facilitates the installation of the detachable shoe covers 90 in the installation assembly 10. Referring to FIG. 3A, simply by inserting the portions of the installation arms 11, 12 in the installation arrangement 102 of the installation assembly 10 into the two connection rods 200 of the shoe cover package 900, the shoe cover package 900 is mounted to the installation arms 11, 12.

Figure 3B:
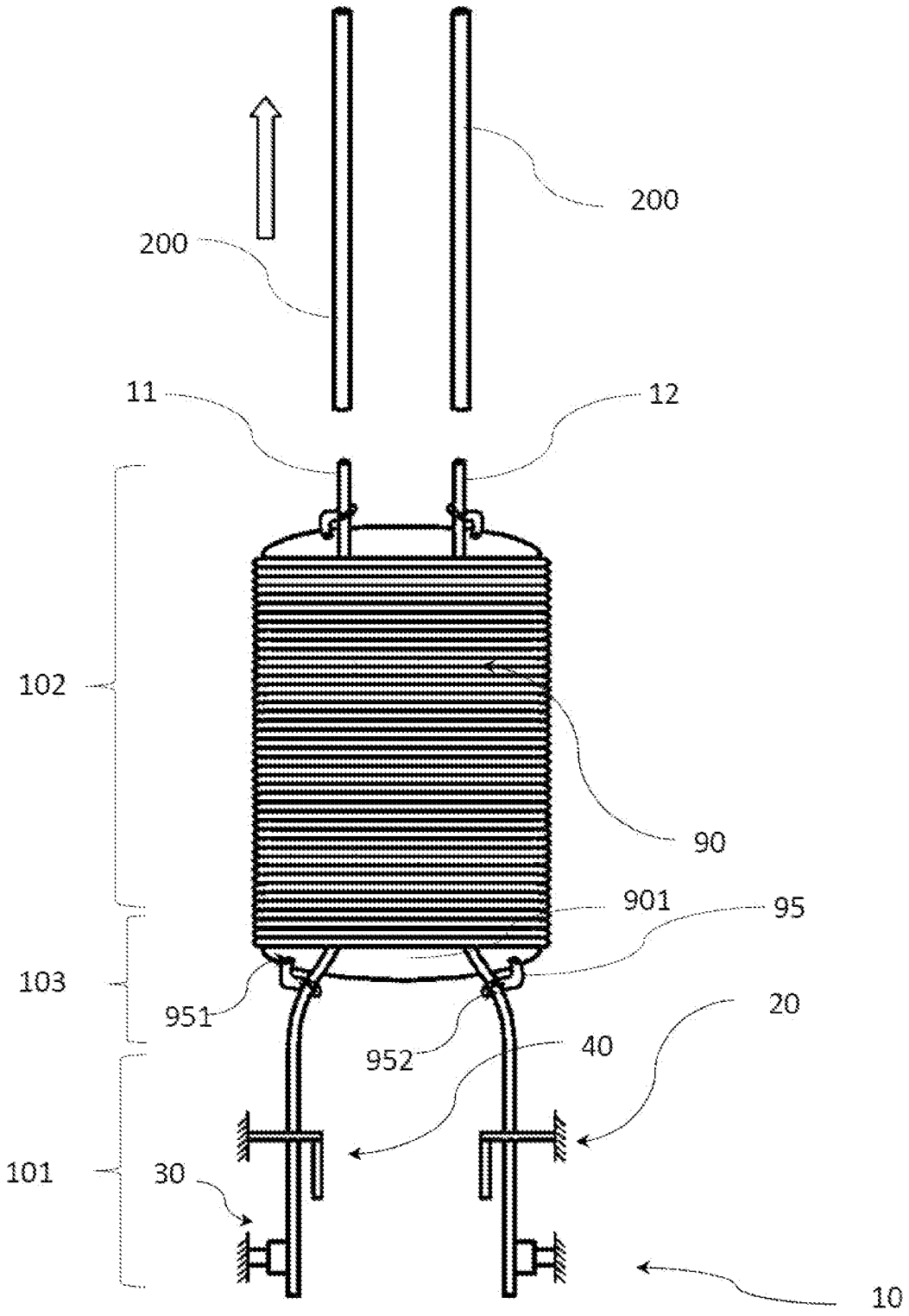

Referring to FIG. 3B, to install the plurality of detachable shoe covers 90 along the installation arms 11, 12 becomes so easily by pulling out the two connection rods 200 such that the interconnection members 950 of the detachable shoe covers 90 are hanged to the installation arms 11, 12. That is the two installation arms 11, 12 penetrate through the two rear joint perforations 952 of the two interconnection members 950 of each of the detachable shoe covers 90 respectively, while the two interconnection members 950 of each detachable shoe cover 90 are extended from outside to inside through the front joint perforations 951 of the adjacent detachable shoe cover 90 as shown in FIG. 6.

It is worth mentioning that the installation assembly 10 of the present invention is effectively simplified in structure and minimizes the manufacturing steps and cost by the curved configuration of the installation arm 11, 12 without the need of any complicated and additional component. The symmetrical configuration of the elongated and curved installation arms 11, 12 of the installation assembly 10 defines the installation arrangement 102, the transition arrangement 103 and the dispenser arrangement 101 of the installation assembly 10, wherein after the package of the plurality of detachable shoe covers 90 is installed to the installation arrangement 102, referring to FIG. 3B and FIG. 4, the distance between the portions of the installation arms 11, 12 of the installation arrangement 102 is generally equal to the distance between the two interconnection members 950 of each of the plurality of detachable shoe covers 90 so that each detachable shoe cover 90 is in a normal state without stretching to open its opening 94 and thus the plurality of detachable shoe covers 90 is stacked together in the installation arrangement 102. In the transition arrangement 103 of the installation assembly 10, the two installation arms 11, 12 are gradually extended frontwardly and outwardly, that substantially restricts the installed detachable shoe covers 90 in the installation arrangement 102 from moving forwards without any pulling force applied to the frontmost detachable shoe cover 901, as shown in FIG. 3B, and guides the detachable shoe cover 90 to move to the dispenser arrangement 101 along the installation arms 11, 12 gradually and smoothly.

Referring to FIG. 1 to FIG. 4, the separator 30 is preferred to be provided at a front portion of the dispenser arrangement 101, that is front ends of the installation arms 11, 12 according to the preferred embodiment and configured to detach the frontmost detachable shoe cover 901 from the subsequent detachable shoe cover 902 by separating the interconnection arrangement 95, that is separating the interconnection members 950 at the detachable lines 953 thereon, as shown in FIG. 5C, according to the preferred embodiment of the present invention.

Referring to FIG. 4, upon a pulling force is applied to the frontmost detachable shoe cover 901 frontwards, the frontmost detachable shoe cover 901 is pulled to move frontwards and be stretched out between the portions of the two installation arms 11, 12 of the dispenser arrangement 101 in an open state while a front portion, including the two front joint perforations 951 thereof, of a subsequent detachable shoe cover 902 of the plurality of detachable shoe covers 90 is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901 is stretched out to the dispenser arrangement 101, the transition arrangement 103 substantially forms a rear retaining configuration to limit the rear portion of the stretched out frontmost detachable shoe cover 901 from re-stretching back to the installation arrangement 102. In order to maintain the frontmost detachable shoe cover 901 in the dispenser arrangement 101 in the open state, the installation assembly 10 further comprises a front retaining configuration 40 to restrict the front portion of the frontmost detachable shoe cover 901 retaining in the open state that the elastic element 96 is stretched out and extended to open the opening 94 enough for the user to place his or her shoe in the receiving cavity 92 of the detachable shoe cover 90, as shown in FIG. 5A.

In view of FIG. 4, in order to dispense a detachable shoe cover 90, the user may simply place his or her shoe in the receiving cavity 92 through the opening 94 to wear the frontmost detachable shoe cover 901 on the shoe and then move the worn frontmost detachable shoe cover 901 frontwards until the two interconnection members 950 reach the separator 30. Accordingly, a continuous frontward movement of the frontmost detachable shoe cover 901 away from the dispenser arrangement 101 not only pulls the interconnection members 950 against the separator 30 until the interconnection members 950 is broken by the separator 30 to detach the frontmost detachable shoe cover 901 from the subsequent detachable shoe cover 902 and separate from the installation assembly 10 to form a detached detachable shoe cover 901' worn on the user's shoe, wherein the previously subsequent detachable shoe cover 902 is also pulled to move the dispenser arrangement 101 becoming the frontmost detachable shoe cover 901 being opened in the dispenser arrangement 101 for wearing and the next detachable shoe cover 90 interconnecting with the original subsequent detachable shoe cover 902 is also pulled frontwards to be partially opened at the transition arrangement 103 and forms the current subsequent detachable shoe cover 902 of the current frontmost detachable shoe cover 901.

Figure 7A:
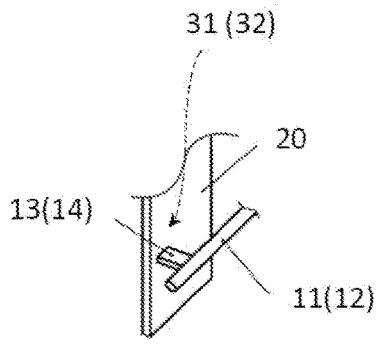
FIG. 7A to FIG. 7C are partial schematic views illustrating alternative modes of the stationary mounting of the installation arm to the frame of the dispenser device according to the above preferred embodiment of the present invention.
Figure 7B:
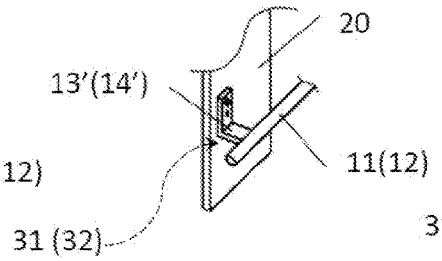
Figure 7C:
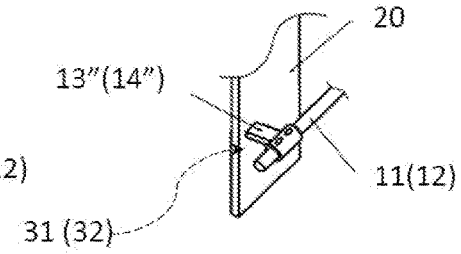

Referring to FIG. 7A to FIG. 7C, according to the preferred embodiment, the installation assembly 10 further comprises a pair of connectors 13,14 rigidly mounted between the frame 20 and the front ends of the pair of installation arms 11, 12 so as to rigidly support the pair of installation arms 11, 12 to the frame 20 in parallel manner. Each of the connectors 13, 14 can be a connecting member integrally extended between the frame 20 and the respective installation arm 11, 12 by welding as shown in FIG. 7A. Person skilled in the art may understand that multiple supporting elements can be used to support the installation arm 11, 12 to the frame in a secure and rigid manner. For example, each of the connectors 13, 14 can be a L-shaped mount 13', 14' having one end integrally welded to the respective installation arm 11, 12 and the other end screwed to the frame 20 as shown in FIG. 7B. Alternatively, each of the connectors 13", 14" can be configured to have one end integrally connected to the frame 20 and a tubular holder to sleeve and hold the front end portion 111, 121 of the respective installation arm 11, 12 in position in a rigid and firm manner, as shown in FIG. 7C.

As shown in FIG. 1 and FIG. 4, the separator 30 is preferred to comprise a pair of resistant separating members 31, 32 provided at the front end portions 111, 121 of the installation arms 11, 12, each of which is configured to break the detachable line 953 of the interconnection member 950 hanged to the respective installation arm 11, 12 when the frontmost detachable shoe cover 901 is pulled to move out frontwardly from the installation arms 11, 12, wherein the two separating members 31, 32 are positioned that the two interconnection members 950 of the pulling out frontmost detachable shoe cover 901 would come across the two separating members 31, 32 respectively and the continuously frontward moving of the frontmost detachable shoe cover 901 would apply a shearing force to each of the interconnection members 950 against the respective separating member 31, 32 and the two interconnection members 950 are broken apart at the weaken detachable lines 953 generally allowing the frontmost detachable shoe cover 901 detaching from the installation assembly 10 of the dispenser device, as shown in FIG. 4.

As shown in FIG. 1 and FIG. 4, the two separating members 31, 32 can be integrally provided between connectors 13, 14 and the two installation arms 11, 12 respectively.

It is appreciated that the two connectors 13, 14, as shown in FIG. 1 and FIGS. 7A to 7C, can be functioned as the separating members 31, 32 too, as along as the connectors 13, 14 are made strong enough to break and/or separate the interconnection members 950, wherein the formation of the detachable line 953 does facilitate the breaking and/or separating of the interconnection members 950. Similarly, the separating members 31, 32 may also be configured to function as the connectors 13, 14 such that the separator 30 not only provides the separating configuration and ability to the detachable shoe covers 90 but also provides the supporting function to the installation arms 11, 12 at the same time that further simplifies the structure and reduces the weight of the dispenser device of the present invention.

Figure 8:
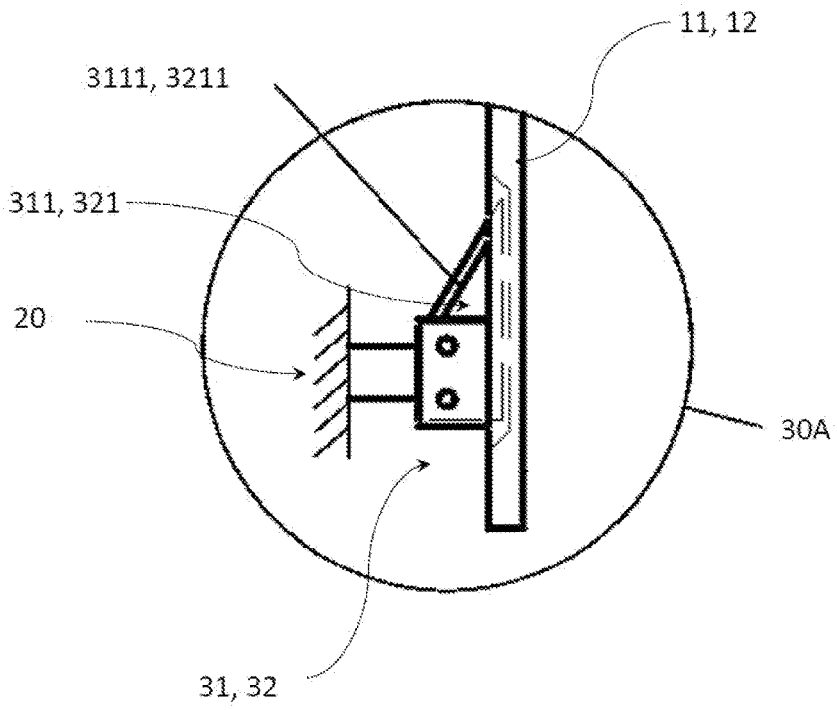
FIG. 8 is an enlarged view illustrating a cutter separator of the dispenser device according to the above preferred embodiment of the present invention.

Referring to FIG. 8, an alternative mode of the separator 30 is illustrated, wherein the separator 30 can be configured to be a cutter separator 30A that a cutter 311, 321 is inclinedly mounted on each of the separating members 31, 32 while the cutting blade 3111, 3211 of the cutter 311, 321 is facing backward inclinedly towards the installed detachable shoe covers 90 and two sides of the cutter 311, 321 are embedded in the separating member 31, 32 and the installation arm 11, 12 respectively to achieve a firm and rigid configuration for separating member 31, 32 as well as the dispenser arrangement 101. Accordingly, while the interconnection members 950 of each of the detachable shoe cover 90 are moving frontward against the cutters 311, 321 respectively, the cutters 311, 321 will cut off the interconnection members 950 to separate the detachable shoe cover 90 from the installation assembly 10. Therefore, even though there is no detachable line 953 provided on the interconnection member 950, the cutter may still cut off the interconnection member 950 easily.

The key of the cutter separator 30A is the cutter 311, 321 made in various configurations as long as a cutting blade 3111, 3211 is formed on the separating member 31, 32 that faces rearwards. Alternative modes of the cutter separator 30A are illustrated in FIG. 9A to FIG. 9C.

Figure 9A:
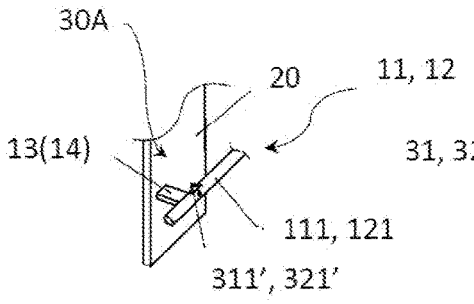
FIG. 9A to FIG. 9C are partial schematic views illustrating alternative modes of the cutter separator of the dispenser device according to the above preferred embodiment of the present invention.

As shown in FIG. 9A, the cutter separator 30A is embodied to comprise a pair of triangular cutters 311', 321' protruded on the front end portions of the installation arms 11, 12 respectively at positions adjacent to the connectors 13, 14 respectively, such that the interconnection members 950 are cut off by the cutters 311', 321' to separate from the installation arms 11, 12 so as to detach the detachable shoe cover 90 from the installation assembly 10.

Figure 9B:
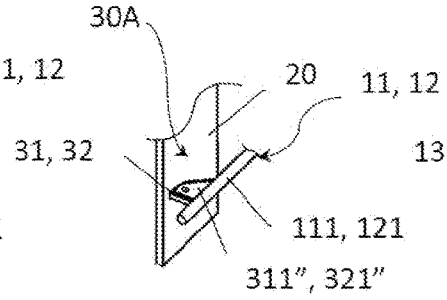

As shown in FIG. 9B, the cutters 311", 321", each having a cutting blade facing rearwards, are mounted on top of the separating members 31, 32 to form the cutter separator 30A, such that the interconnection members 950 are cut off by the cutters 311", 321" to separate from the installation arms 11, 12 so as to detach the detachable shoe cover 90 from the installation assembly 10.

Figure 9C:
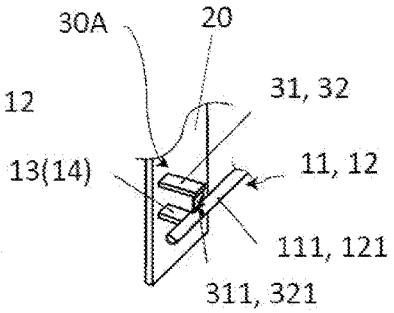

As shown in FIG. 9C, the separating members 31, 32 are mounted on top of the connectors 13, 14 and the cutters 311, 321, each having a cutting blade facing rearwards, are downwardly extended from the separating members 31, 32 to the installation arms 11, 12 respectively to form the cutter separator 30A, such that the interconnection members 950 are cut off by the cutters 311, 321 to separate from the installation arms 11, 12 so as to detach the detachable shoe cover 90 from the installation assembly 10.

Figure 10A:
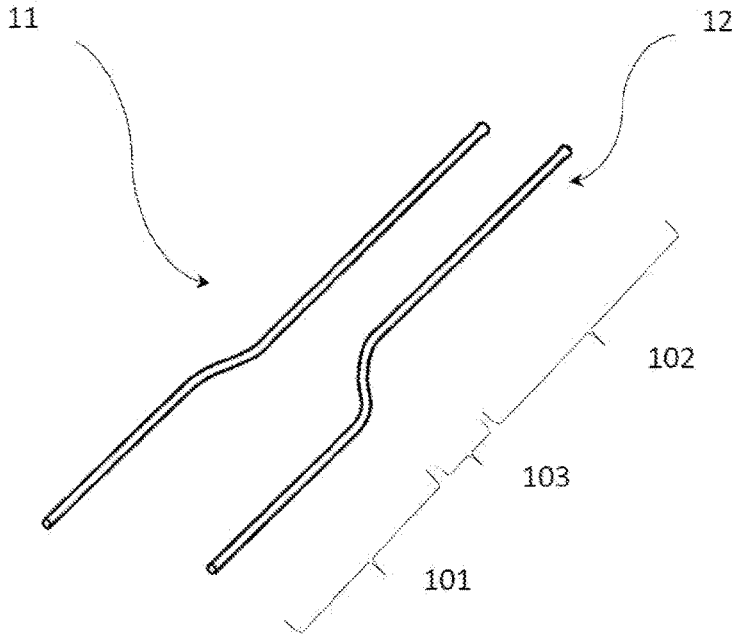
FIG. 10A is a schematic view of a pair of installation arms of the dispenser device according to the above preferred embodiment of the present invention.
Figure 10B:
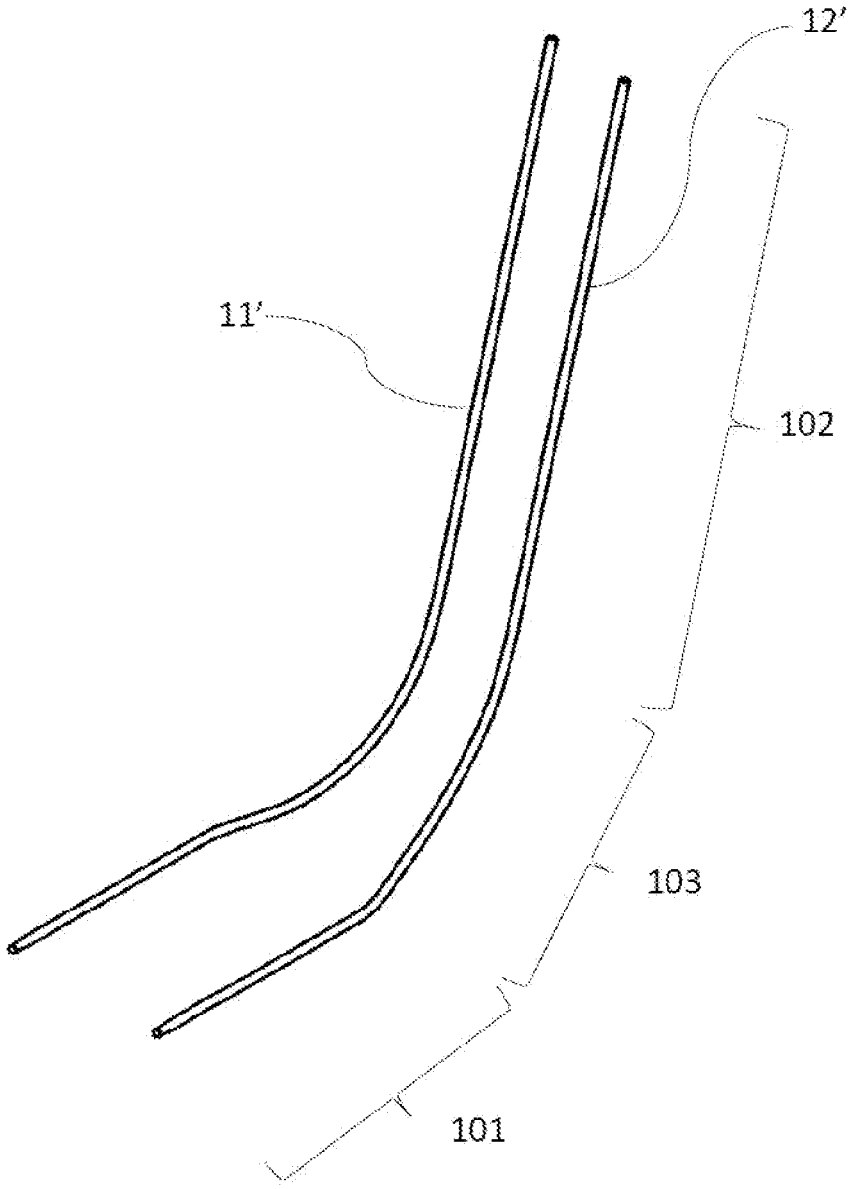
FIG. 10B is a schematic view illustrating an alternative mode of the pair of installation arms of the dispenser device according to the above preferred embodiment of the present invention.
Figure 12:
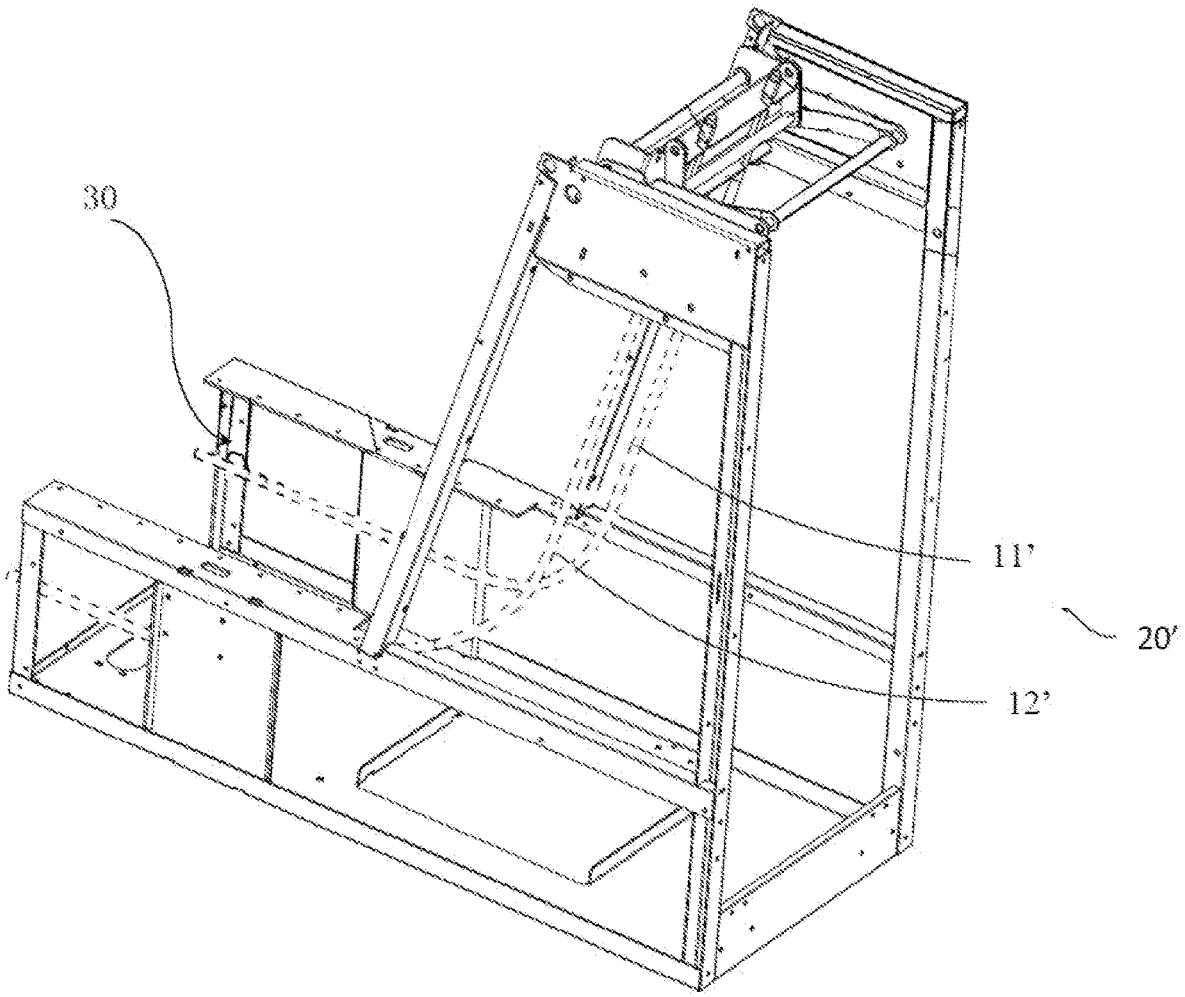
FIG. 12 is a perspective view of an alternative mode of the frame of the dispenser device for installing the pair of L shape installation arms as shown in FIG. 10B according to the above preferred embodiment of the present invention.

FIG. 10A illustrates the pair of parallel and symmetrical installation arms 11, 12 in linear pattern as described in the above preferred embodiment. As shown in FIG. 10B, an alternative mode of the installation arms 11, 12 is illustrated, wherein the pair of installation arms 11', 12' are made in L shape and supported parallelly and symmetrically to the frame 20 to form the installation assembly 10. The installation arm 11', 12' are extended parallelly and horizontally to define the dispenser arrangement 101, extended curvedly, inwardly and upwardly to define the transition arrangement 103, and then extended upwardly and inclinedly in parallel to define the installation arrangement 102. The L-shape installation arms 11', 12', which are supported to the L-shape frame 20' to form an alternative mode of the dispenser device as shown in FIG. 12, functions basically as the linear installation arms 11, 12, as shown in FIG. 1 to FIG. 4, while the upwardly and inclinedly extended upper portions of the installation arms 11', 12' may provide more room to install more detachable shoe covers 90 thereon for use.

According to the present invention, the pair of installation arms 11, 12 are configured to have a funnel configuration defining the narrower and parallel installation arrangement 102, the curved transition arrangement 103 and the wider and parallel dispenser arrangement 101 as shown in FIGS. 1-4 and FIGS. 10A-12, wherein the transition arrangement 103 of the installation assembly 10 can be functioned as the rear retaining configuration to limit the rear portion of the stretched out frontmost detachable shoe cover 901 from re-stretching back to the installation arrangement 102. However, the installation assembly 10 may further comprise a rear retaining arrangement 50 on the transition arrangement 103.

Figure 13A:
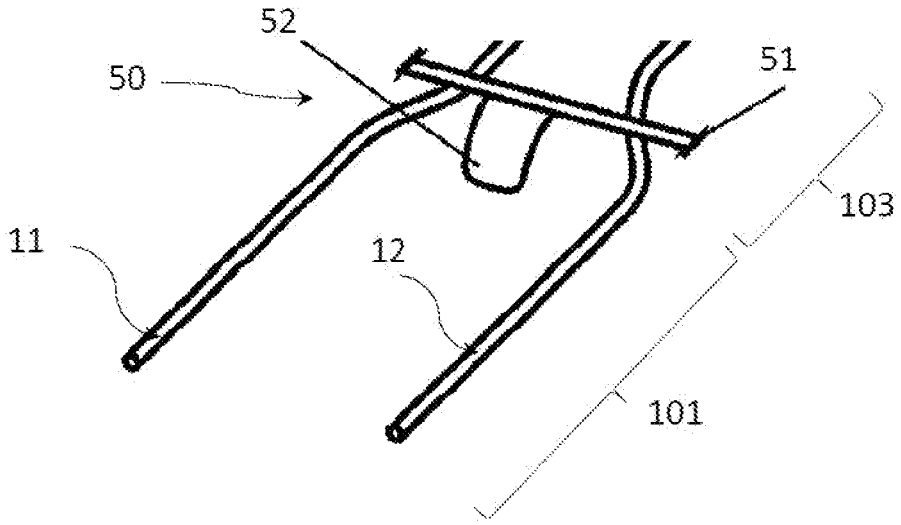
FIG. 13A is a schematic view illustrating a rear retaining arrangement of the installation assembly according to the above preferred embodiment of the present invention.

Referring to FIG. 13A, the rear retaining arrangement 50 comprises a retaining bar 51 transversely extended across the portions of the installation arms 11, 12 in the transition arrangement 103 and a retainer member 52 downwardly extended from the retaining bar 51 and configured to extend into the receiving cavity 92 of the frontmost detachable shoe cover 901 to limit the rear portion of the stretched out frontmost detachable shoe cover 901 from re-stretching back to the installation arrangement 102.

Figure 13B:
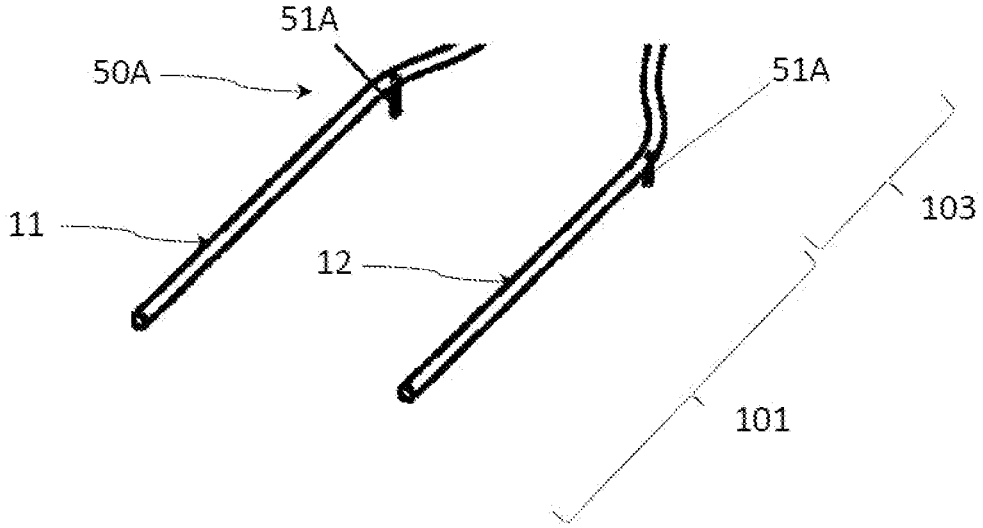
FIG. 13B is a schematic view illustrating an alternative mode of the rear retaining arrangement of the installation assembly according to the above preferred embodiment of the present invention.

FIG. 13B illustrates an alternative mode of the rear retaining arrangement 50A which comprises a pair of retainers 51A downwardly extended from the portions of the installation arms 11, 12 in the transition arrangement 103 and configured to extend into the receiving cavity 92 of the frontmost detachable shoe cover 901 to limit the rear portion of the stretched out frontmost detachable shoe cover 901 from re-stretching back to the installation arrangement 102.

Referring to FIGS. 1-4 and FIGS. 14A-14C, various embodying modes of the front retaining configuration 40 adapted to be equipped in the dispenser arrangement 101 of the installation assembly 10 are illustrated as examples.

As shown in FIGS. 1-4 and FIG. 14A, the front retaining configuration 40 comprises a pair of L shape retainers 41 each having a supporter 411 transversely extended from the frame 20, positioned behind the separator 30, across the respective installation arm 11, 12 and a retaining bar 412 downwardly extended from a free end of the supporter 411 to extend into the receiving cavity 92 of the frontmost detachable shoe cover 901 to limit the front portion of the stretched out frontmost detachable shoe cover 901 from re-stretching back to the installation arrangement 102, so as to retain the frontmost detachable shoe cover 901 in the open state with the rear retaining configuration (rear retaining arrangement 50) in the dispenser arrangement 101.

Figure 14A:
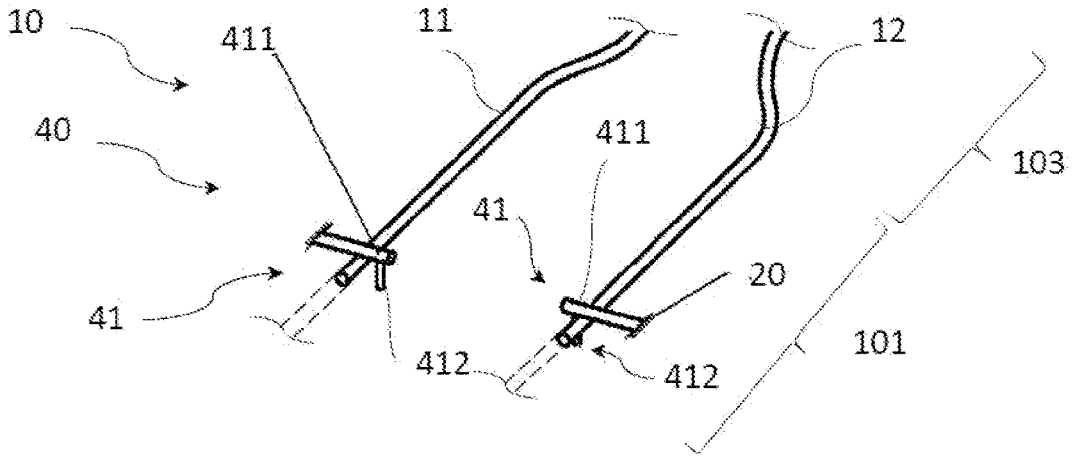
FIG. 14A to FIG. 14C are schematic views illustrating alternative modes of the front retaining configuration of the installation assembly according to the above preferred embodiment of the present invention
Figure 14B:
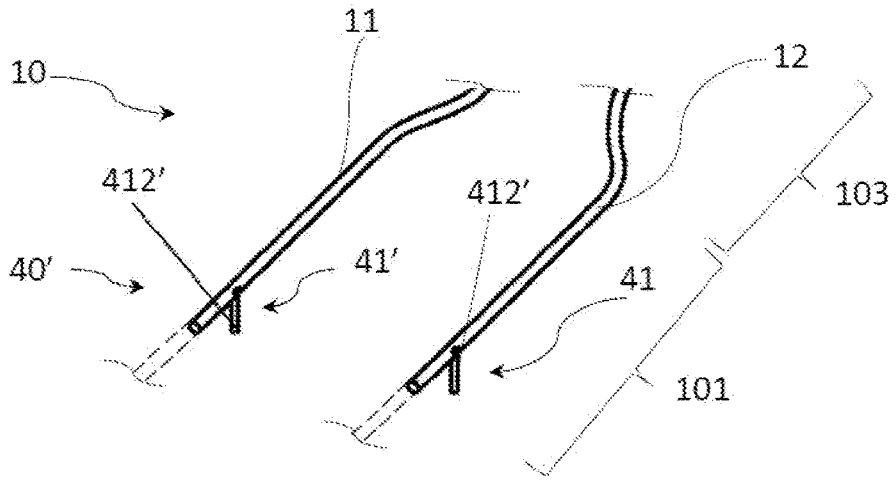

An alternative mode of the front retaining configuration 40' is illustrated in FIG. 14B, wherein the front retaining configuration 40' comprises a pair of retaining bar 412' integrally and downwardly extended from the installation arms 11, 12 respectively to extend into the receiving cavity of the frontmost detachable shoe cover 901 to limit the front portion of the stretched out frontmost detachable shoe cover 901 from re-stretching back to the installation arrangement 102, so as to retain the frontmost detachable shoe cover 901 in the open state with the rear retaining configuration (rear retaining arrangement 50) in the dispenser arrangement 101.

Figure 14C:
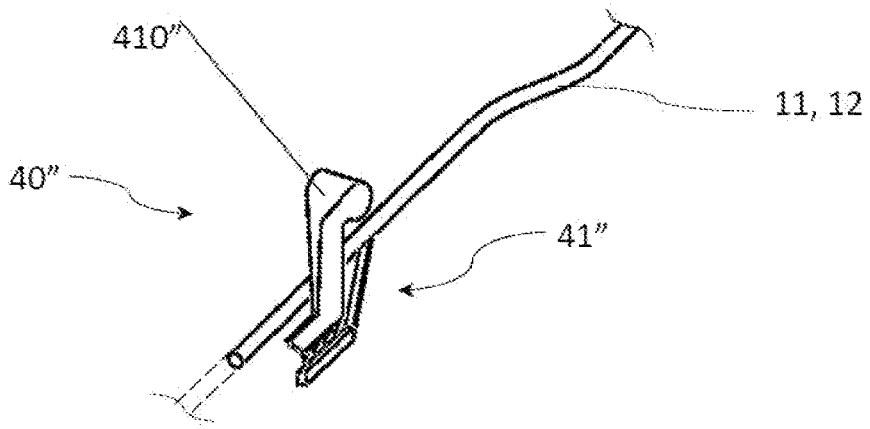

FIG. 14C illustrates another alternative mode of the front retaining configuration 40" which comprises a pair of clip type retainers 410" configured to clip on the installation arms 11, 12 respectively at the desired positions that allows the user to adjust the position of the retainers 410" on the installation arms 11, 12. In other words, the front retaining configuration 40" can be configured to be adjustable to adapt for different sizes of the detachable shoe cover 90.

According to the present invention, the funnel configuration of the pair of installation arms 11, 12 of the installation assembly 10 incorporated and equipped with the separator 30 mounted to the frame 20 enable the shoe covers 90 to be configured in detachable manner. In other words, multiple modes of the detachable shoe cover 90 are able to be dispensed by the dispenser device of the present invention. One example has been disclosed in FIG. 5A to FIG. 5C of the above preferred embodiment. Referring to FIG. 15 to FIG. 31C, alternative modes of the detachable shoe cover 90 to be dispensed by the dispenser device are disclosed hereinafter.

Referring to FIG. 15A to FIG. 17, a first alternative mode of the detachable shoe cover 90A according to the present invention is illustrated, wherein the detachable shoe cover 90A has the same configuration as the detachable shoe cover 90 as shown in FIG. 5A that comprises the shoe cover main body 91 having the receiving cavity 92, the elastic opening edge portion 93 defining the opening 94, and the interconnection arrangement 95 for interconnecting the detachable shoe covers 90A to be installed in the dispenser device. Similarly, as shown in FIG. 15B, each of the detachable shoe covers 90A further comprises the ring shape elastic element 96 provided around the opening edge 931 of the elastic opening edge portion 93 to provide an elastic effect for being stretched to open the opening 94 for wearing on a shoe of a user and to retracted to reduce a size of the opening 94 for holding on the shoe of the user. The different of the first alternative mode of the detachable shoe cover 90A and the detachable shoe cover 90 as shown in FIG. 5A is that the two rear interconnection members 950 are replaced by two rear joint perforations 952 so that there are two front joint perforations 951 and two rear joint perforations 952 formed below the elastic element 96.

Figure 15A:
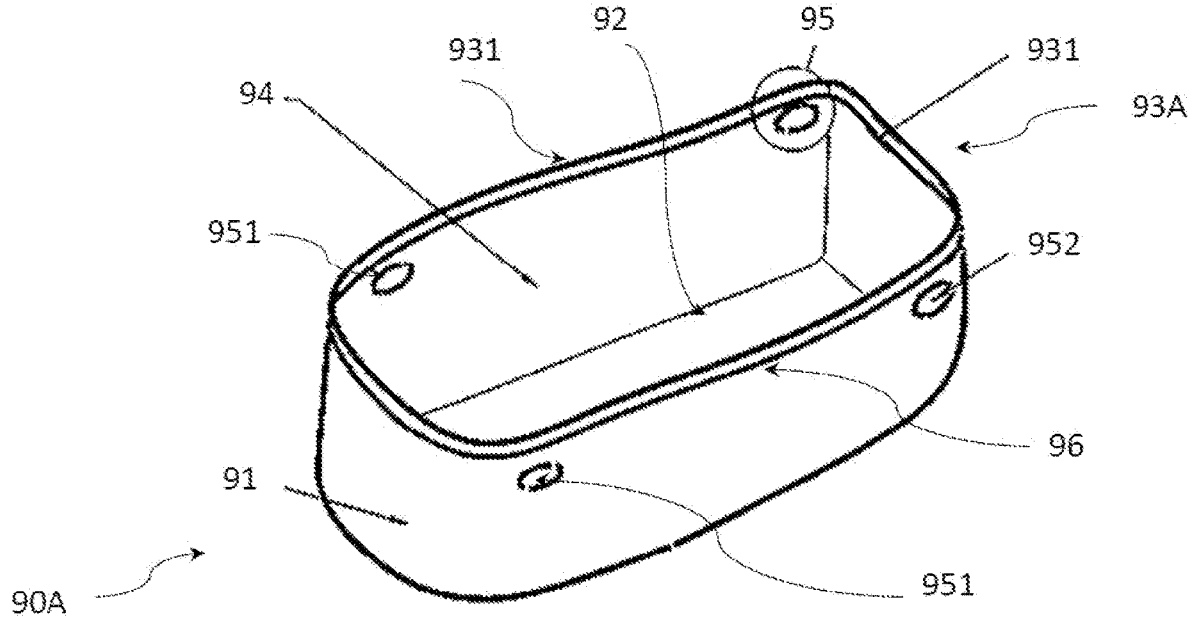
FIG. 15A is a schematic view of a first alternative mode of the detachable shoe cover according to the above preferred embodiment of the present invention.
Figure 15B:
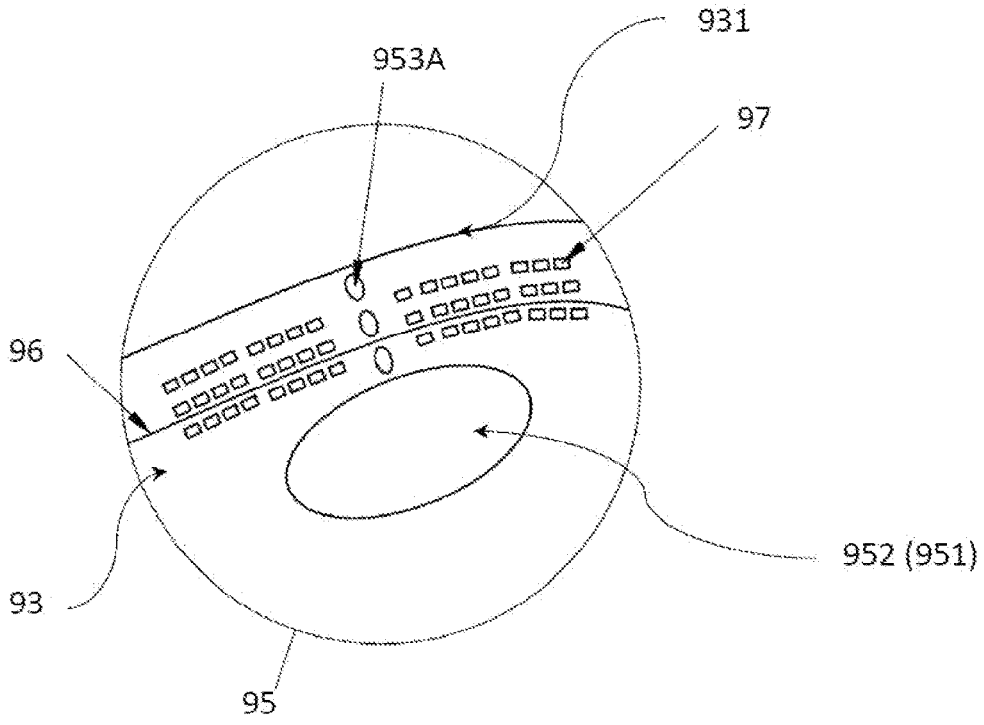
FIG. 15B is an enlarged view illustrating the detachable connection arrangement of the first alternative mode of the detachable shoe cover according to the above preferred embodiment of the present invention.

According to the first alternative mode of the detachable shoe cover 90A, between the opening edge 931 and each of the front and rear joint perforations 951, 952, as shown in FIG. 15B, a sealing portion 97 is formed by thermal pressing so as to reinforce and strength the material between the opening edge 931 and each of the front and rear joint perforations 951, 952 of the detachable shoe cover 90A, and a detachable line 953A is formed and extended from the opening edge 931 to each of the front and rear joint perforations 951, 952.

Figure 16:
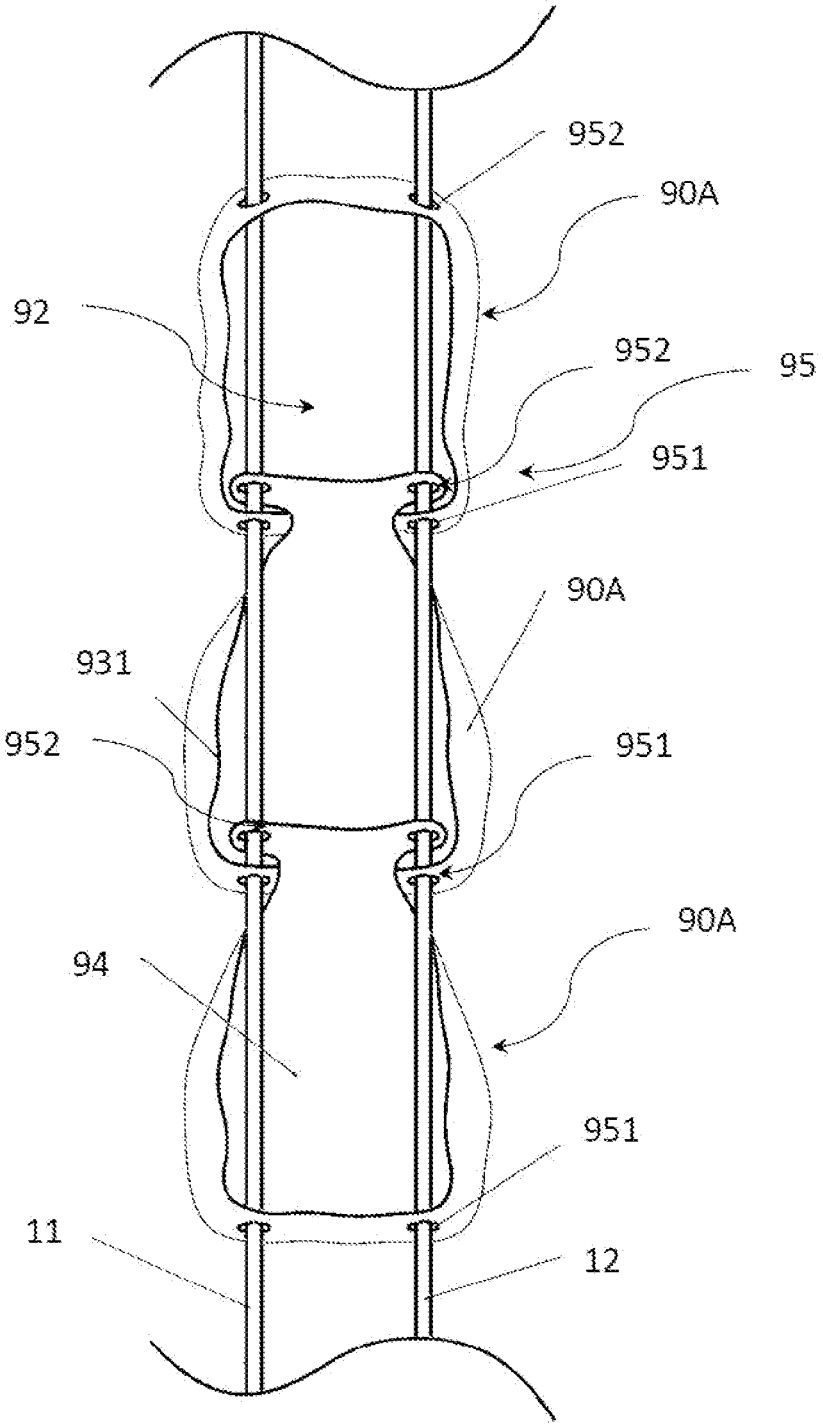
FIG. 16 is a schematic view illustrating the installation arrangement of the detachable shoe covers, according to the first alternative mode as shown in FIGS. 14A and 14B, and the dispenser device according to the above preferred embodiment of the present invention.

Referring to FIG. 16, to interconnecting the detachable shoe covers 90A one-by-one in series with the two installation arms 11, 12, the two rear portion of the detachable shoe cover 90A is extended in the receiving cavity 92 and positioned behind the front portion of the subsequent detachable shoe cover 90A, wherein the two rear joint perforations 952 of the detachable shoe cover 90A is aligned with the two front joint perforations 951 of the subsequent detachable shoe cover 90A allowing the two installation arms 11, 12 to penetrate through respectively so as to interconnecting the plurality of detachable shoe covers 90A along the installation arms 11, 12 of the installation assembly 10. For illustration purpose, the detachable shoe covers 90A are stretched to open state as shown in FIG. 16 to illustrate the interconnecting configuration between the front and rear joint perforations 951, 952 and the two installation arms 11, 12. Normally, as shown in FIG. 17, the plurality of detachable shoe covers 90A installed in the installation arrangement 102 of the installation assembly 10 is stacked one-by-one in series along the two installation arms 11, 12 of the installation assembly 10 to maximize the storage capacity of the detachable shoe covers 90A.

Figure 17:
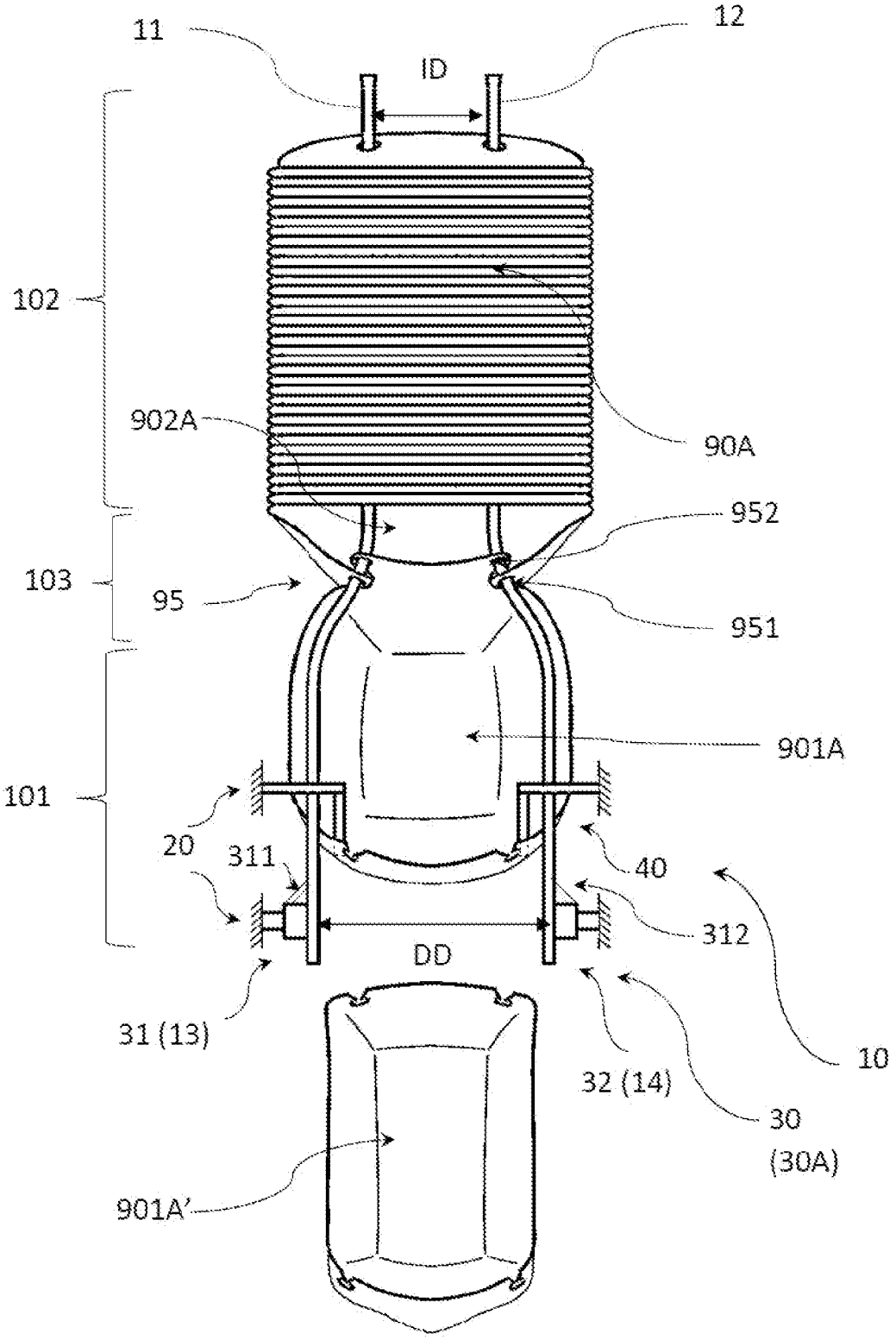
FIG. 17 is a schematic view of the dispenser device installed with the detachable shoe covers, according to the first alternative mode as shown in FIGS. 14A and 14B, during dispensing of a frontmost detachable shoe cover from a subsequent detachable shoe cover according to the above preferred embodiment of the present invention.

Referring to FIG. 17, the separator 30 is preferred to be provided at a front portion of the dispenser arrangement 101, that is front ends of the installation arms 11, 12 respectively according to the preferred embodiment and configured to detach the frontmost detachable shoe cover 901A from the subsequent detachable shoe cover 902A by separating the interconnection arrangement 95, that is separating the sealing portion 97 (as shown in FIG. 15B), such that the two installation arms 11, 12 can be moved out of the front and rear joint perforations 951, 952 and thus the detachable shoe cover 90A is detached from the installation assembly 10. When the detachable line 953A is formed across the sealing portion 97, the sealing portion 97 will be separated at the detachable line 953A.

It would be even more effective in separating the sealing portion 97 when the separator 30 is a cutter separator that comprises the cutters 311, 312 which can easily cut off the sealing portions 97 of the frontmost detachable shoe cover 901A while it is pulling frontward in the dispenser arrangement 101.

It is worth mentioning that when the sealing portions 97 are cut to separate, the elastic element 96 is also cut at the sealing portion 97 but the sealing portion 97 is fused with the elastic element 96 so as to prevent the elastic element 96 from coming out and maintain the elastic holding ability of the detachable shoe cover 90A to be worn on the user's shoe.

Referring to FIG. 17, upon a pulling force is applied to the frontmost detachable shoe cover 901A frontwards, the frontmost detachable shoe cover 901A is pulled to move frontwards and be stretched out between the portions of the two installation arms 11, 12 of the dispenser arrangement 101 in the open state while the front portion of a subsequent detachable shoe cover 902A of the plurality of detachable shoe covers 90A is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901A is stretched out to the dispenser arrangement 101, the transition arrangement 103 substantially forms the rear retaining configuration (or by means of the rear retaining arrangement 50 as shown in FIG. 13A and FIG. 13B in addition) to limit the rear portion of the stretched out frontmost detachable shoe cover 901A from re-stretching back to the installation arrangement 102. In addition, the front retaining configuration 40 restricts the front portion of the frontmost detachable shoe cover 901A retaining in the open state that the elastic element 96 is stretched out and extended to open the opening 94 enough for the user to place his or her shoe in the receiving cavity 92 of the detachable shoe cover 90A.

In order to dispense a detachable shoe cover 90A, the user may simply place his or her shoe in the receiving cavity 92 through the opening 94 to wear the frontmost detachable shoe cover 901A on the shoe and then move the worn frontmost detachable shoe cover 901A frontwards until the sealing portions 97 adjacent the rear joint perforations 952 of the frontmost detachable shoe cover 901A and the front joint perforations 951 of the subsequent detachable shoe cover 902A reach the separator 30. Accordingly, a continuous frontward movement of the frontmost detachable shoe cover 901A away from the dispenser arrangement 101 not only pulls the sealing portions 97 against the separator 30 until the sealing portions 97 are broken by the separator 30 or cut off by the cutter separator 30A to detach the frontmost detachable shoe cover 901A from the subsequent detachable shoe cover 902A and separate from the installation assembly to form a detached detachable shoe cover 901A' worn on the user's shoe, wherein the previously subsequent detachable shoe cover 902A is also pulled to move the dispenser arrangement 101 becoming the frontmost detachable shoe cover 901A being opened in the dispenser arrangement 101 for wearing and the next detachable shoe cover 90A interconnecting with the original subsequent detachable shoe cover 902A is also pulled frontwards to be partially opened at the transition arrangement 103 and forms the current subsequent detachable shoe cover 902A of the current frontmost detachable shoe cover 901A.

Figure 18:
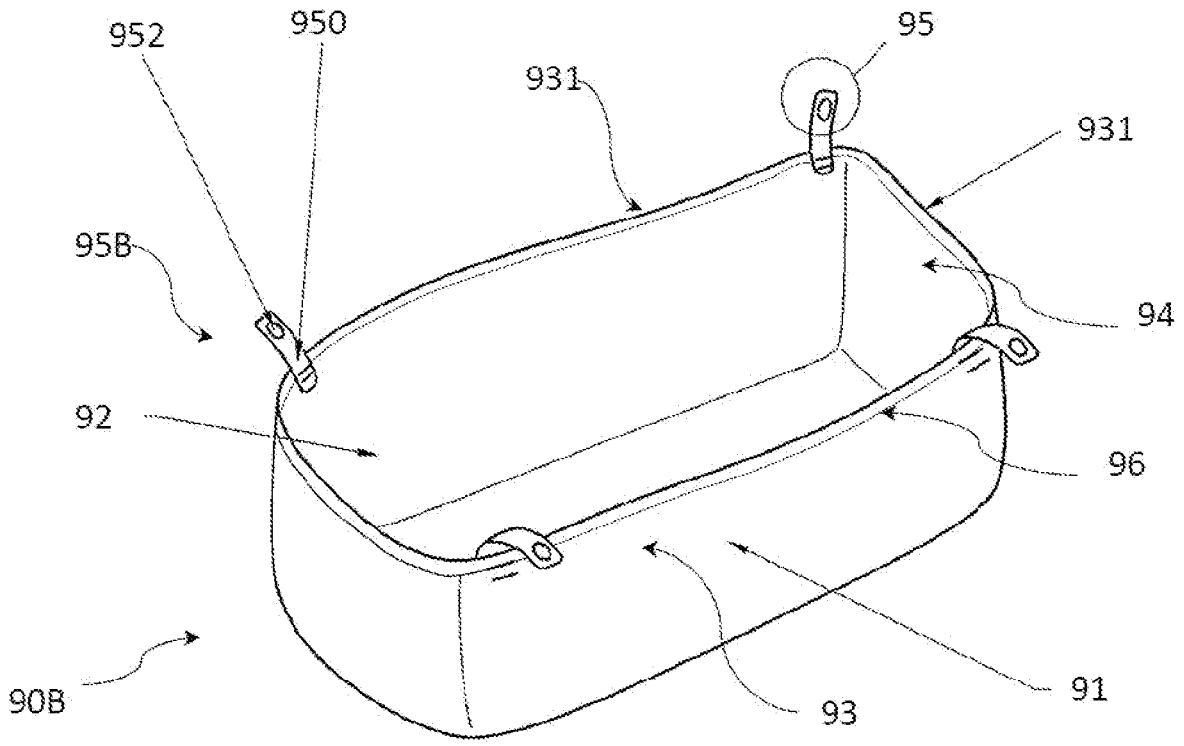
FIG. 18 is a schematic view of a second alternative mode of the detachable shoe cover according to the above preferred embodiment of the present invention.
Figure 19:
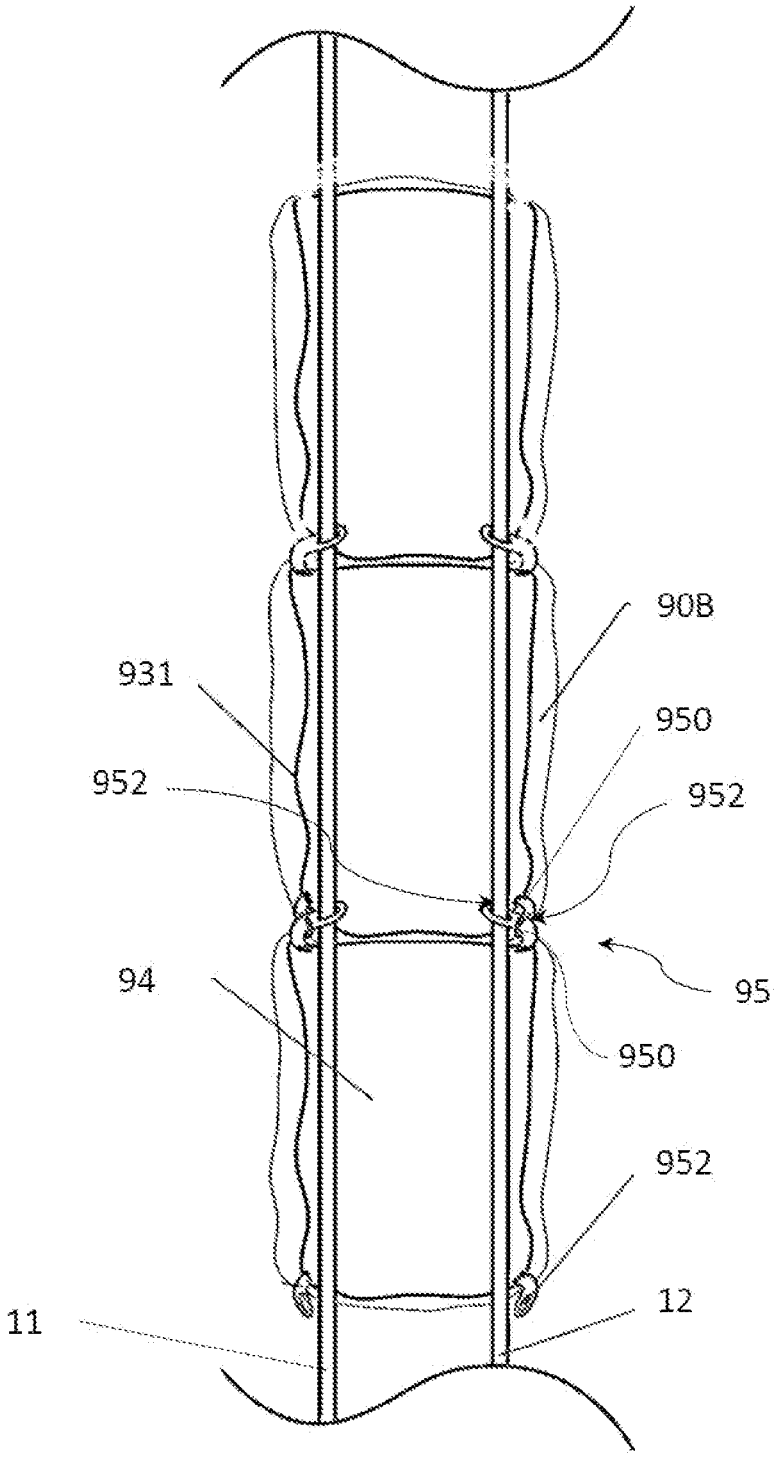
FIG. 19 is a schematic view illustrating the installation arrangement of the detachable shoe covers, according to the second alternative mode as shown in FIG. 17, and the dispenser device according to the above preferred embodiment of the present invention.
Figure 20:
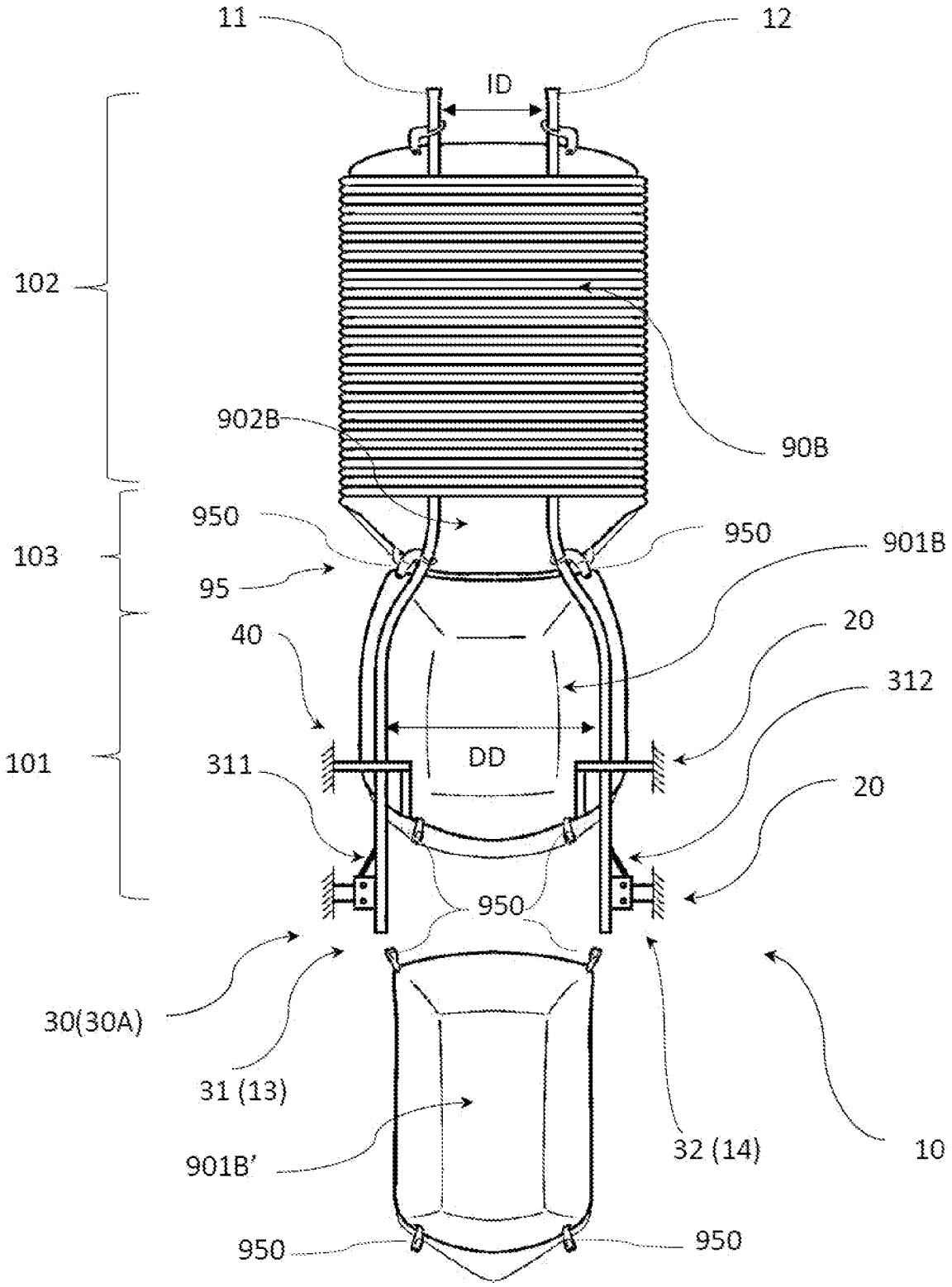
FIG. 20 is a schematic view of the dispenser device installed with the detachable shoe covers, according to the second alternative mode as shown in FIG. 17, during dispensing of a frontmost detachable shoe cover from a subsequent detachable shoe cover according to the above preferred embodiment of the present invention.

Referring to FIG. 18 to FIG. 20, a second alternative mode of the detachable shoe cover 90B according to the present invention is illustrated, wherein the detachable shoe cover 90B has the same configuration as the detachable shoe cover 90 as shown in FIG. 5A that comprises the shoe cover main body 91 having the receiving cavity 92, the elastic opening edge portion 93 defining the opening 94, and the interconnection arrangement 95 for interconnecting the detachable shoe covers 90B to be installed in the dispenser device. Similarly, each of the detachable shoe covers 90B further comprises an elastic element 96 provided around an opening edge 931 of the elastic opening edge portion 93 to provide an elastic effect for being stretched to open the opening 94 for wearing on a shoe of a user and to retracted to reduce a size of the opening 94 for holding on the shoe of the user. The different of the second alternative mode of the detachable shoe cover 90B and the detachable shoe cover 90 as shown in FIG. 5A is that the two front joint perforations 951 of the interconnection arrangement 95 are replaced with another two interconnection members 950 each of which has a joint perforation 952 therein as shown in FIG. 5C.

Referring to FIG. 19, to interconnecting the detachable shoe covers 90B one-by-one in series with the two installation arms 11, 12, the two rear interconnection members 950 of each of the detachable shoe covers 90B are penetrated through the two joint perforations 952 of the front interconnection members 950 a subsequent detachable shoe cover 90B respectively. Then, the two interconnection members 950 of the two rear interconnection members 950 are hanged to the two installation arms 11, 12 respectively by penetrating the two installation arms 11, 12 through the two joint perforations 952 of the two rear interconnection members 950 respectively, such that the plurality of detachable shoe covers 90B are installed along the two installation arms 11, 12 of the installation assembly 10. For illustration purpose, the detachable shoe covers 90B are stretched to open state as shown in FIG. 19 to illustrate the interconnecting configuration between the front and rear pairs of interconnection members 950, the joint perforations 952 of the front and rear pairs of interconnection members 950, and the two installation arms 11, 12. Normally, as shown in FIG. 20, the plurality of detachable shoe covers 90B installed in the installation arrangement 102 of the installation assembly 10 is stacked one-by-one in series along the two installation arms 11, 12 of the installation assembly 10 to maximize the storage capacity of the detachable shoe covers 90B.

Referring to FIG. 20, the separator 30 is preferred to be provided at a front portion of the dispenser arrangement 101, that is the separating members 31, 32 are respectively provided at front ends of the installation arms 11, 12 according to the preferred embodiment and configured to detach the frontmost detachable shoe cover 901B from the subsequent detachable shoe cover 902B by separating the interconnection arrangement 95, that is separating the rear interconnection members 950 at the detachable lines 953 thereon, as shown in FIG. 5C. Upon a pulling force is applied to the frontmost detachable shoe cover 901B frontwards, the frontmost detachable shoe cover 901B is pulled to move frontwards and be stretched out between the portions of the two installation arms 11, 12 of the dispenser arrangement 101 in the open state while the front portion of a subsequent detachable shoe cover 902B of the plurality of detachable shoe covers 90B is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901B is stretched out to the dispenser arrangement 101, the transition arrangement 103 substantially forms the rear retaining configuration (or by means of the rear retaining arrangement 50 as shown in FIG. 13A and FIG. 13B in addition) to limit the rear portion of the stretched out frontmost detachable shoe cover 901B from re-stretching back to the installation arrangement 102. In addition, the front retaining configuration 40 restricts the front portion of the frontmost detachable shoe cover 901B retaining in the open state that the elastic element 96 is stretched out and extended to open the opening 94 enough for the user to place his or her shoe in the receiving cavity 92 of the detachable shoe cover 90B, as shown in FIG. 20.

In view of FIG. 20, in order to dispense a detachable shoe cover 90A, the user may simply place his or her shoe in the receiving cavity 92 through the opening 94 to wear the frontmost detachable shoe cover 901A on the shoe and then move the worn frontmost detachable shoe cover 901A frontwards until the two interconnection members 950 reach the separator 30. Accordingly, a continuous frontward movement of the frontmost detachable shoe cover 901A away from the dispenser arrangement 101 not only pulls the interconnection members 950 against the separator 30 until the rear interconnection members 950 is broken by the separator 30 to detach the frontmost detachable shoe cover 901A from the subsequent detachable shoe cover 902A and separate from the installation assembly 10 to form a detached detachable shoe cover 901A' worn on the user's shoe, wherein the previously subsequent detachable shoe cover 902A is also pulled to move the dispenser arrangement 101 becoming the frontmost detachable shoe cover 901A being opened in the dispenser arrangement 101 for wearing and the next detachable shoe cover 90A interconnecting with the original subsequent detachable shoe cover 902A is also pulled frontwards to be partially opened at the transition arrangement 103 and forms the current subsequent detachable shoe cover 902A of the current frontmost detachable shoe cover 901A.

Figure 21A:
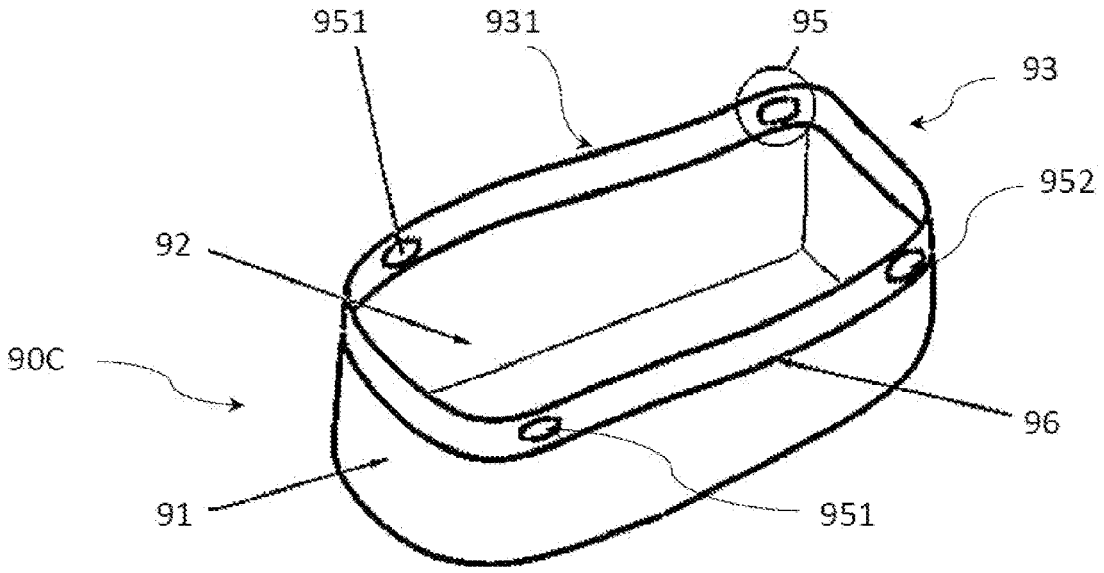
FIG. 21A is a schematic view of a third alternative mode of the detachable shoe cover according to the above preferred embodiment of the present invention.
Figure 21B:
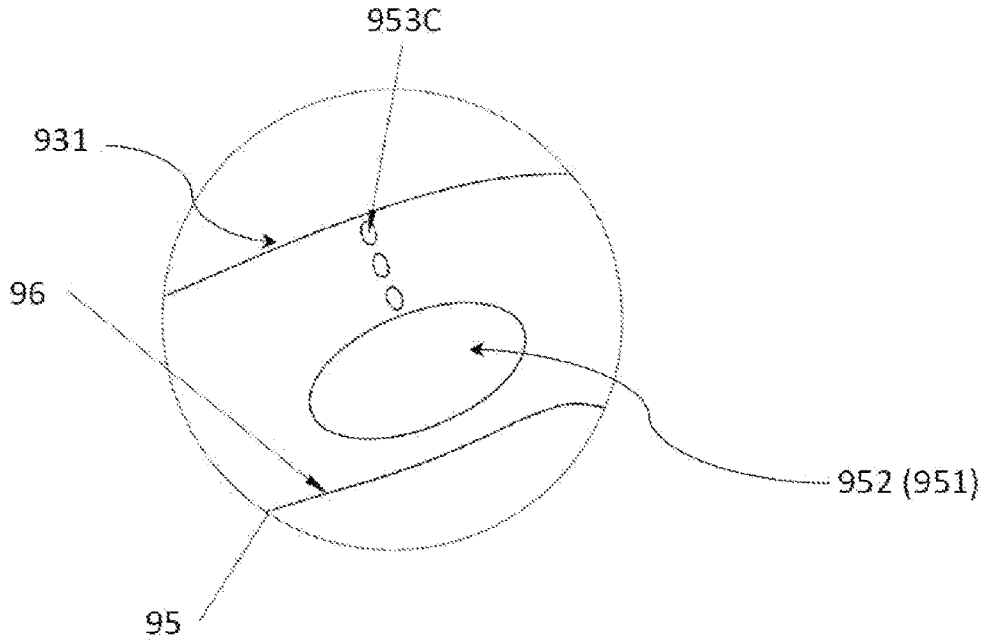
FIG. 21B is an enlarged view illustrating the detachable connection arrangement of the third alternative mode of the detachable shoe cover according to the above preferred embodiment of the present invention.
Figure 22:
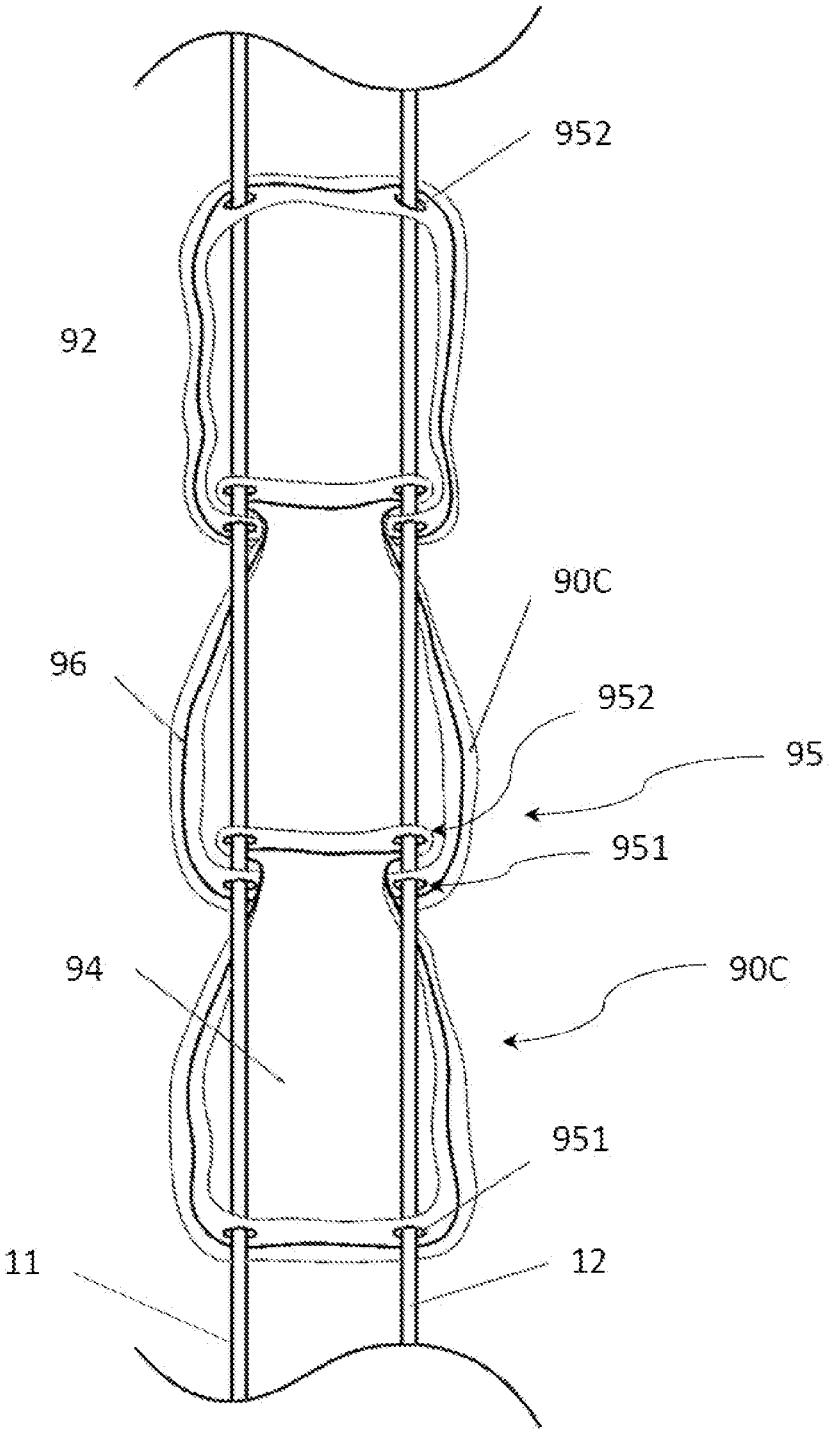
FIG. 22 is a schematic view illustrating the installation arrangement of the detachable shoe covers, according to the third alternative mode as shown in FIG. 20, and the dispenser device according to the above preferred embodiment of the present invention.

Referring to FIG. 21A to FIG. 22, a third alternative mode of the detachable shoe cover 90C is illustrated, wherein the third alternative mode of the detachable shoe cover 90C is similar to the first alternative mode of the detachable shoe cover 90A, wherein the interconnection arrangement 95 is configured by the two front joint perforations 951 and two rear joint perforations 952 as shown in FIG. 21A. However, the different between the third alternative mode of the detachable shoe cover 90C is similar to the first alternative mode of the detachable shoe cover 90A is that the ring shape elastic element 96 is formed below the front and rear joint perforations 951, 952 of the interconnection arrangement 95 while the four detachable lines 953C are respectively extended from the opening edge 931 and the front and rear joint perforations 951, 952, so that no sealing portion 97 is required. Since the elastic element 96 is provided below the front and rear joint perforations 951, 952, when the detachable lines 953C are cut off to separate by the separator 30 (or the cutter separator 30A), the elastic element 96 will not be cut off for wearing on the user's shoe.

Figure 23:
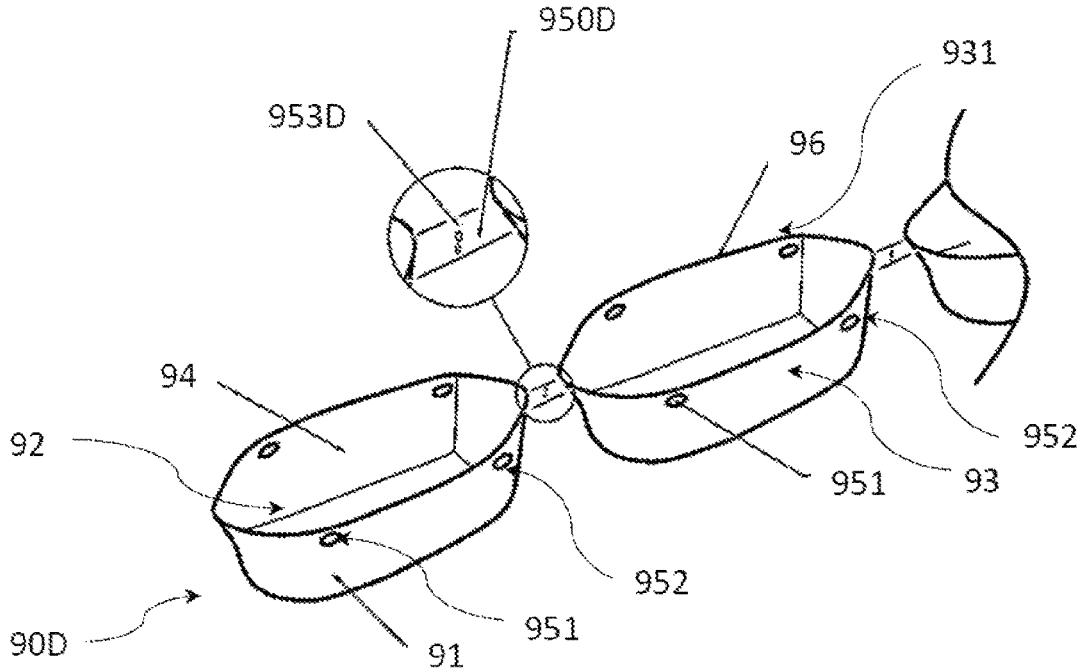
FIG. 23 is a schematic view of a fourth alternative mode of the detachable shoe cover according to the above preferred embodiment of the present invention.
Figure 24:
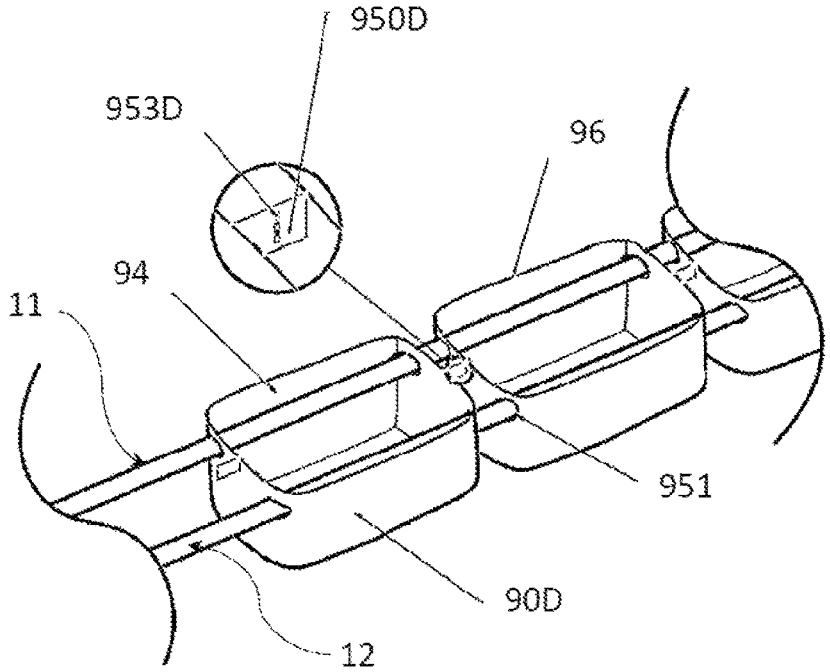
FIG. 24 is a schematic view illustrating the installation arrangement of the detachable shoe covers, according to the fourth alternative mode as shown in FIG. 20, and the dispenser device according to the above preferred embodiment of the present invention.
Figure 25:
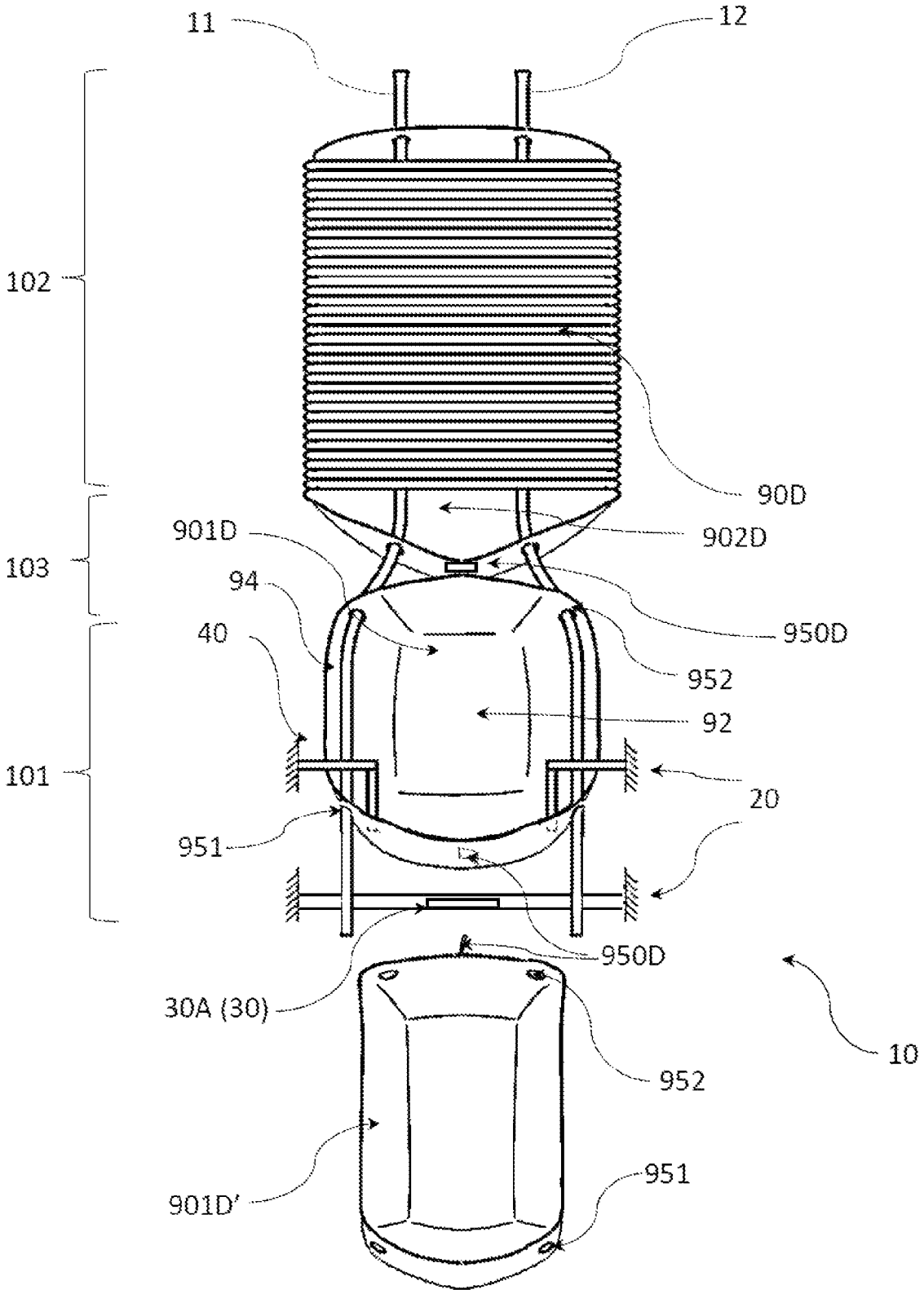
FIG. 25 is a schematic view of the dispenser device installed with the detachable shoe covers, according to the fourth alternative mode as shown in FIG. 20, during dispensing of a frontmost detachable shoe cover from a subsequent detachable shoe cover according to the above preferred embodiment of the present invention.

Referring to FIG. 23 to FIG. 25, a fourth alternative mode of detachable shoe cover 90D is illustrated. The detachable shoe cover 90D may have a structure similar to the first alternative mode of the detachable shoe cover 90A that comprises the shoe cover main body 91 having the receiving cavity 92, the elastic opening edge portion 93 defining the opening 94, and the interconnection arrangement 95 for interconnecting the detachable shoe covers 90D to be installed in the dispenser device, as shown in FIG. 23. The different between the fourth alternative mode of the detachable shoe cover 90D and the above first and third disclosed detachable shoe cover 90A, 90C is that the ring shape elastic element 96 provided at the opening edge 931 of the elastic opening edge portion 93 to provide the elastic effect for being stretched to open the opening 94 for wearing on a shoe of a user and to retracted to reduce a size of the opening 94 for holding on the shoe of the user, and that the two installation arms 11, 12 of the installation assembly 10 are directly penetrating through the front and rear joint perforations 951, 952 of the interconnection arrangement 95, as shown in FIG. 24. In addition, the interconnection arrangement 95 further comprises an interconnection member 950D connecting the rear portion of the detachable shoe cover 90D with the front portion of another subsequent detachable shoe cover 90D, wherein a detachable line 953D is formed across the interconnection member 950D, so as to interconnect the plurality of detachable shoe covers 90D one-by-one in series while installed in the installation assembly 10 by penetrating the two installation arms 11, 12 through the front and rear joint perforations 951, 952 of the detachable shoe covers 90D as shown in FIG. 24 and FIG. 25.

For illustration purpose, the detachable shoe covers 90D are stretched to open state as shown in FIG. 24 to illustrate the interconnecting configuration of the interconnection members 950D, the front and rear joint perforations 951, 952 and the two installation arms 11, 12. Normally, as shown in FIG. 25, the plurality of detachable shoe covers 90A installed in the installation arrangement 102 of the installation assembly 10 is stacked one-by-one in series along the two installation arms 11, 12 of the installation assembly 10 to maximize the storage capacity of the detachable shoe covers 90D.

Referring to FIG. 25, the separator 30 is preferred to be a cutter separator 30D provided between the two installation arms 11, 12 at the front portion of the dispenser arrangement 101, that is the two separating members 31, 32 are respectively provided at front ends of the installation arms 11, 12 and configured to cut off the interconnection member 950D between the frontmost detachable shoe cover 901D and the subsequent detachable shoe cover 902D so as to detach the frontmost detachable shoe cover 901D from the subsequent detachable shoe cover 902D. In detail, upon a pulling force is applied to the frontmost detachable shoe cover 901D frontwards, the frontmost detachable shoe cover 901D is pulled to move frontwards and be stretched out between the portions of the two installation arms 11, 12 of the dispenser arrangement 101 in the open state while the front portion of a subsequent detachable shoe cover 902A of the plurality of detachable shoe covers 90A is pulled to partially open in the transition arrangement 103 between the two installation arms 11, 12 at the same time. Since the distance between the two installation arms 11, 12 of the dispenser arrangement 101 of the installation assembly 10 is wider than that of the installation arrangement 102, when the frontmost detachable shoe cover 901D is stretched out to the dispenser arrangement 101, the transition arrangement 103 substantially forms the rear retaining configuration (or by means of the rear retaining arrangement 50 as shown in FIG. 13A and FIG. 13B in addition) to limit the rear portion of the stretched out frontmost detachable shoe cover 901D from re-stretching back to the installation arrangement 102. In addition, the front retaining configuration 40 restricts the front portion of the frontmost detachable shoe cover 901D retaining in the open state that the elastic element 96 is stretched out and extended to open the opening 94 enough for the user to place his or her shoe in the receiving cavity 92 of the detachable shoe cover 90D.

Similarly, in order to dispense a detachable shoe cover 90D, the user may simply place his or her shoe in the receiving cavity 92 through the opening 94 to wear the frontmost detachable shoe cover 901D on the shoe and then move the worn frontmost detachable shoe cover 901D frontwards until the interconnection member 950D reaches the separator 30 (cutter separator 30A). Accordingly, a continuous frontward movement of the frontmost detachable shoe cover 901D away from the dispenser arrangement 101 not only pulls the interconnection member 950D against the separator 30 until the interconnection member 950D is broken by the separator 30 or cut off by the cutter separator 30A to detach the frontmost detachable shoe cover 901D from the subsequent detachable shoe cover 902D and separate from the installation assembly 10, wherein the front and rear joint perforations 951, 952 of the frontmost detachable shoe cover 901D are slid out of the two installation arms 11, 12 to form a detached detachable shoe cover 901D' worn on the user's shoe. Then, the previously subsequent detachable shoe cover 902D is also pulled to move the dispenser arrangement 101 becoming the frontmost detachable shoe cover 901D being opened in the dispenser arrangement 101 for wearing and the next detachable shoe cover 90D interconnecting with the original subsequent detachable shoe cover 902D is also pulled frontwards to be partially opened at the transition arrangement 103 and forms the current subsequent detachable shoe cover 902D of the current frontmost detachable shoe cover 901D.

The separating operations of various separators 30 of the dispenser device with respect to various modes of the detachable shoe covers 90 according to the present invention are illustrated as examples referencing FIG. 26A to FIG. 31C as follows.

Figure 26A:
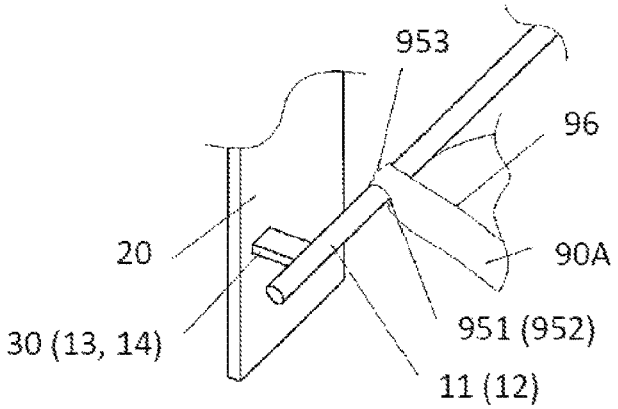
FIG. 26A to FIG. 26C are schematic views illustrating a separating operation of the frontmost shoe cover as well as the first alternative mode thereof by the separator of the dispenser device according to the above preferred embodiment of the present invention.
Figure 26B:
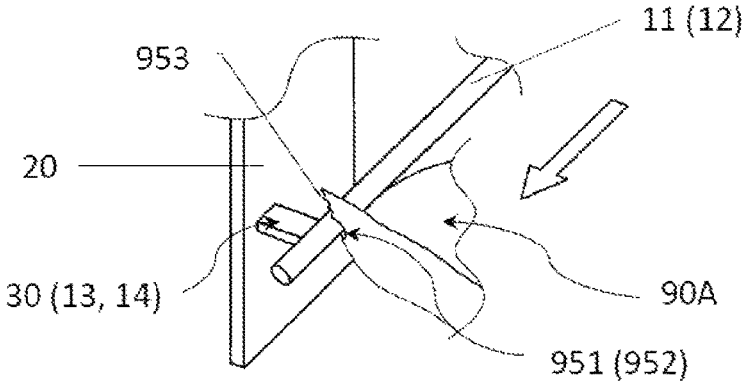
Figure 26C:
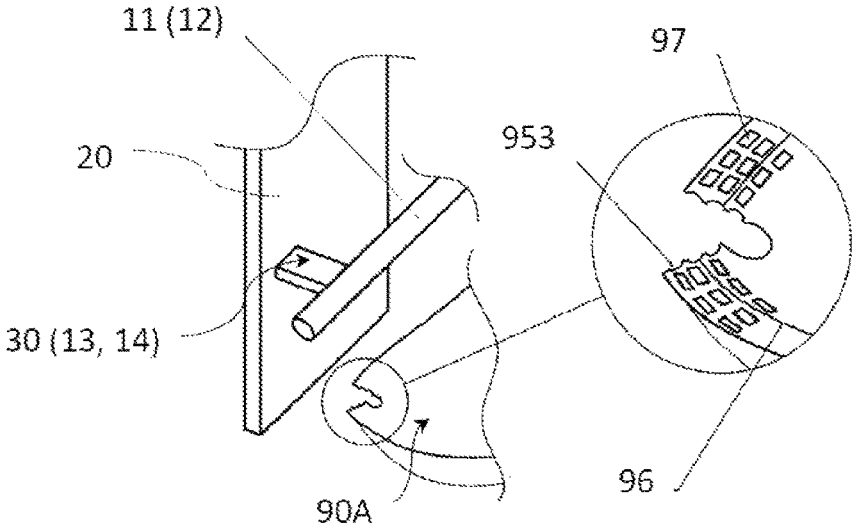
Figure 29A:
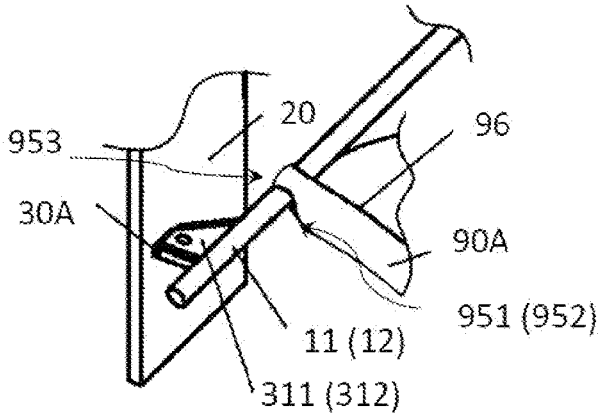
FIG. 29A to FIG. 29C are schematic views illustrating a separating operation of the frontmost shoe cover as well as the first alternative mode thereof by the cutter separator of the dispenser device according to the above preferred embodiment of the present invention.
Figure 29B:
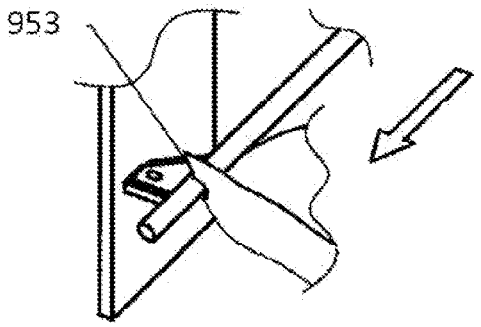
Figure 29C:
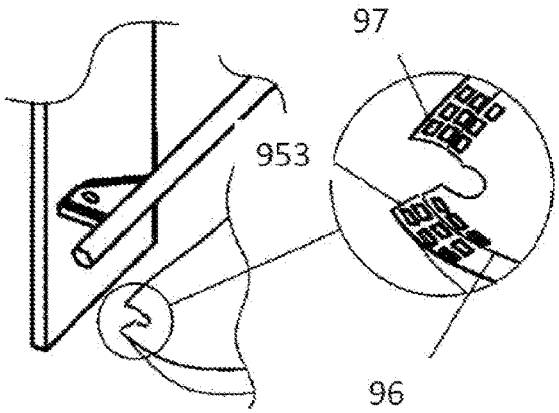

As shown in FIG. 26A to FIG. 26C, the connector 13, 14 of the installation assembly 10 as shown in FIG. 7A is embodied as the separator 30 to separate the first alternative mode of the detachable shoe cover 90A as shown in FIG. 15A and FIG. 15B, wherein when the detachable shoe cover 90A is moving forwards, the detachable line 953 is arranged to position along an outer side of the installation arm 11, 12, as shown in FIG. 26A. While the detachable shoe cover 90A is continuously moving forwards until the front joint perforation 951 reaches the separator 30, the frontward pulling force will tear or cut off the detachable line 953 to separate the detachable shoe cover 90A from the installation arm 11, 12, as shown in FIG. 26B, wherein the elastic element 96 retracts as usual due to the reinforcing of the sealing portion 97, as shown in FIG. 26C. FIG. 29A to FIG. 29C illustrates the same separating operation as in FIG. 26A to FIG. 26C while the separator 30 is the cutter separator 30A that facilitates the separation by cutting off with the cutting blade 311, 312.

Figure 27A:
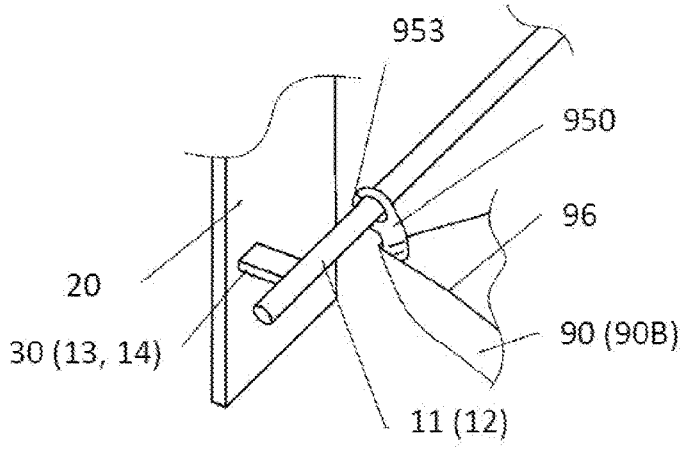
FIG. 27A to FIG. 27C are schematic views illustrating a separating operation of the frontmost shoe cover as well as the second alternative mode thereof by the separator of the dispenser device according to the above preferred embodiment of the present invention.
Figure 27B:
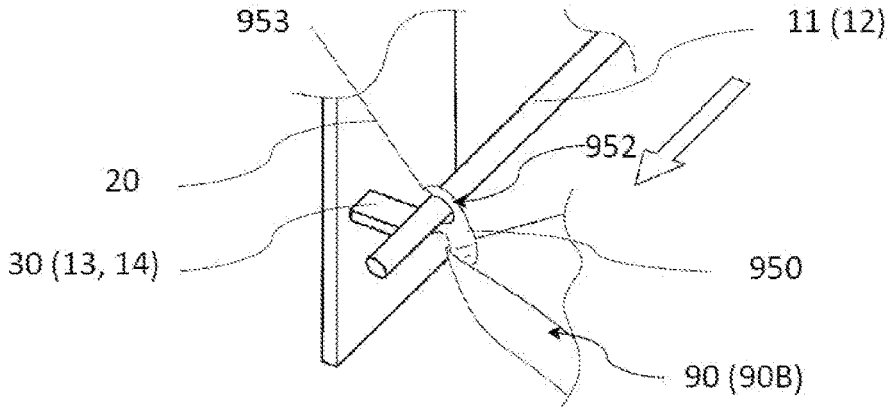
Figure 27C:
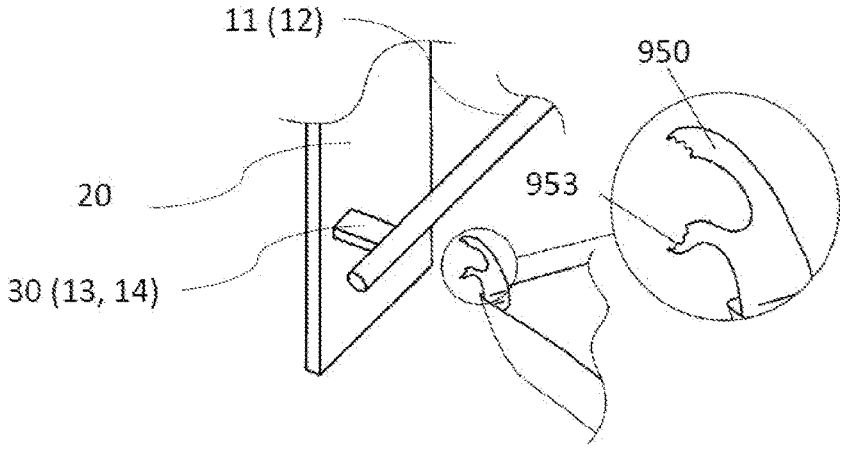
Figure 30A:
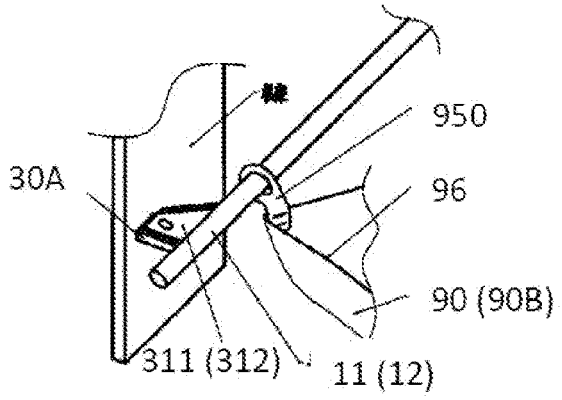
FIG. 30A to FIG. 30C are schematic views illustrating a separating operation of the frontmost shoe cover as well as the second alternative mode thereof by the cutter separator of the dispenser device according to the above preferred embodiment of the present invention.
Figure 30B:
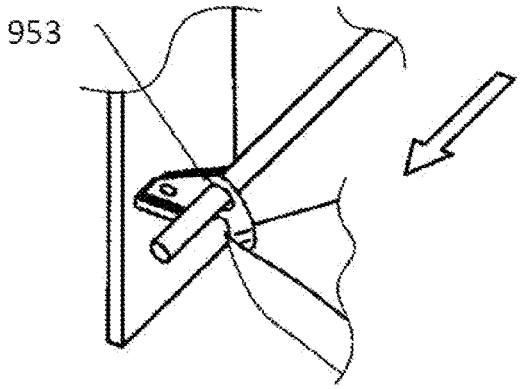
Figure 30C:
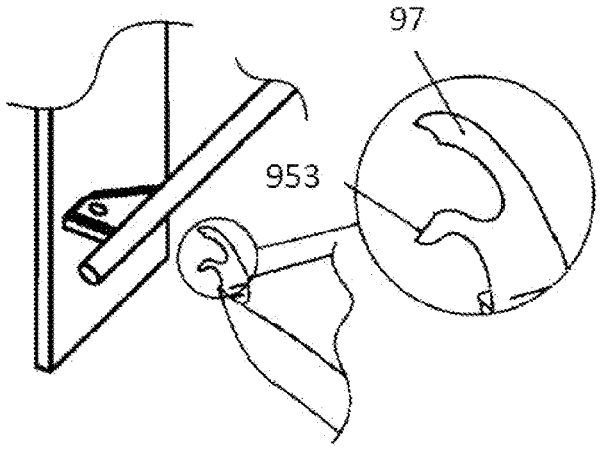

As shown in FIG. 27A to FIG. 27C, the connector 13, 14 of the installation assembly 10 as shown in FIG. 7A is embodied as the separator 30 to separate the interconnection member 950 of the detachable shoe cover 90 as shown in FIG. 5A and FIG. 5C and the second alternative mode of the detachable shoe cover 90B as shown in FIG. 18, wherein when the interconnection member 950 of the detachable shoe cover 90, 90B is moving forwards, the detachable line 953 is arranged to position along an outer side of the installation arm 11, 12, as shown in FIG. 27A. While the detachable shoe cover 90A is continuously moving forwards until the interconnection member 950 reaches the separator 30 as show in FIG. 27B, the frontward pulling force will tear or cut off the detachable line 953 to separate the interconnection member 950 from the installation arm 11, 12, as shown in FIG. 27C. FIG. 30A to FIG. 30C illustrates the same separating operation as in FIG. 27A to FIG. 27C while the separator 30 is the cutter separator 30A that facilitates the separation by cutting off with the cutting blade 311, 312.

Figure 28A:
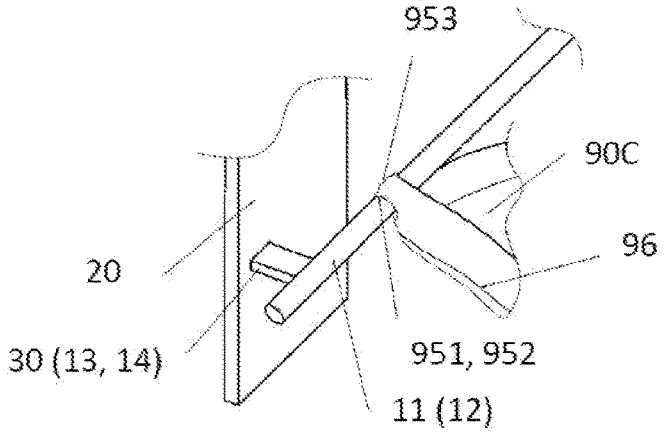
FIG. 28A to FIG. 28C are schematic views illustrating a separating operation of the frontmost shoe cover as well as the third alternative mode thereof by the separator of the dispenser device according to the above preferred embodiment of the present invention.
Figure 28B:
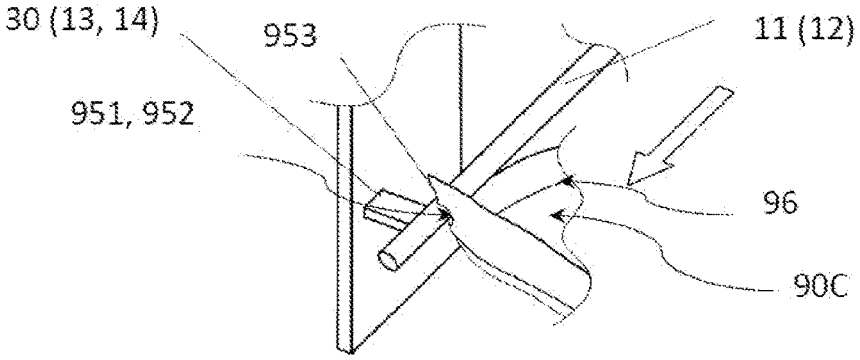
Figure 28C:
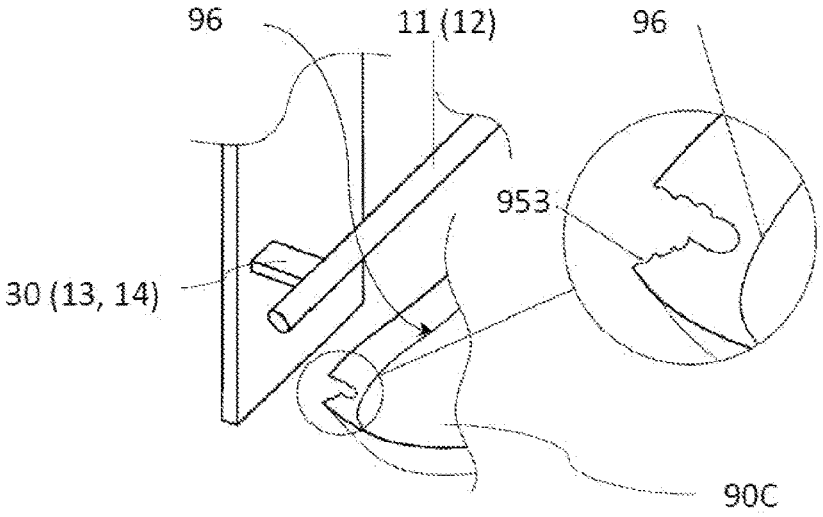
Figure 31A:
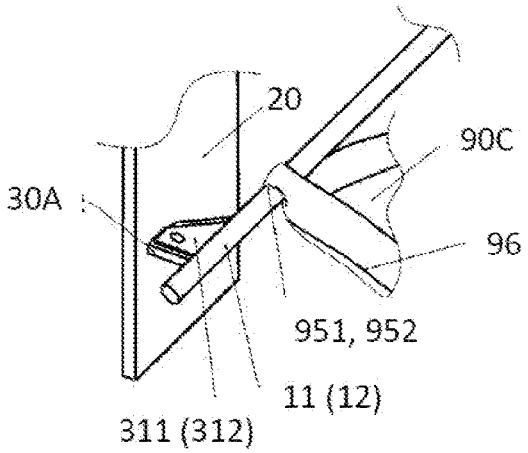
FIG. 31A to FIG. 31C are schematic views illustrating a separating operation of the frontmost shoe cover as well as the third alternative mode thereof by the cutter separator of the dispenser device according to the above preferred embodiment of the present invention.
Figure 31B:
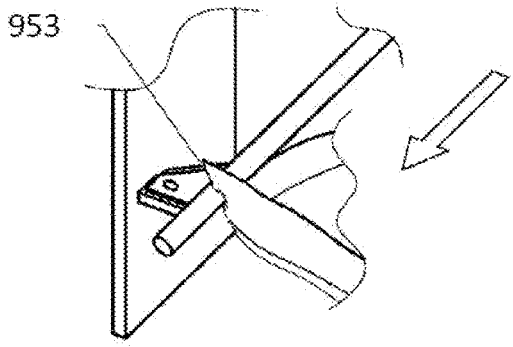
Figure 31C:
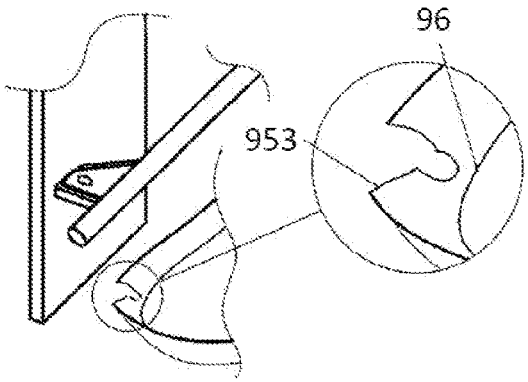

As shown in FIG. 28A to FIG. 28C, the connector 13, 14 of the installation assembly 10 as shown in FIG. 7A is embodied as the separator 30 to separate the third alternative mode of the detachable shoe cover 90C as shown in FIG. 21A and FIG. 21B, wherein when the detachable shoe cover 90C is moving forwards, the detachable line 953 is arranged to position along an outer side of the installation arm 11, 12, as shown in FIG. 28A. While the detachable shoe cover 90C is continuously moving forwards until the front joint perforation 951 reaches the separator 30, the frontward pulling force will tear or cut off the detachable line 953 to separate the detachable shoe cover 90C from the installation arm 11, 12, as shown in FIG. 28B, wherein the elastic element 96 positioned below the front and rear joint perforations 951, 952 retracts as usual, as shown in FIG. 28C. FIG. 31A to FIG. 31C illustrates the same separating operation as in FIG. 28A to FIG. 28C while the separator 30 is the cutter separator 30A that facilitates the separation by cutting off with the cutting blade 311, 312.

In view of above, the installation arms 11, 12 are stationary mounted to the frame 20 for steady and smooth guiding of the detachable shoe covers 90 (90A-90D) to move to the dispenser arrangement as the frontmost detachable shoe cover 901 in turn to open the opening 94 of the receiving cavity 92 thereof by the front retaining configuration 40 and the rear retaining arrangement 50 and providing a firm support of the frontmost detachable shoe cover 901 for user to place his or her shoe in the receiving cavity 92 thereof. The arrangement of the connectors 13,14 and/or the separating members 31, 32 of the separator 30 with respect to the installation arms 11, 12 respectively not only provides the firm support of the frontmost detachable shoe cover 901 but also collaborates with the interconnection arrangement 95 of the detachable shoe cover 90, including the interconnection member 950, the joint perforations 951, 952, the sealing portion 97, and/or the detachable line 953 of various modes of the detachable shoe cover 90 (90A-90D), to break the opening edge portions 93 adjacent the joint perforations 951, 952 or the interconnection member 950, so that the frontmost detachable shoe cover 901 can break away and disconnect from the installation arms 11, 12 of the installation assembly 10. When a cutter separator 30A is embodied, the breaking away of the frontmost detachable shoe cover 90 (90A-90D) is even more easy and precise by cutting the opening edge portion 93 or the interconnection member 950.

Accordingly, the method of dispensing detachable shoe covers installed in the dispenser device of the present invention includes the following steps:

(a) guiding a plurality of interconnecting detachable shoe covers 90 (90A-90D) to move from the installation arrangement 102 to the dispenser arrangement 101 provided at the front end portions 111, 121 by the pair of installation arms 11, 12 of the installation assembly 10;

(b) opening a frontmost detachable shoe cover 901 of the plurality of detachable shoe covers 90 (90A-90D) at the dispenser arrangement 101 for wearing the frontmost detachable shoe cover 901 on the shoe of the user placed in the receiving cavity 92 through the opening 94 thereof; and (c) separating the frontmost detachable shoe cover 901 from a subsequent detachable shoe cover 902 of the plurality of detachable shoe covers 90 (90A-90D), by the separator 30 (30A) arranged at the dispenser arrangement 101 of the installation assembly 10 of the dispenser device under a pulling of the frontmost detachable shoe cover 901 away from the subsequent detachable shoe cover 902.

In the step (b), the frontmost detachable shoe cover is opened by stretching the elastic element 96 provided around the opening edge portion 93 to open the opening 94 by means of the rear retaining arrangement 50 and the front retaining configuration 40 installed in the dispenser arrangement 101 of the installation assembly 10.

The step (c) further includes steps of:

(c-1) guiding the opening edge portion of the frontmost detachable shoe cover 901 to be moved against the separator 30 (30A) until the opening edge portion of the frontmost detachable shoe cover 901 is broken by the separator 30 (30A) to open the joint perforations 951, 952 to allow the frontmost detachable shoe cover 901 to detach from the installation assembly 10 of the dispenser device; and (c-2) guiding the subsequent detachable shoe cover 902 to move to the dispenser arrangement 101 of the installation assembly 10 to become the current frontmost detachable shoe cover 901' while the previously frontmost detachable shoe cover 901 is moved to be detached from the dispenser arrangement 101 of the installation assembly 10, wherein the current frontmost detachable shoe cover 901' is opened by means of the rear retaining arrangement 50 and the front retaining configuration 40 installed in the dispenser arrangement 101 of the installation assembly 10 as in the step (b).

Therefore, the user may simply wear the frontmost detachable shoe cover 901 by placing his or her shoe therein and moves the shoe and then the frontmost detachable shoe cover 901 continuously moves frontwards with the shoe placed therein away from the installation assembly 10 will break the interconnection between the frontmost detachable shoe cover 901 and the installation arms 11, 12 and the subsequent detachable shoe cover 902 at the same time. In other words, no additional operation is required by the user. To the user, the dispensing operation is as simple as "step in" and "move out".

It is appreciated that the detachable shoe cover 90 (90A-90D) disclosed in the present invention is adapted to various type of shoe cover dispenser devices. Another embodiment of the dispenser device according to the present invention is illustrated in the FIG. 32 to FIG. 53B and the following description.

As shown in FIG. 32 to FIG. 35, a shoe cover dispenser device 100 for dispensing a plurality of shoe covers 90 according to a first preferred embodiment of the present invention is illustrated. The shoe cover dispenser device 100 comprises an installation assembly 10, a frame 20, and a locking assembly A30. The installation assembly 10 is installed in the frame 20, and the locking assembly A30 is installed in the frame 20 and can lock the installation assembly 10.

In detail, as shown in FIG. 32 to FIG. 35, the frame 20 is a structure capable of receiving a plurality of shoe covers 90, and the frame 20 is convenient for enabling the shoe covers 90 to be worn by a user. The installation assembly 10 comprises two installation arms 11 and 12, and the two installation arms 11 and 12 can connect a plurality of the shoe covers 90 in series and open the shoe covers 90, and can facilitate a user to wear the shoe covers 90 on shoes.

The locking assembly A30 comprises a first locking member A31 and a second locking member A32, wherein the installation assembly 10 comprises a first end portion 101 and a second end portion 102, wherein the first end portions 101 of the two installation arms 11 and 12 are locked by the first locking member A31 so that the second end portions 102 of the two installation arms 11 and 12 can be free end portions, so that the shoe cover 90 can be removed from the second end portions 102 of the installation assembly 10.

Correspondingly, the second locking member A32 can lock the second end portions 102 of the two installation arms 11 and 12, so that the installation assembly 10 is fixed to the frame 20 and the first end portion 101 of the two installation arms 11 and 12 can be free end portions which are convenient to install the shoe covers 90 on the installation assembly 10.

In other words, when installing the shoe covers 90, firstly, the second locking member A32 of the locking assembly A30 locks the second end portions 102 of the installation assembly 10, and the first locking member A31 is operated to release the first end portions 101, so that the installation assembly 10 is fixed to the frame 20 and the first end portions 101 of the installation assembly 10 are free end portions, thereby facilitating to install the shoe covers 90 on the installation assembly 10. After the shoe covers 90 are installed in the installation assembly 10, the first end portions 101 of the installation assembly 10 are locked by the first locking member A31 of the locking assembly A30, and then the second locking member A32 is opened, so that the second end portions 102 of the installation assembly 10 are released from the second locking member A32 to form free end portions, thereby facilitating the separation of the shoe covers 90 from the second end portions 102 of the installation assembly 10.

In the preferred embodiment of the present invention, the installation assembly comprises two elongated installation arms 11 and 12, so as to connect a plurality of shoe covers 90 in series, and the distance between the two installation arms 11 and 12 is greater than the width of the shoe. In this way, the opened opening of each of the shoe covers 90 can facilitate the user's shoes to wear the shoe covers 90.

Figure 32:
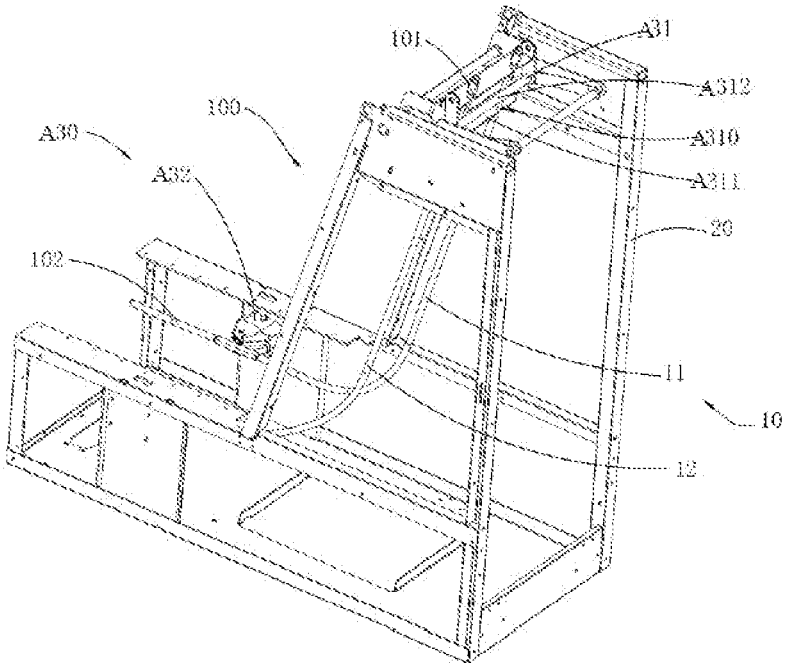
FIG. 32 is a perspective view of a shoe cover dispenser device according to another preferred embodiment of the present invention.

The first locking member A31 comprises a holding base A311 mounted to the frame 20, and a movable frame A316, wherein the holding base A311 has two grooves A310, wherein the positions of the two grooves AA310 are corresponding to the positions of the first end portions 101 of the two installation arms 11 and 12 of the installation assembly 10, and the first end portions 101 of the two installation arms 11 and 12 can be respectively clamped into the two grooves A310. The first locking member A31 further comprises at least one positioning member A312 connected to the movable frame A316, the positioning member A312 can be rotated and bias against to one side of the two installation arms 11 and 12 of the installation assembly 10, so that the two installation arms 11 and 12 are respectively fixed in the two grooves A310 of the first locking member A31, thereby completing the fixing of the first end portions 101 of the two installation arms 11 and 12 of the installation assembly 10, as shown in FIG. 32 of the drawings.

Figure 33:
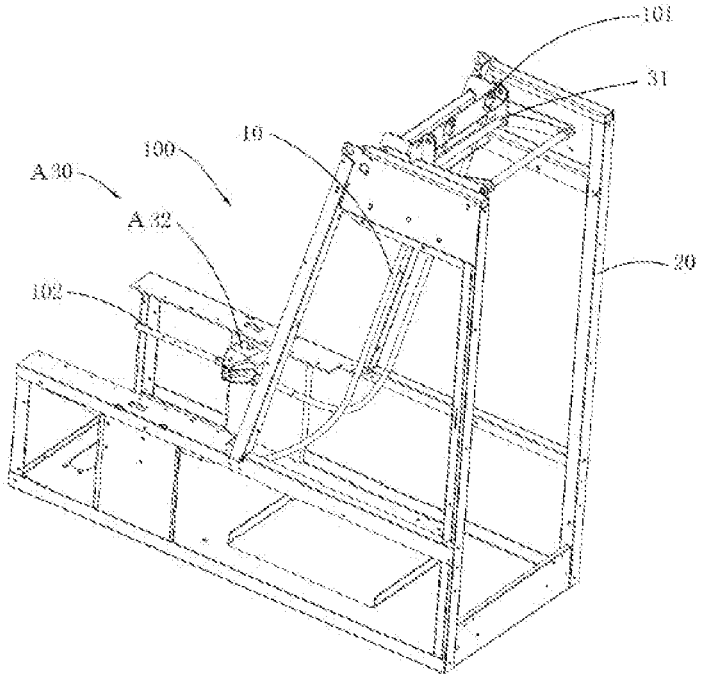
FIG. 33 is a perspective view illustrating releasing of second end portions of two installation arms from a second locking member of the shoe cover dispenser device according to the above another preferred embodiment of the present invention.
Figure 34:
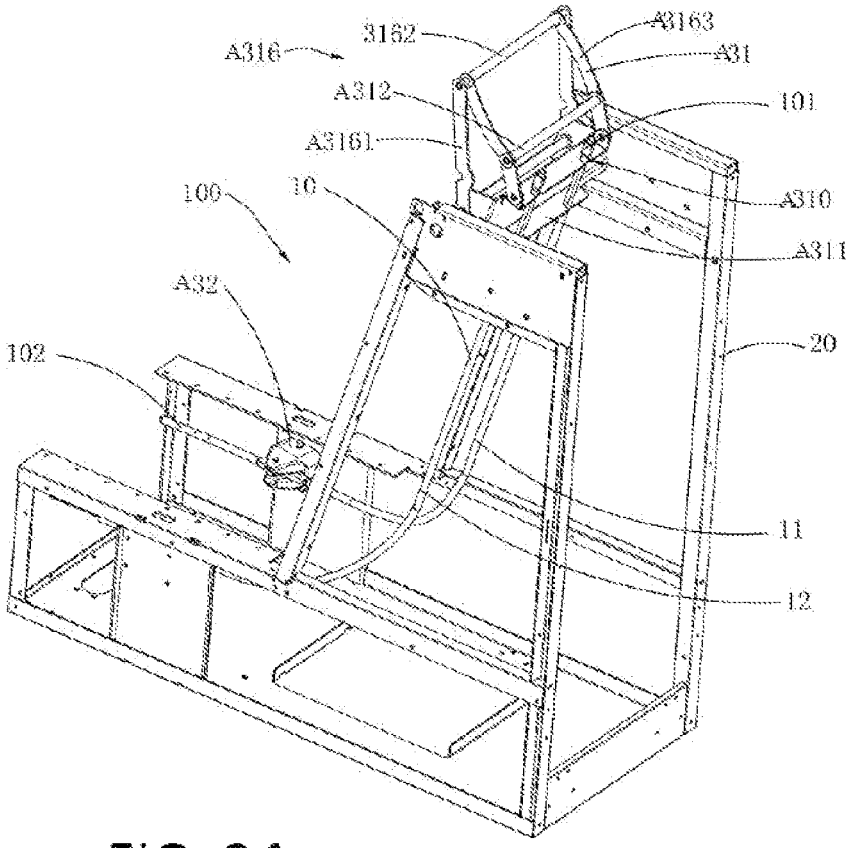
FIG. 34 and FIG. 35 are perspective views illustrating releasing of first end portions of the two installation arms from a first locking member of the shoe cover dispenser device according to the above another preferred embodiment of the present invention.
Figure 35:
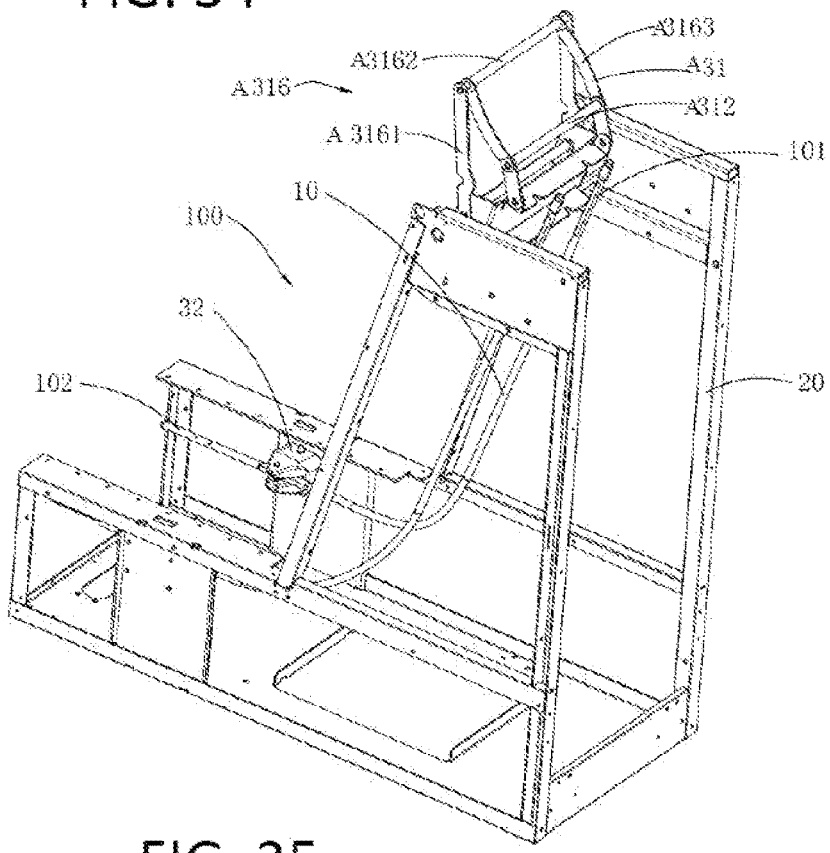
Figure 36A:
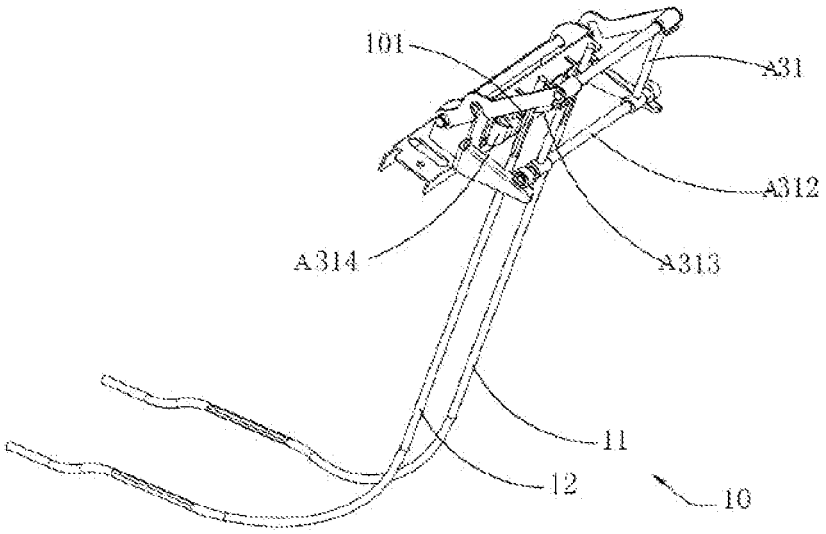
FIG. 36A to FIG. 36B are perspective views illustrating a first locking member of the shoe cover dispenser device according to a first alternative mode of the another preferred embodiment of the present invention.
Figure 36B:
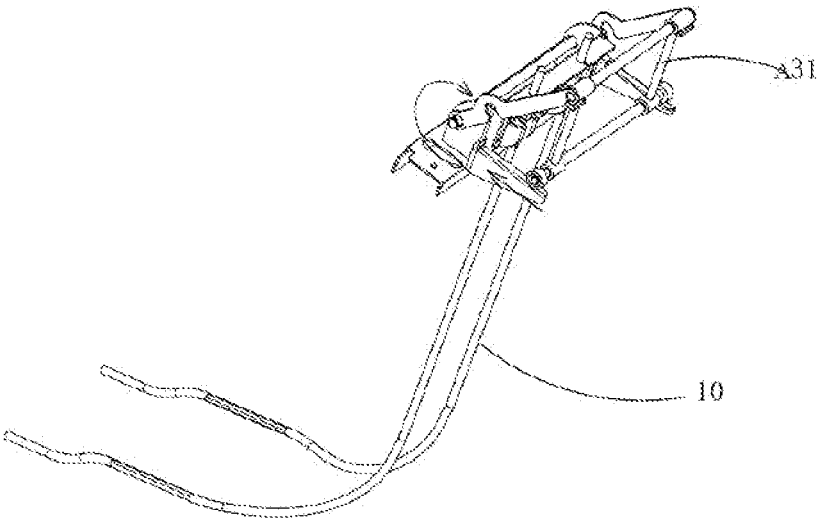
Figure 37A:
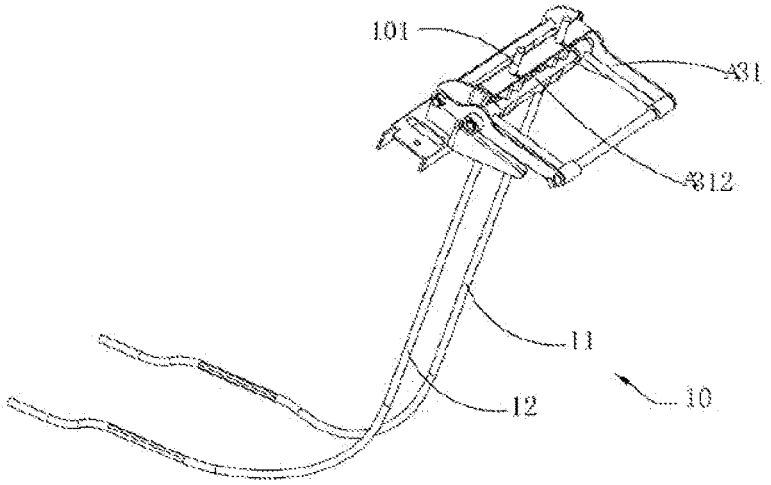
FIG. 37A is a perspective view illustrating the first locking member of the shoe cover dispenser device being in a locked state according to the first alternative mode of the another preferred embodiment of the present invention.
Figure 37B:
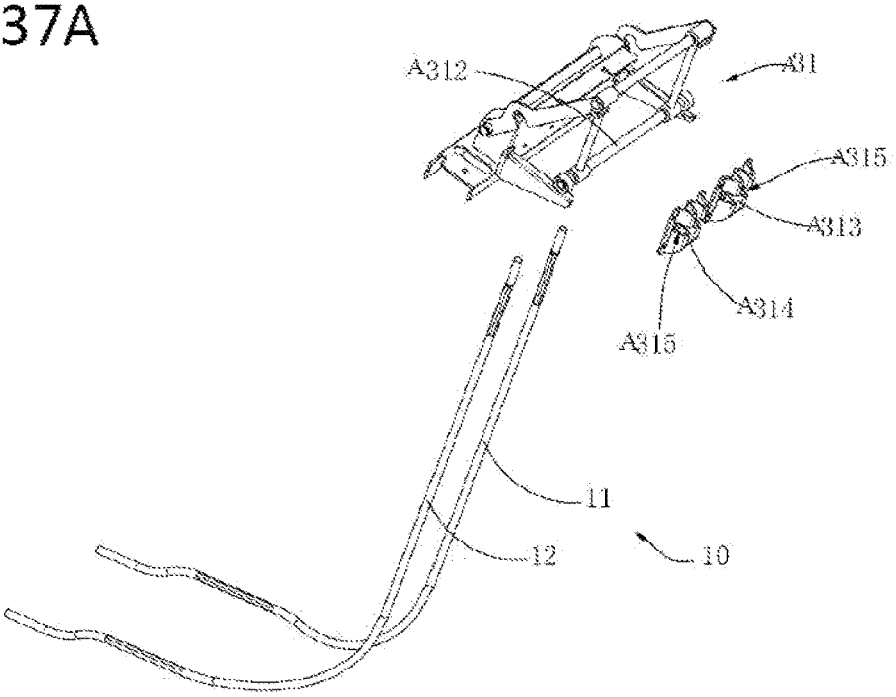
FIG. 37B is an exploded view of the first locking member and the two installation arms of the shoe cover dispenser device according to the first alternative mode of the another preferred embodiment of the present invention.
Figure 37C:
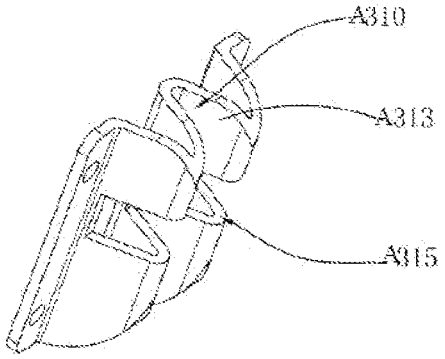
FIG. 37C is a partial enlarged perspective view of a positioning block of the first locking member of the shoe cover dispenser device according to the first alternative mode of the another preferred embodiment of the present invention.
Figure 38A:
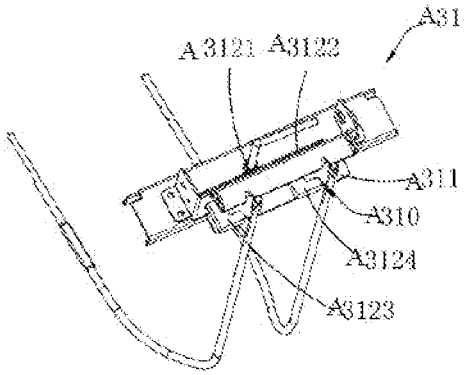
FIG. 38A and FIG. 38B are perspective views illustrating a first locking member of the shoe cover dispenser device according to a second alternative mode of the another preferred embodiment of the present invention.
Figure 38B:
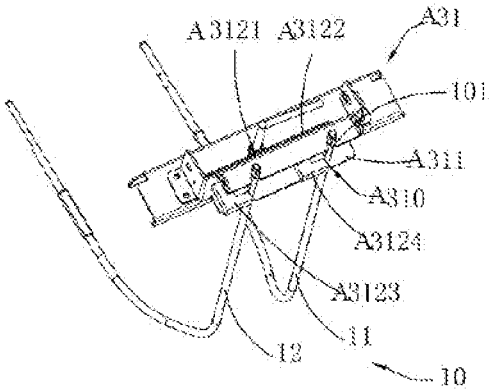
Figure 38C:
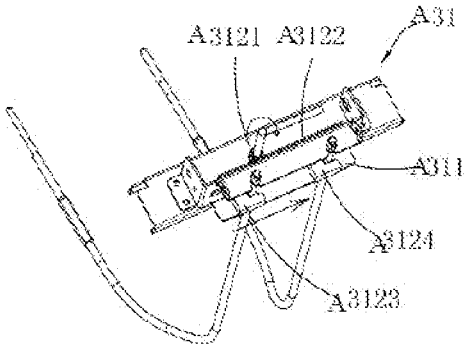
FIG. 38C is a perspective view illustrating the first locking member of the shoe cover dispenser device being in a locked state according to the second alternative mode of the another preferred embodiment of the present invention.
Figure 38D:
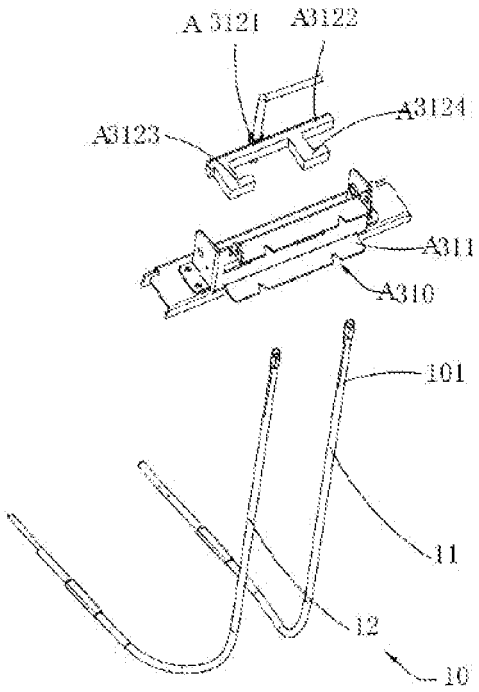
FIG. 38D is an exploded view of the first locking member and the two installation arms of the shoe cover dispenser device according to the second alternative mode of the another preferred embodiment of the present invention.

As shown in FIGS. 33 to 35 of the drawings, when the two second end portions 102 are locked by the second locking member A32, the first end portions 101 can be released from the two grooves A310 by operating the first locking member A31 to rotate the positioning member A312. More specifically, the movable frame A316, which is pivotally mounted to the frame 20, comprises two first movable arms A3161 pivotally mounted to the frame 20, a handle A3162 mounted between the two first movable arms A3161, two second movable arms A3163 pivotally mounted to the holding base A311. The positioning member A312 is extended between the two second movable arms A3163. When the handle A3162 is driven to rotate, the movable frame A316 is driven to rotate, so as to drive the positioning member A312 to rotate so as to lock or release the two first end portions 101 of the installation arms 11 and 12.

FIGS. 36A to 37C are perspective views of the shoe cover dispenser device 100 according to a first alternative mode of the preferred embodiment of the present invention. Different from the above-mentioned preferred embodiment, in this first alternative mode, the first locking member A31 can be implemented as a locking mechanism comprising a first positioning block A313 and a second positioning block A314, wherein the first positioning block A313 and the second positioning block A314 are substantially W-shaped members, wherein the first end portions 101 of the two installation arms 11 and 12 of the installation assembly 10 can be respectively stored in the W-shaped grooves AA310 of the first positioning block A313 and the second positioning block A314. And each of the first positioning block A313 and the second positioning block A314 has a clamping groove A315, the positions of the clamping groove A315 on the first positioning block A313 and the clamping groove A315 on the second positioning block A314 are aligned with each other, and the positioning member A312 can be engaged with the clamping groove A315 of the first positioning block A313 and the clamping groove A315 of the second positioning block A314 after being reversedly rotated for biasing against the two installation arms 11 and 12, thereby completing the alignment of the first positioning block A313 and the second positioning block A314, so that the first end portions 101 of the two installation arms 11 and 12 of the installation assembly 10 can be fixed by the first locking member A31.

As shown in FIGS. 38A to 38D which are perspective views of the shoe cover dispenser device 100 according to a second alternative mode of the preferred embodiment of the present invention. The difference from the above-mentioned preferred embodiment is that in this second alternative mode, the positioning member A312 in the first locking member A31 is implemented as a gear-rack structure which comprises a gear A3121 and a rack A3122 cooperated to move with respect to the gear A3121, and the rotary motion of the gear A3121 can actuate the linear motion of the rack A3122.

Further, the rack A3122 comprises a first stop arm A3123 and a second stop arm A3124, and the first end portions 101 of the two installation arms 11 and 12 of the installation assembly 10 can be retained in the first stop arm A3123 and the second stop arm A3124, so as to realize the fixing of the two installation arms 11 and 12 of the installation assembly 10 in the two grooves A310 on the holding base A311, so as to realize fixation of the first end portions 101 of the two installation arms 11 and 12 of the installation assembly 10.

Figure 39A:
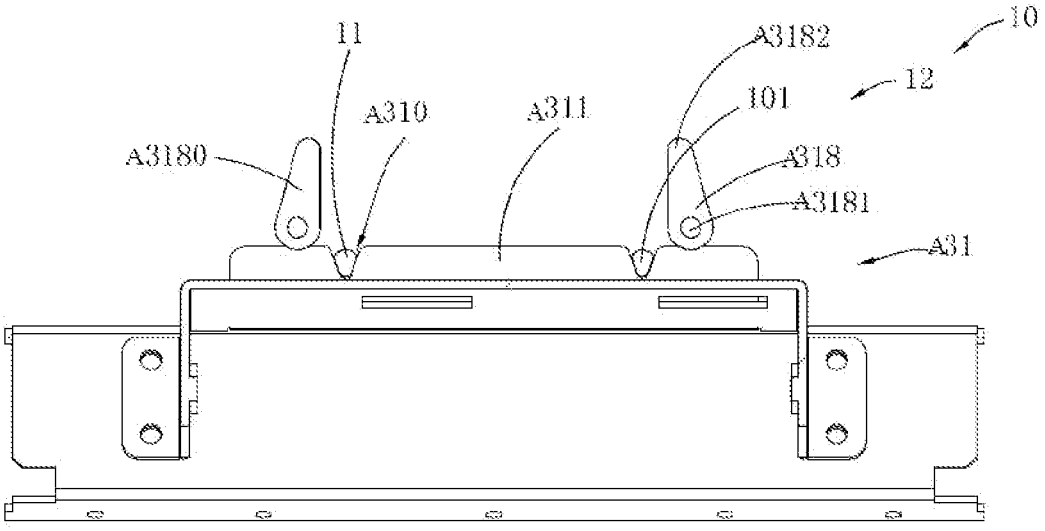
FIG. 39A is a perspective view illustrating the first locking member of the shoe cover dispenser device being in an unlocked state according to a third alternative mode of the another preferred embodiment of the present invention.
Figure 39B:
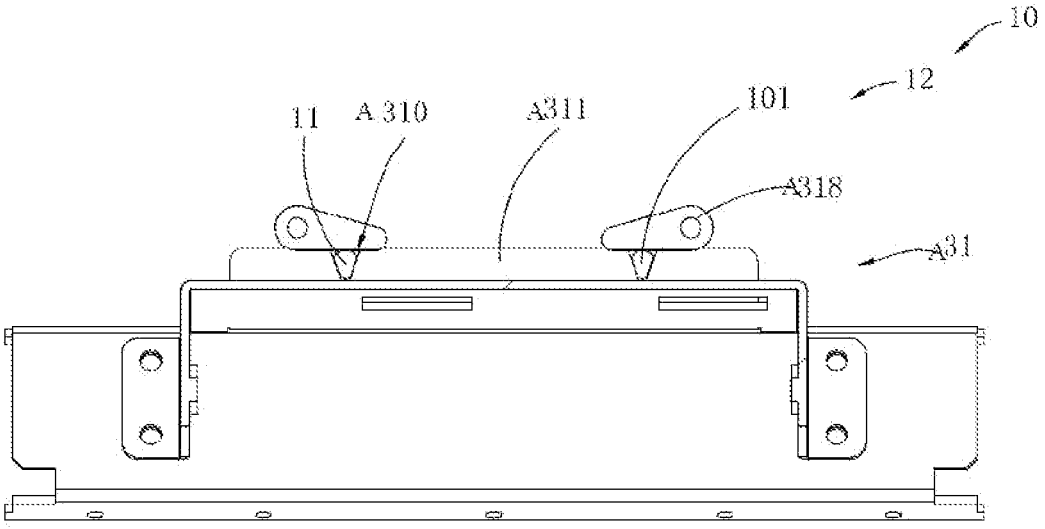
FIG. 39B is a perspective view illustrating the first locking member of the shoe cover dispenser device being in a locked state according to the above third alternative mode of the another preferred embodiment of the present invention

As shown in FIGS. 39A to 39B, which are perspective views of preferred embodiment, the shoe cover dispenser device 100 according to a third alternative mode of the preferred embodiment of the present invention. The difference from the above-mentioned preferred embodiment is that in this third alternative mode, the positioning member A312 in the first locking member A31 is implemented as an eccentric mechanism A318, wherein the eccentric mechanism A318 is mounted near the two grooves A310 in the holding base A311, wherein an eccentric wheel A3181 of the eccentric mechanism A318 can rotate along the holding base A311, so that the holding arm end portion A3182 of the eccentric mechanism A318 can hold to stop the first end portions 101 of the installation arms 11 and 12 of the installation assembly 10 after rotating, so that the first end portions 101 of the two installation arms 11 and 12 of the installation assembly 10 are fixed to the holding base A311.

In addition, one skilled in the art can adjust the structure of the positioning member A312 in the first locking member A31 of the shoe cover dispenser device 100 according to the actual situation, such as adjusting the positioning members A312 in the first locking member A31. For example, the positioning member A312 can be a shifter lever and so on.

Figure 40A:
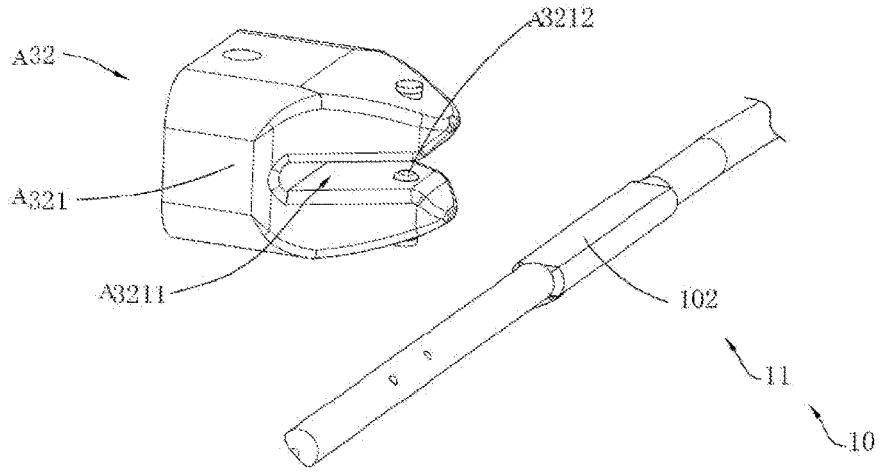
FIG. 40A and FIG. 40B are perspective view illustrating a second locking member of the shoe cover dispenser device according to the above another preferred embodiment of the present invention.
Figure 40B:
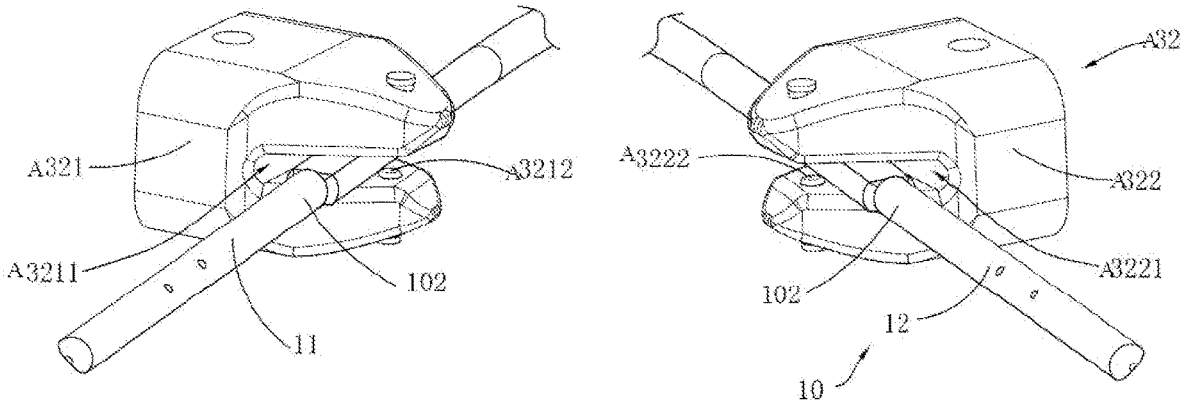

FIGS. 40A to 40B are perspective views illustrating the second locking member of the preferred embodiment of the shoe cover dispenser device 100 of the present invention. The second locking member A32 has two slots, and two second end portions 102 of the installation arms 11 and 12 of the installation assembly 10 can be fixed to the two slots respectively, thereby fixing the two installation arms 11 and 12 of the installation assembly 10 to the frame 20. At this time, the first end portions 101 of the two installation arms 11 and 12 can be free end portions, so a series of shoe covers 90 can be mounted on the installation assembly 10 through the first end portions 101 of the two installation arms 11 and 12.

The second locking member A32 which is mounted to the frame 20 is configured to comprise a first holding member A321 and a second holding member A322, wherein the first holding member A321 has a first slot A3211 and comprises at least one first locking ball A3212. The first locking ball A3212 holding member A321 is movable holding member A321 can allow the second end portion 102 of the installation assembly to be locked in the first slot 3A31.

The second holding member A322 has a second locking slot A3221 and comprises at least one second locking ball A3222, wherein the second locking ball A3222 is movable to allow the second end portion 102 of the installation assembly 10 to be locked in the second slot 3A32.

In other words, when the second end portions 102 of the two installation arms 11 and 12 of the installation assembly 10 are respectively placed in the first slot A3211 of the first holding member A321 and the second slot A3221 of second holding member A322, the second end portions 102 of the two installation arms 11, 12 of the installation assembly 10 can be locked by locking the first locking ball A3212 and the second locking ball A3222, thereby locking the installation assembly 10 fixedly connected to the frame 20. So that when the first end portions 101 of the two installation arms 11, 12 of the installation assembly 10 are released from the first locking member A31, a plurality of the shoe covers 90 is mounted to the shoe cover dispenser device 100 through the first end portion 101 of the two installation arms 11, 12 of the installation assembly 10.

Further, the first holding member A321 and the second holding member A322 are configured to be able to move laterally and longitudinally with respect to the frame 20, so as to increase fitness between the two end portions of the second installation arms 11 and 12 of the two installation arms 11 and 12 of the installation assembly 10 and the first slot A3211 and the second slot A3221.

Furthermore, the first holding member A321 and the second holding member A322 can be movably connected to the frame 20, so that the position of the first slot A3211 of the first holding member A321 and the second slot A3221 of the second holding member A322 can be adjusted relative to the positions of the second end portions 102 of the two installation arms 11 and 12 of the installation assembly 10, so that when the positions of the two installation arms 11 and 12 of the installation assembly 10 and the first holding portion and the second holding member A322 are not aligned with each other, and the relative positions of the first holding member A321 and the second holding member A322 can also be adjusted to make the second end portions 102 of the two installation arms 11 and 12 of the installation assembly 10 are respectively engaged with the first holding member A321 and the second holding member A322 to complete the fixing of the second end portions 102 of the two installation arms 11 and 12 of the installation assembly 10.

Figure 41A:
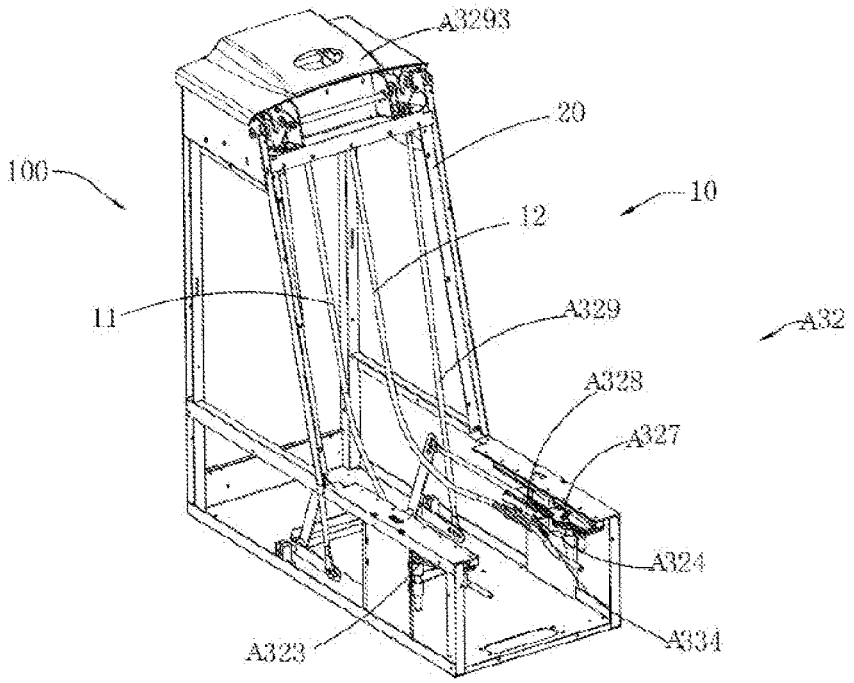
FIG. 41A to FIG. 41C are perspective views of the shoe cover dispenser device according to a fourth alternative mode of the another preferred embodiment of the present invention.
Figure 41B:
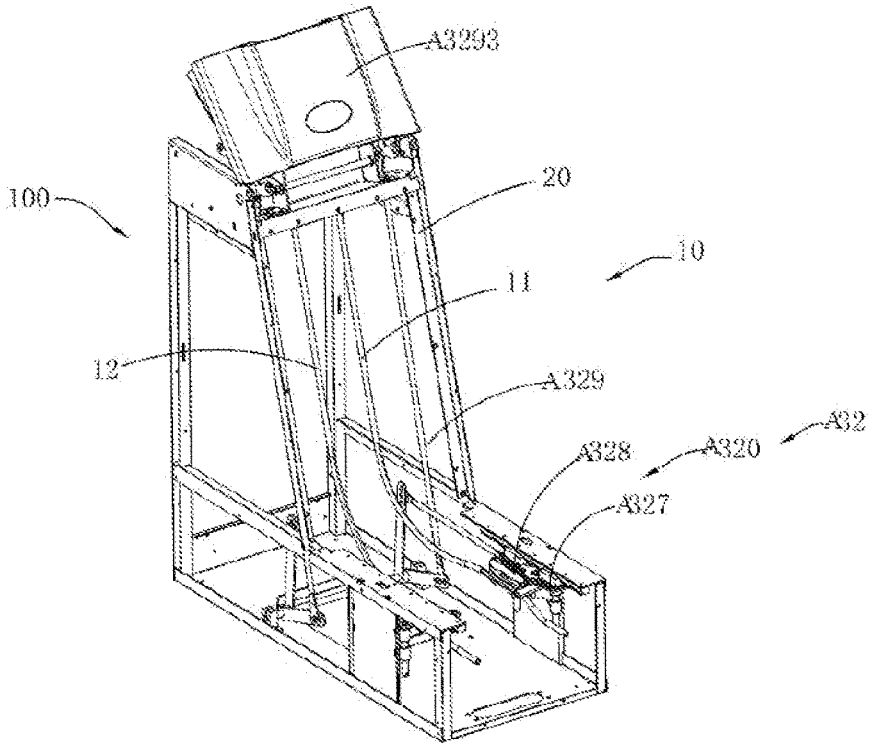
Figure 41C:
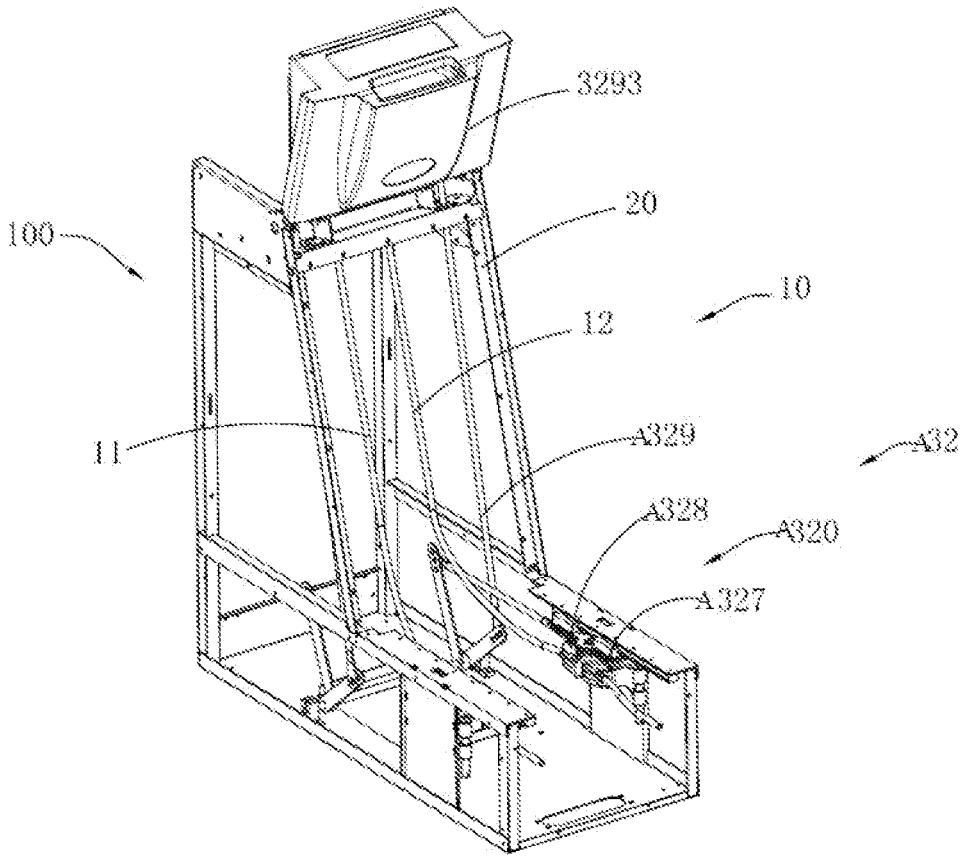

As shown in FIG. 41A to FIG. 41C, the shoe cover dispenser device 100 according to a fourth alternative mode of the preferred embodiment of the present invention is illustrated. The difference from the above-mentioned preferred embodiment is that in this fourth alternative mode, the second locking member A32 is configured to comprise two locking system A320 each comprises a guiding mechanism A327, a locking unit AA328, and a transmission mechanism A329. The guiding mechanism A327 is fixedly connected to the end of the transmission mechanism A326 so as to be able to move when it is driven by the transmission mechanism A326, and can secure the installation assembly 10 to the second locking member A32. The locking unit AA328 can be embodied to comprise the two holding members A321 and A322, or other suitable structure that can be arranged to detachably fix the two second end portions 102 of the installation arms 11 and 12.

The transmission mechanism A329 is implemented as a transmission mechanism A329 which comprises a crank A3291 and an actuating mechanism AA3292, wherein the crank A3291 works as an active driving member, so that the rotation of the crank A3291 is converted by the transmission mechanism A329 to actuate the displacement of the actuating mechanism AA3292.

The guiding mechanism A327 comprises a displacement mechanism A3271, a control mechanism A3272 and a sliding member A3273. The sliding member A3273 is arranged on the displacement mechanism A3271 and is fixedly connected to the control mechanism A3272 so that the control mechanism A3272 can be used to be driven by the sliding member A3273 to move along with the movement of the displacement mechanism A3271, wherein the displacement mechanism A3271 is fixed to an end of the transmission mechanism A329. The control mechanism A3272 comprises a guide rod A32721, a pusher member A32722, and a pivot shaft A32723 mounted to the frame 20, wherein the guide rod A32721 pivotally connected to the pivot shaft A32723 and is arranged to be extended outward from the end of the actuating mechanism A3292 and can move along with the actuating mechanism A3292, so that a displacement of the guide rod A32721 with respect to the frame 20 is performed, the pusher member A32722 is extended downwardly from the guide rod A32721, and the first end portions 101 of the two installation arms 11 and 12 of the installation assembly 10 are arranged between the pusher member A32722 and the guide rod A32721, so that the second end portions 102 of the two installation arms 11 and 12 of the installation assembly 10 can be biased against by the pusher member A32722 to move to a state in which the second end portions 102 of the two installation arms 11 and 12 are retained and fixed by the two second locking units A328. And when the control mechanism A3272 is moved away from the two installation arms 11 and 12, the second end portions 102 of the two installation arms 11 and 12 are not retained by the two locking units A328, so that the second end portions 102 of the two installation arms 11 and 12 can be free end portions for dispensing the shoe covers 90.

In the fourth alternative mode of the preferred embodiment of the shoe cover dispenser device 100 of the present invention, a cross rod 200 is provided on the frame 20, and the cross rod 200 is configured to be fixed to the bottom of the frame 20. The actuating mechanism A3292 comprises a first connecting rod A32921, a second connecting rod A32922, a third connecting rod A32923, and a fourth connecting rod A32924, wherein the first connecting rod A32921 is hingedly connected with the crank A3291, so that the first connecting rod A32921 realizes up and down movement under the rotation of the crank A3291. At the same time, the first connecting rod A32921 is able to drive the second connecting rod A32922 to rotate, the second connecting rod A32922 and the third connecting rod A32923 are movably connected to the cross rod 200, and the second connecting rod A32922 and the third connecting rod A32923 are rotatable with the cross rod 200. The fourth connecting rod A32924 is movably connected to the third connecting rod A32923 and can be driven to move by the third connecting rod A32923, and the displacement mechanism A3271 is fixedly connected to the fourth connecting rod A32924 so that the displacement mechanism A3271 can perform forward and backward reciprocating displacement movement relative to the cross rod 200 under the driving of the fourth connecting rod A32924.

Therefore, when the crank A3291 rotates, the first connecting rod A32921 is driven to move up and down, and the up and down movement of the first connecting rod A32921 simultaneously drives the second connecting rod A32922 to rotate with respect to the cross rod 200, and the rotational movement of the second connecting rod A32922 will correspondingly drive the third connecting rod A32923 to rotate with respect to the cross bar 200, so that the fourth connecting rod A32924 is driven by the third connecting rod A32924 to move, thereby driving the displacement mechanism A3271 to perform corresponding forward and backward displacement movements.

The displacement mechanism A3271 comprises a retaining surface A32710 defining a displacement groove A32711. The retaining surface A32710 is an inner side surface which comprises a retention surface A327101 which can be an inclined surface or a curved surface, and a straight surface A327102, the retention surface A327101 and the straight surface A327102 are smoothly transitioned, and the sliding member A3273 is arranged in the displacement groove A32711, and the sliding member A3273 can slide along the retaining surface A32710.

The sliding member A3273 is fixedly connected to the guide rod A32721 in the control mechanism A3272, so when the displacement mechanism A3271 moves forward and backward, the sliding member A3273 is driven by the retaining surface A3271 to slide along the retaining surface A32710 of the displacement groove A32711, so as to drive the guide rod A32721 in the control mechanism A3272 to pivotally rotate.

Since the pusher member A32722 is fixedly connected to the guide rod A32721, the pusher member A32722 will be driven by the guide rod A32721 to rotate to push against the second end portion 102 of the installation arms 11 and 12 of the installation assembly 10 pusher member A32722, so that the two second end portions 102 of the installation arms 11 and 12 of the installation assembly 10 will be driven to move along with the displacement of the guide rod A32721, and thus the two second end portions 102 of the installation arms 11 and 12 can be moved to positions that are locked by the second locking unit A328.

In other words, the locking unit A328 of the second locking member A32 may comprises the first holding member A321 and the second holding member A322 the two second end portions 102 of the two installation arms 11 and 12 of the installation assembly 10 can be respectively engaged in the first slot A3211 and the second slot A3221 under the operation of the transmission mechanism A329 and the pusher member A32722 of the control mechanism A3272, so as to realize the locking of the two installation arms 11 and 12 of the installation assembly 10.

Preferably, in the fourth alternative mode of the present invention, each crank A3291 is implemented as a component of a cover frame A3293, and the cover frame A3293 is movably connected to the frame 20*s*. Therefore, as described above, when the cover frame A3293 is rotated, the guiding mechanism A327 can be driven to move and finally the two installation arms 11 and 12 of the installation assembly 10 are driven to be locked or released.

However, the specific implementation of the present invention is not limited to this. Those skilled in the art can determine the specific structure in the displacement mechanism A3271 according to the actual situation, as long as the sliding member can be realized under the driving of the displacement mechanism A3271 left and right. In other words, as long as the same or similar technical solutions as the present invention are adopted on the basis of the above disclosure of the present invention, the same or similar technical problems as the present invention are solved, within the protection scope of the present invention and the same or similar technical solutions as the present invention are achieved.

As shown in FIGS. 42A to 42F of the drawings, the first locking member A31 and the second locking member A32 of the locking assembly A30 is interlocked with each other. More specifically, when the locking assembly A30 is operated to drive the first locking member A31 locks the two first end portions 101 of the installation arms 11 and 12, the two second end portions 102 of the installation arms 11 and 12 are simultaneously released from the second locking member A32, when the locking assembly A30 is operated to drive the first locking member A31 releases the two first end portions 101 of the installation arms 11 and 12, the two second end portions 102 of the installation arms 11 and 12 are simultaneously locked by the second locking member A32.

Figure 42A:
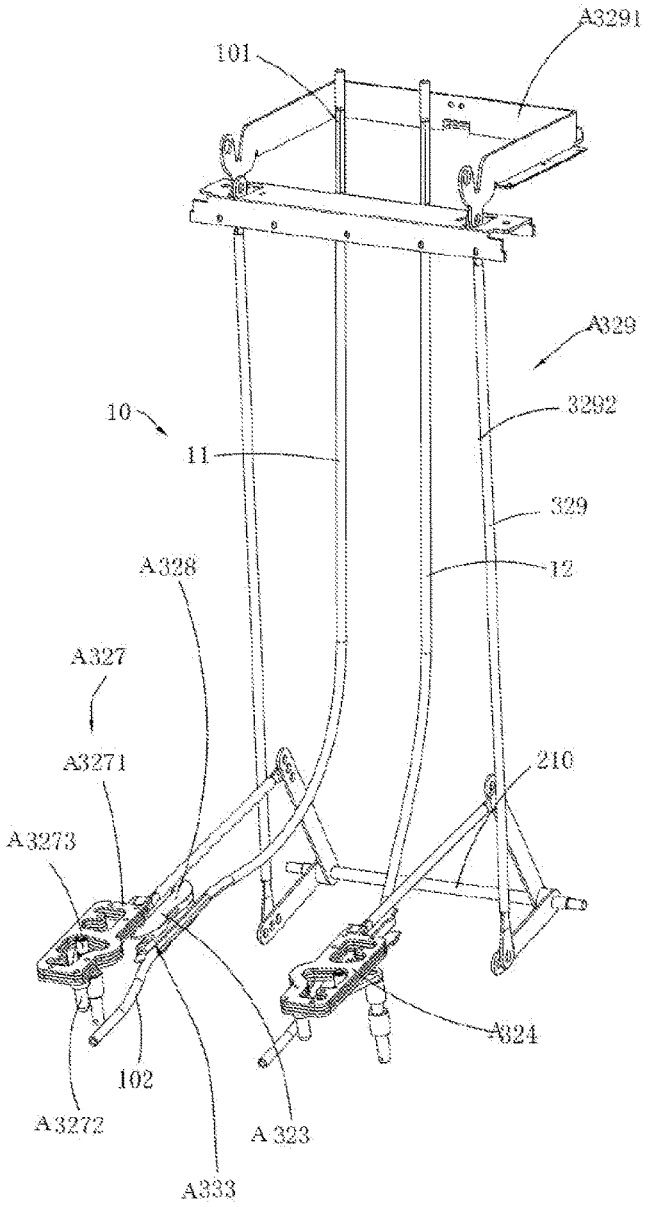
FIG. 42A is a perspective view illustrating a second locking member of the shoe cover dispenser device according to the fourth alternative mode of the another preferred embodiment of the present invention.
Figure 42B:
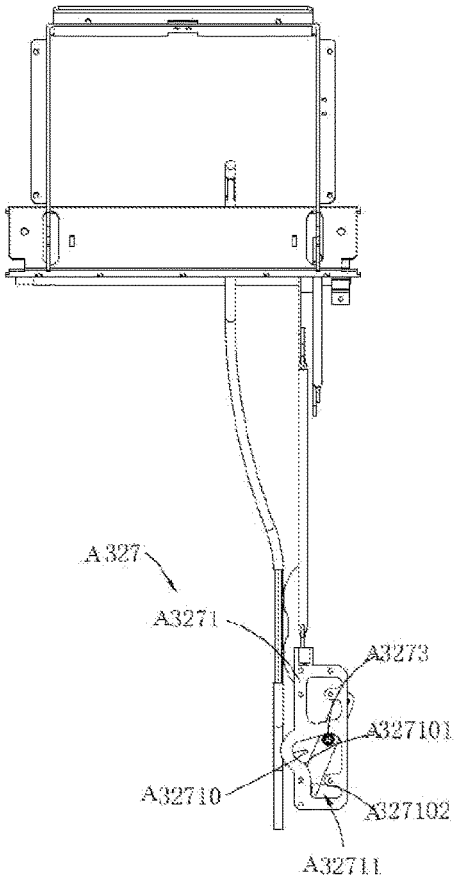
FIG. 42B is a top side view illustrating the second locking member of the shoe cover dispenser device according to the fourth alternative mode of the another preferred embodiment of the present invention.
Figure 42C:
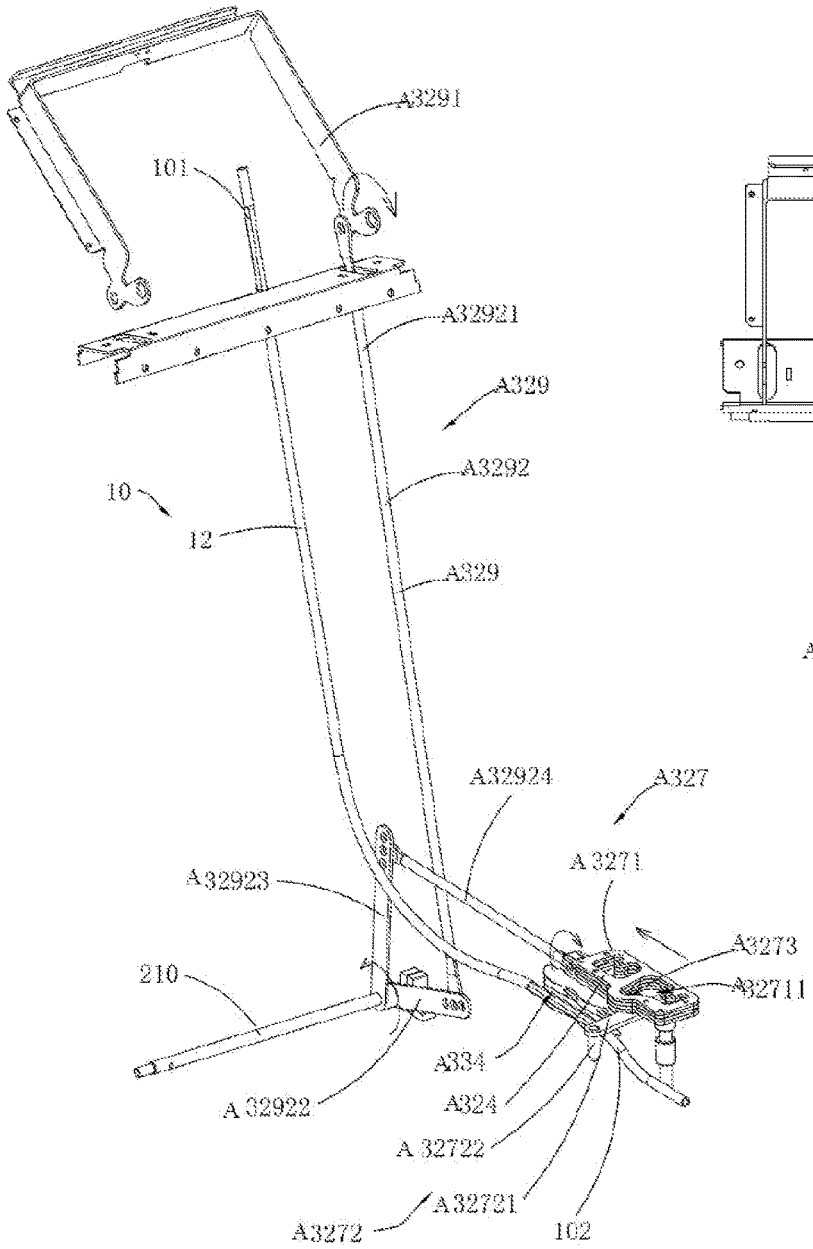
FIG. 42C to FIG. 42F are schematic views illustrating operation of the second locking member for locking the second end portions of the two installation arms of the shoe cover dispenser device according to the fourth alternative mode of the another preferred embodiment of the present invention.
Figure 42D:
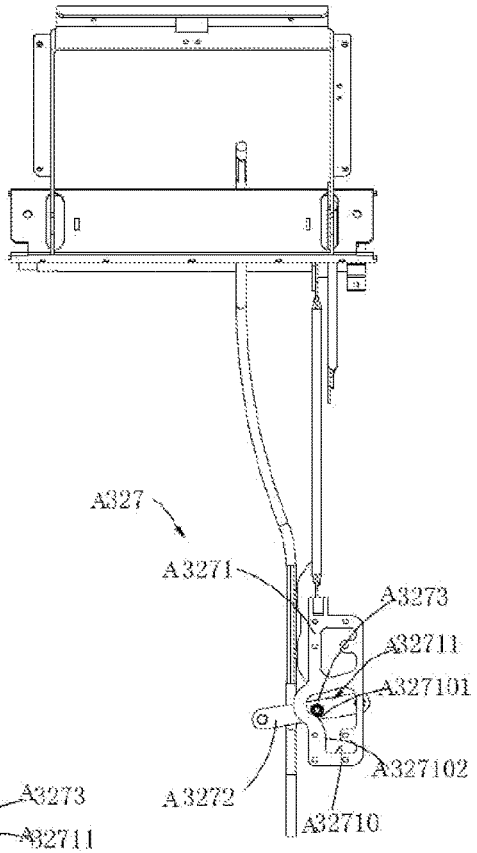
Figure 42E:
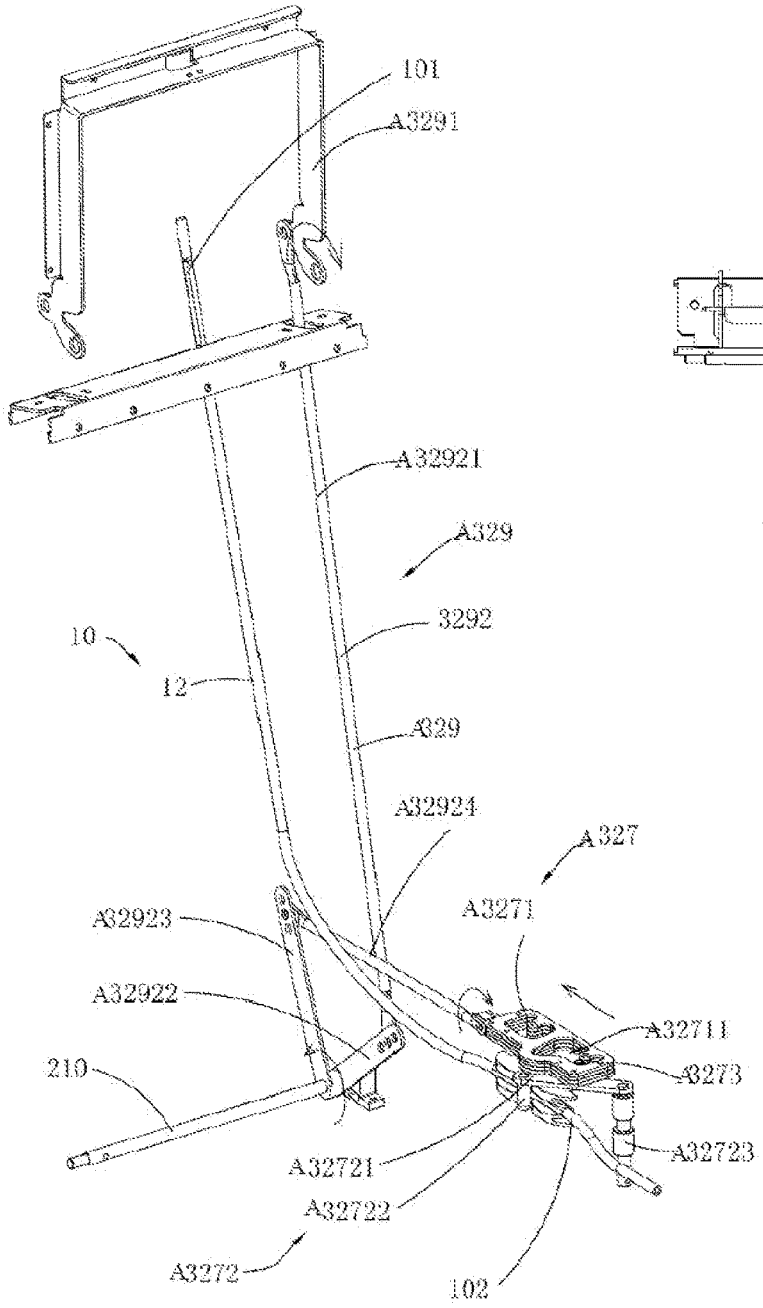
Figure 42F:
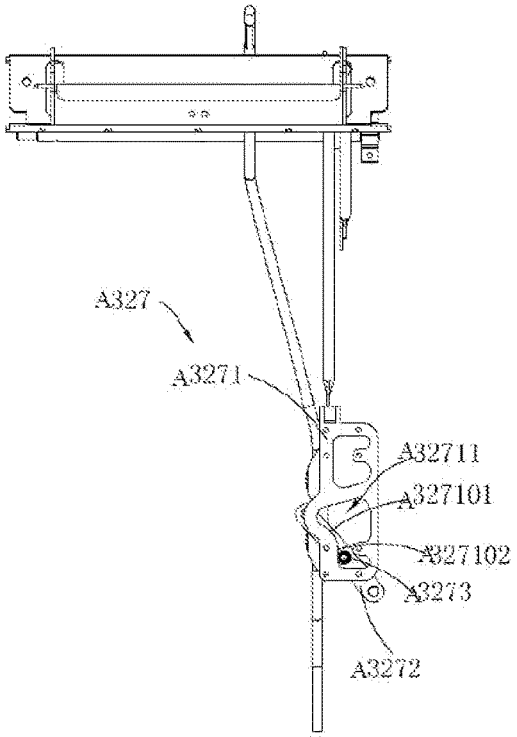
Figure 42H:
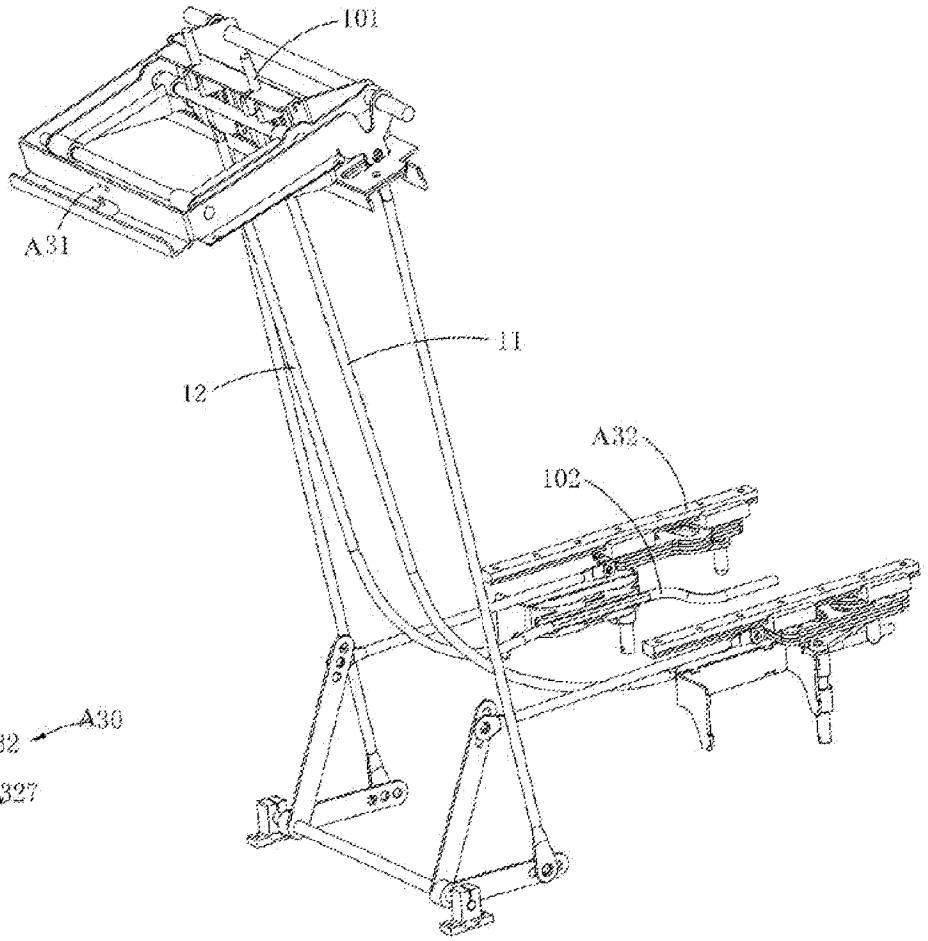
FIG. 42G to FIG. 42H are perspective views illustrating the linked first locking member and second locking member of the shoe cover dispenser device according to the fourth alternative mode of the another preferred embodiment of the present invention.
Figure 42G:
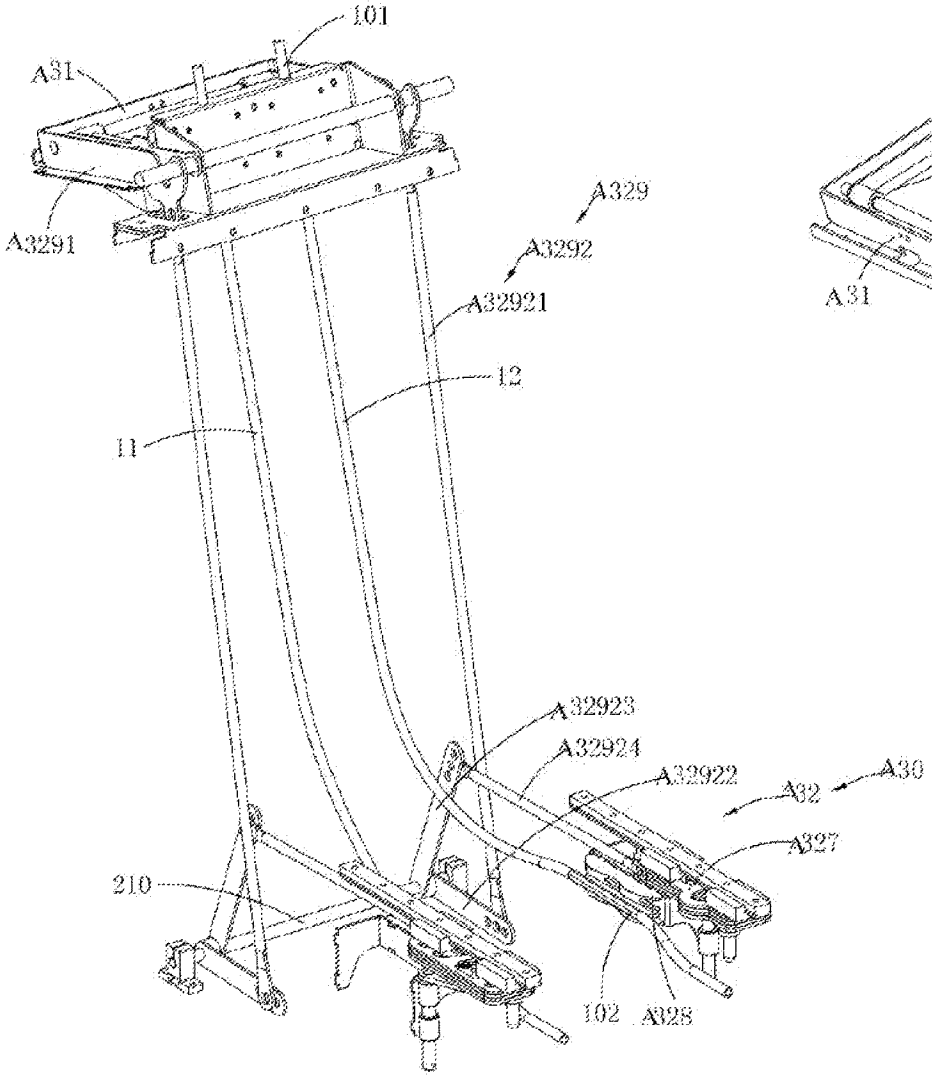
Figure 42J:
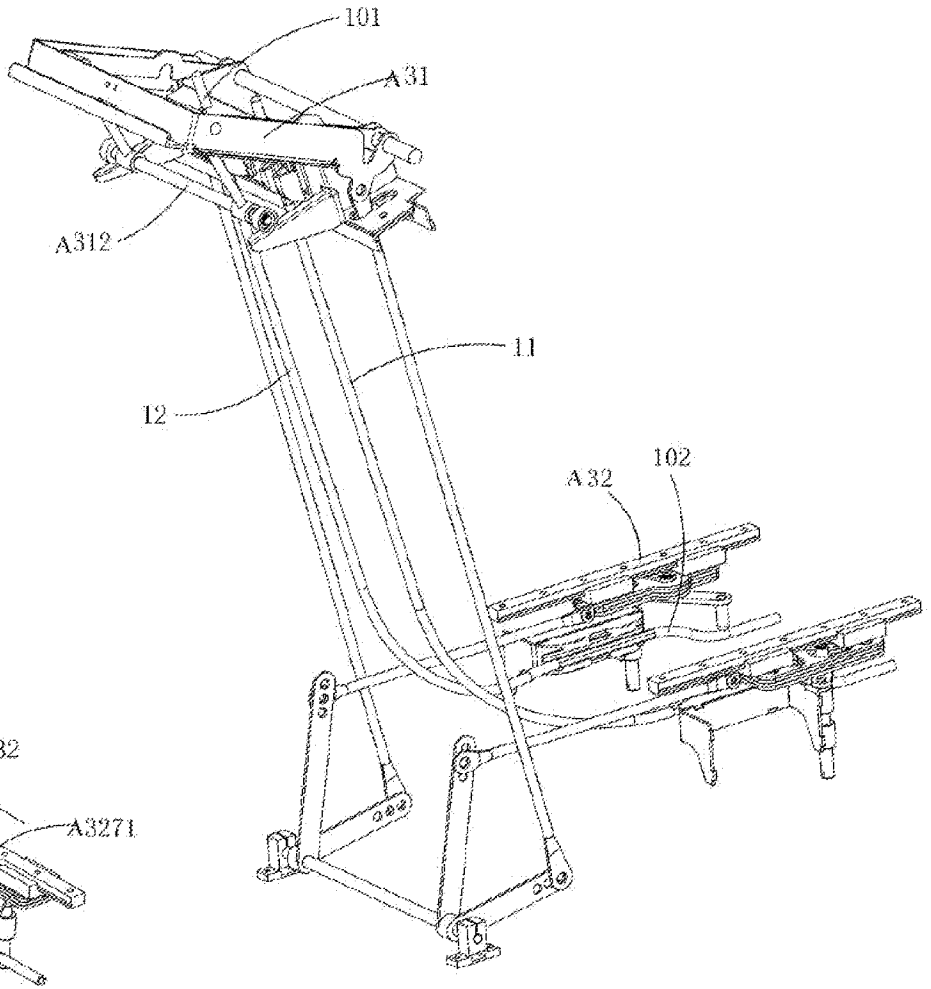
FIG. 42I to FIG. 42J are perspective views illustrating the linkage operation of the linked first locking member and second locking member of the shoe cover dispenser device according to the fourth alternative mode of the another preferred embodiment of the present invention.
Figure 42I:
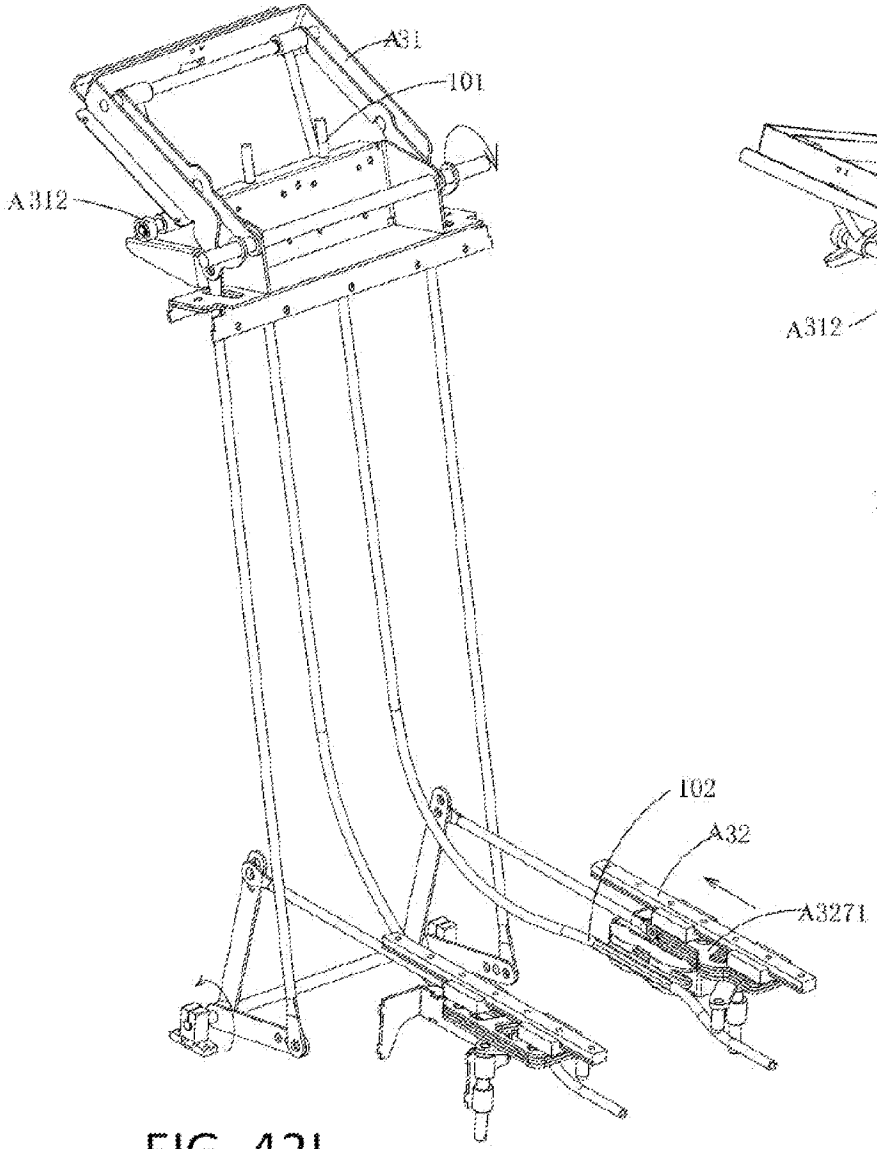
Figure 43A:
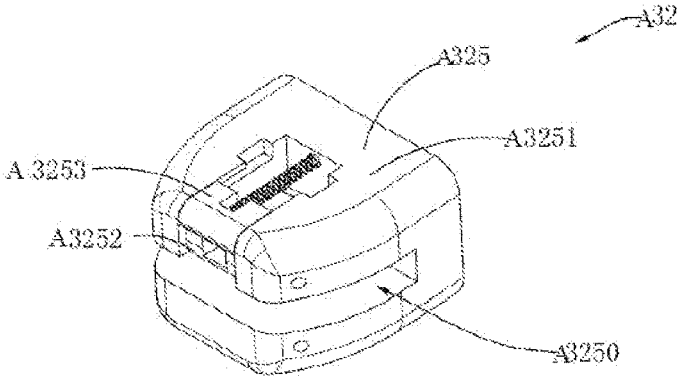
FIG. 43A is a perspective view illustrating a second locking member of—the shoe cover dispenser device according to a fifth alternative mode of the another preferred embodiment of the present invention.
Figure 43B:
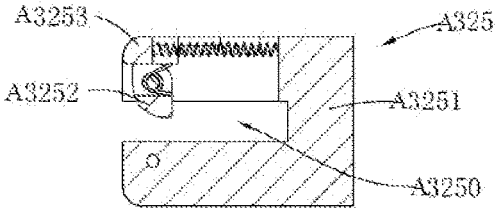
FIG. 43B to FIG. 43H are sectional views illustrating operation of the second locking member for locking or releasing the second end portions of the two installation arms of the shoe cover dispenser device according to the fifth alternative mode of the another preferred embodiment of the present invention
Figure 43C:
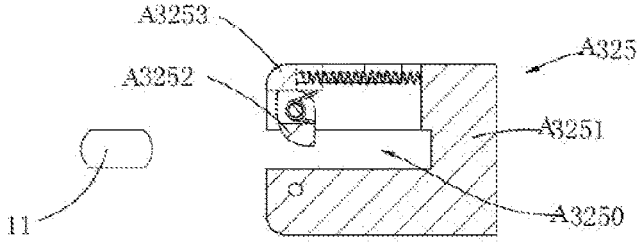
Figure 43D:
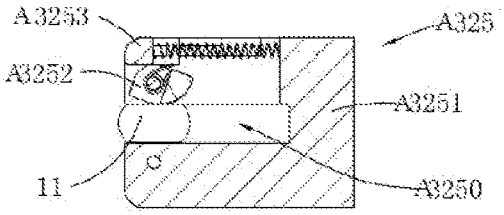
Figure 43E:
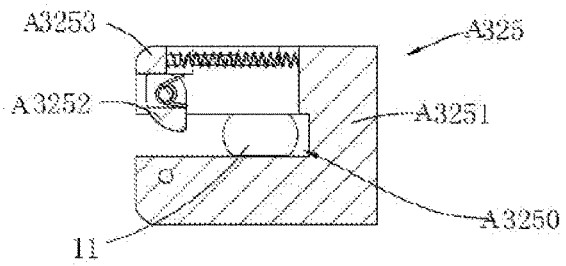
Figure 43F:
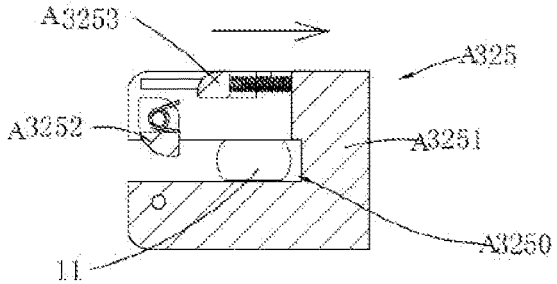
Figure 43G:
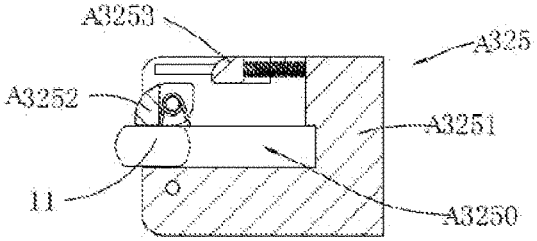
Figure 43H:
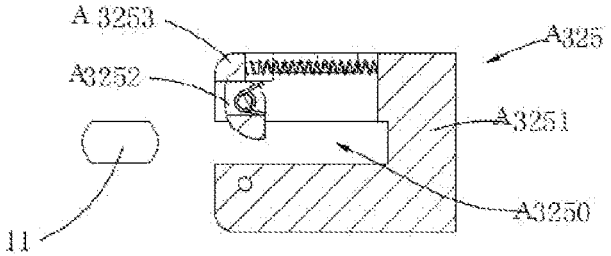

As shown in FIGS. 42G and 42H of the drawings, during a normal working state of the shoe cover dispenser device of this fourth alternative mode of the preferred embodiment of the present invention, the two second end portions 102 of the installation arms 11 and 12 are two free end portions for dispensing the shoe covers 90. As shown in FIGS. 111 to 11L of the drawings, when the locking assembly A30 is operated to lock the two second end portions 102 of the installation arms 11 and 12, the two first end portions 101 of the installation arms 11 and 12 are released for installing new shoe covers 90 to the installation arms 11 and 12.

The operation of the second locking member A32 for locking the two second end portions 102 of the installation arms 11 and 12 will automatically drive the first locking member A31 to release the two first end portions 101 of the installation arms 11 and 12. The operation of the first locking member A31 for locking the two first end portions 101 of the installation arms 11 and 12 will automatically drive the second locking member A32 to release the two second end portions 102 of the installation arms 11 and 12.

According to this fourth alternative mode of the preferred embodiment of the present invention, the first locking member A31 comprises the positioning member AA312, the first positioning block A313 and the second positioning block A314. The first positioning block A313 and the second positioning block A314 are substantially W-shaped members, wherein the two first end portions 101 of the two installation arms 11 and 12 of the installation assembly 10 can be respectively stored in the grooves A310 of the first positioning block A313 and the second positioning block A314. Each of the first positioning block A313 and the second positioning block A314 has a clamping groove A315 for retaining the positioning member A312.

The second locking member A32 comprises two locking system A320 each comprises the guiding mechanism A327, the locking unit A328, and the transmission mechanism A329. The first locking member A31 is integrated with the two cranks A3291 of the transmission mechanism A329 to form the cover frame A3293, so that when the cover frame A3293 is rotated upward, the positioning member A312 is rotated to release the two first end portions 101 of the installation arms 11 and 12, while simultaneously the two second end portions 102 of the installation arms 11 and 12 are driven to be pushed by the pusher members A32722 because of linkage of the second locking member A31 with the first locking member A31, so as to be locked by the locking unit A328, as shown in FIGS. 11I to 11L of the drawings.

When the two first end portions 101 of the installation arms 11 and 12 are free end portions and finished the replacement of new cover covers 90 which are installed on the installation arms 11 and 12, the cover frame A3293 can be rotated downward, so that the two first end portions 101 of the installation arms 11 and 12 are pushed by the positioning member A312, so as to be locked at the grooves A310. Simultaneously, the cover frame A3293 drive the transmission mechanism A329 to move, so as to drive the guide mechanism A327 to drive the two pusher members A32722 to rotate away from the two second end portions 102 of the installation arms 11 and 12, so as to release the two second end portions 102 of the installation arms 11 and 12 to allow the two second end portions 102 of the installation arms 11 and 12 to function as free end portions for dispensing the shoe covers 90. FIGS. 43A to 43H illustrate a preferred embodiment shoe cover dispenser device 100 according to a fifth alternative mode of the preferred embodiment of the present invention. In this fifth alternative mode of the preferred embodiment of the present invention, the second locking member A32 is configured to comprise two self-locking assemblies A325 each comprises a self-locking body A3251 and a self-locking member A3252, wherein the self-locking body A3251 has a receiving groove A3250, the receiving groove A3250 can receive one of the installation arms 11, 12, the self-locking member A3252 is movably arranged on an upper part of the receiving groove A3250 of the self-locking body A3251. When the installation arm 11, 12 are pushed into the two receiving grooves A3250, the two self-locking members A3252 can block the installation arm 11, 12 from moving out from the receiving grooves A3250, thereby fixing the installation arm 11, 12 in the receiving grooves A3250 of the self-locking assembly A30.

Referring to FIGS. 43A-43H, the self-locking assembly A325 further comprises a reset member A3253, wherein the reset member A3253 is elastically disposed on the self-locking body A3251 and the reset member A3253 is coupled with the self-locking member A3252, so that the self-locking member A3252 is retained by the reset member A3253 and outward movement of the self-locking member A3252 is blocked. When the installation arms 11 and 12 are respectively pushed into the receiving grooves A3250, the self-locking members A3252 can rotate with the displacement of the installation arms 11 and 12 to allow the installation arms 11 and 12 to enter the receiving grooves A3250, after the installation arms 11 and 12 are respectively disposed in the receiving grooves A3250, the two self-locking members A3252 rotate back to its initial positions, but further movement is blocked by the reset member A3253.

When the installation arms 11 and 12 need to be released from the receiving grooves A3250 of the self-locking assembly A30, it is only necessary to push the reset member A3253 away from the self-locking member A3252, so that the self-locking member A3252 can realize reverse rotation, so that the installation arms 11 and 12 can push the self-locking members A3252 to rotate in a reverse direction to escape from the receiving grooves A3250.

Figure 44A:
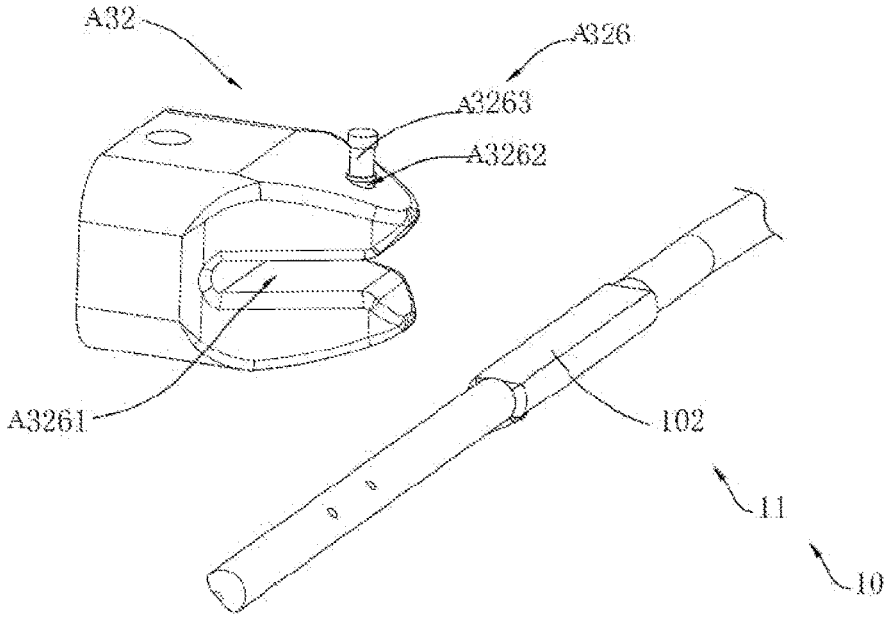
FIG. 44A to FIG. 44B are enlarged perspective views illustrating a second locking member of the shoe cover dispenser device according to a sixth alternative mode of the another preferred embodiment of the present invention.
Figure 44B:
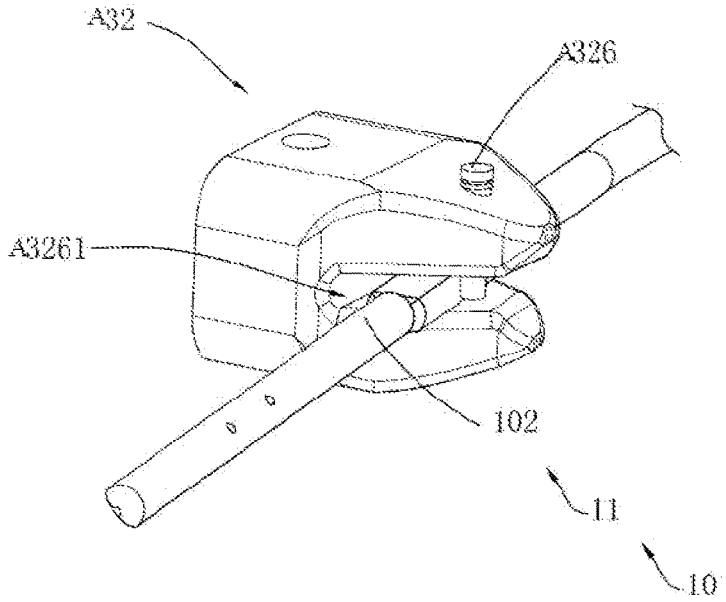

As shown in FIGS. 44A to 44B, the shoe cover dispenser device 100 according to a sixth alternative mode of the preferred embodiment of the present invention is illustrated. The difference from the above-mentioned preferred embodiment is that in this sixth alternative mode, the second locking member A32 is implemented to comprise two elastic locking sleeves A326, and each elastic locking sleeves A326 has an engaging groove A3261, a mounting hole A3262 and an elastic lock A3263, the mounting hole A3262 is provided in the housing of the elastic locking sleeves A326 and located on an upper outside of the engaging groove A3261, the elastic lock A3263 is elastically mounted in the mounting hole A3262 and can be pushed up and down with respect to the mounting hole A3262 to lock or release one of the second end portions 102 of the installation arm 11 and 12 through the engaging groove A3261.

The size of the engaging groove A3261 is set to enable each of the second end portions 102 of the installation arms 11 and 12 to be received in the engaging grooves A3261, and when the second end portions 102 of the installation arms 11 and 12 are respectively received in the engaging grooves A3261. The installer may press the elastic lock A3263 to penetrate the mounting hole A3262 to allow the elastic lock A3263 to be extended into the engaging groove A3261, thereby blocking the second end portions 102 of the installation arms 11 and 12 from moving out of the engaging grooves A326, so as to lock the second end portions 102 of the installation arms 11 and 12.

Figure 45A:
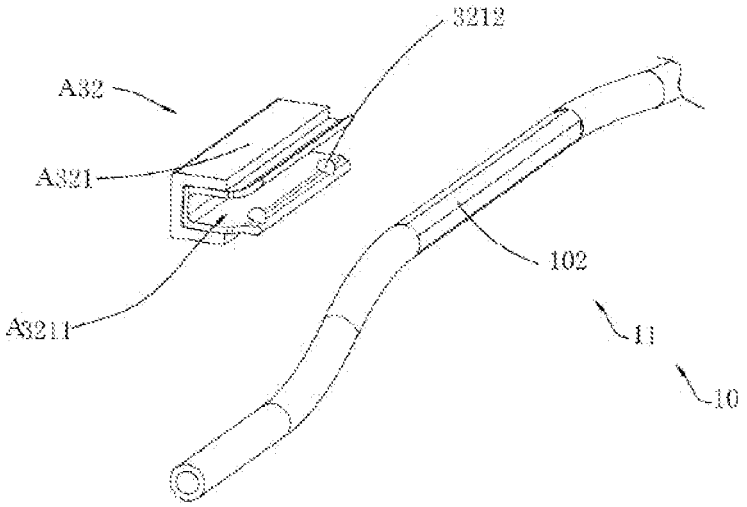
FIG. 45A to FIG. 45B are perspective views illustrating a second locking member of the shoe cover dispenser device according to another alternative mode of the another preferred embodiment of the present invention.
Figure 45B:
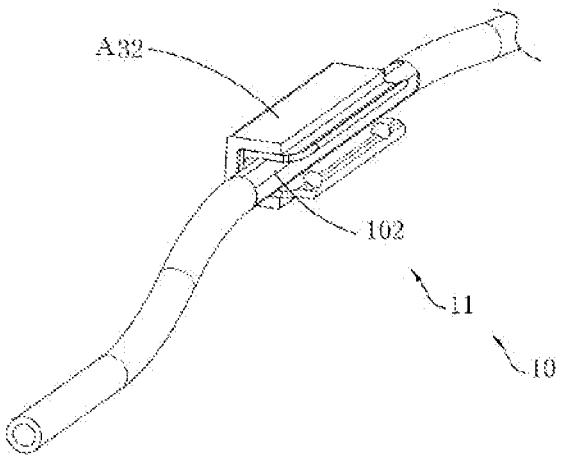

In addition, those skilled in the art can determine or change the specific structure of the second locking member A32 according to the actual situation, as shown in FIG. 45A and FIG. 45B, such as changing the first holding member A321 and the second holding member A322 And/or change the shape, the position or the quantity of the first locking ball 341 and/or the second locking ball 342. In other words, as long as the same or similar technical solutions as the present invention are adopted on the basis of the above disclosure of the present invention, the same or similar technical problems as the present invention are solved, and the same or similar technical effects as the present invention are achieved. All of them fall within the protection scope of the present invention, and the specific embodiments of the present invention are not limited thereto.

Figure 46A:
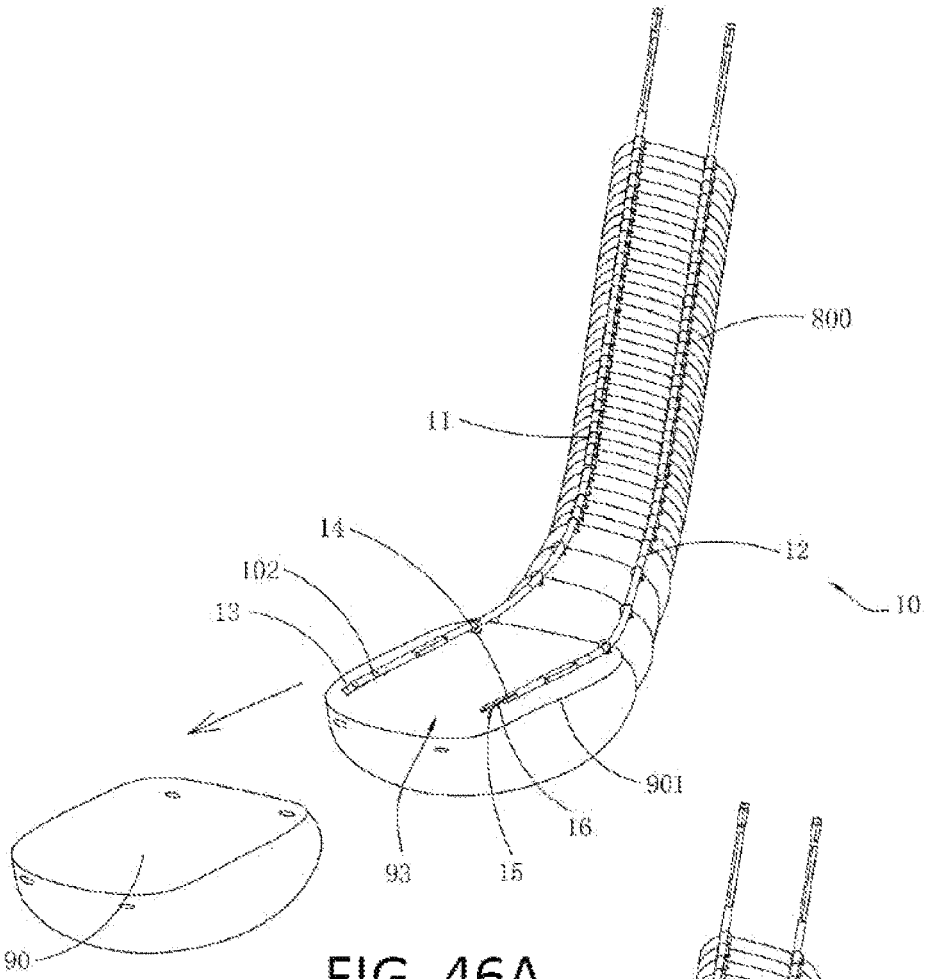
FIG. 46A to FIG. 46B are perspective views illustrating the shoe cover dispenser device dispensing the shoe covers according to the another preferred embodiment of the present invention.
Figure 46B:
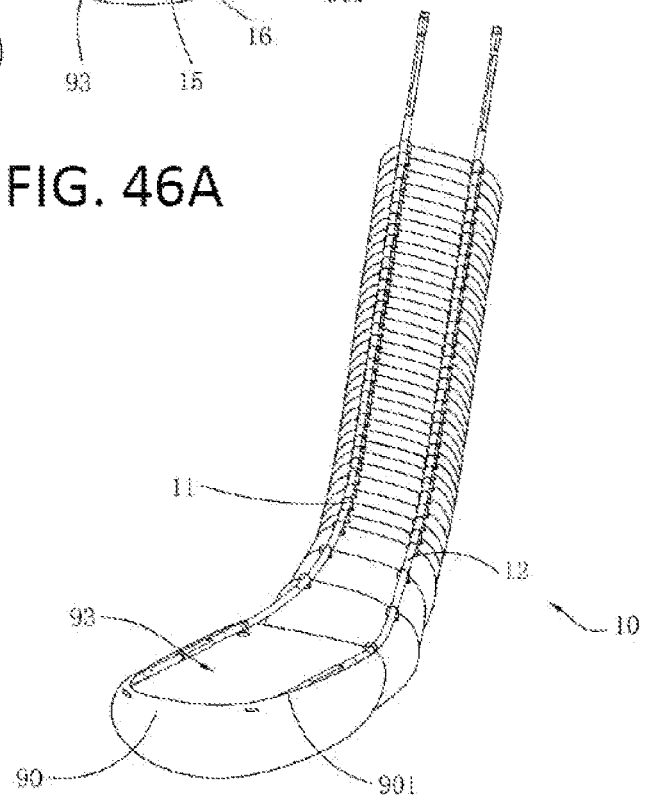
Figure 46C:
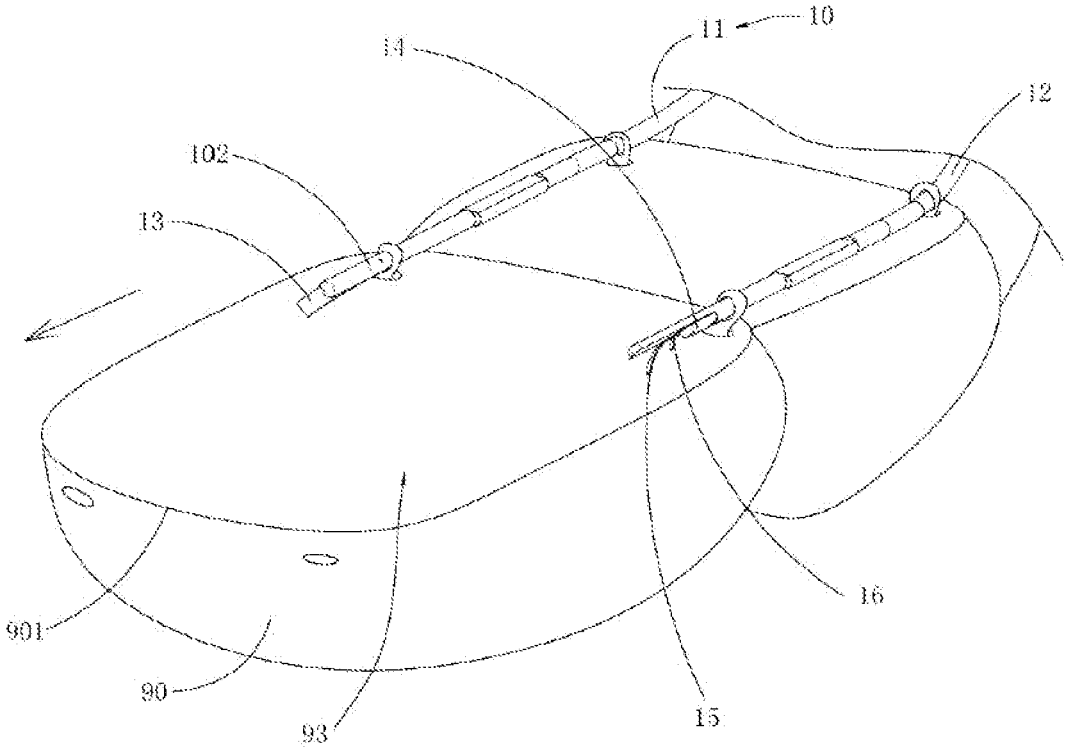
FIG. 46C is an enlarged perspective view illustrating the shoe covers according to the another preferred embodiment of the present invention.

As shown in FIGS. 46A to 46C, in the preferred embodiment of the of the present invention, the installation assembly 10 further comprises at least two stoppers 13 and 14, and the two stoppers 13 and 14 are respectively mounted on ends of the second end portions 102 of the two installation arms 11 and 12 to prevent a subsequent shoe cover 90 from retracting backward under the action of elastic force after a standby shoe cover 90 is taken out.

Since the front and rear shoe covers 90 are interlocked with each other, when a standby shoe cover 90 is worn by a user, the subsequent shoe cover 90 will move forward. After the standby shoe cover 90 is separated from the subsequent shoe cover 90, the subsequent shoe cover 90 shrinks backward under the action of its elastic opening edge 901. When encountering the stoppers 13 and 14, a front end portion of the subsequent shoe cover 90 is blocked by the stoppers 13 and 14 to avoid further retract movement. At the same time, since a rear end portion of the subsequent shoe cover 90 is pulled by a rear shoe cover 90, under the action of the stoppers 13 and 14, the subsequent shoe cover 90 is in an open state and function as a subsequent standby shoe cover 90 for the user to wear on.

Figure 46D:
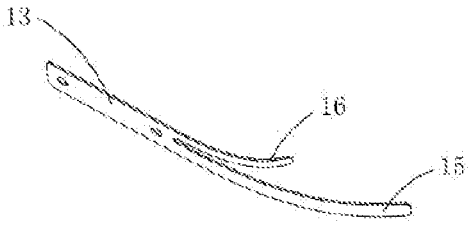
FIG. 46D to FIG. 46E are enlarged perspective views illustrating a stopper of the shoe cover dispenser device according to the another preferred embodiment of the present invention

As shown in FIG. 46D, each of the stoppers 13 and 14 is formed as an arc-shaped arm for retaining the front end portion of the subsequent shoe cover 90.

Figure 46E:
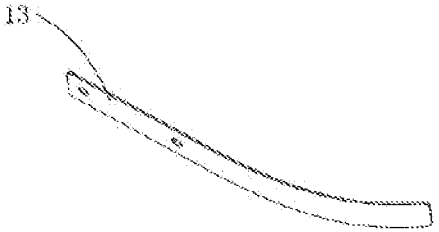

As shown in FIG. 46E, each of the stoppers 13 and 14 comprises a first stopper end portion 15 and a second stopper end portion 16, wherein each of the first stopper end portion 15 and the second stopper end portion 16 is extended inwardly and formed in an arc shape, the lengths of the first stopper end portion 15 and the second stopper end portion 16 are not the same. The front end portion of the subsequent shoe cover 90 is either retained by the first stopper end portion 15, or the second stopper end portion 16, or is retained between the first stopper end portion 15 and the second stopper end portion 16, so as to ensure that the subsequent shoe cover 90 is retained at the second end portions 102 of the installation arms 11 and 12 with enlarged opening 93 ready for a user to put his or her shoe into the subsequent shoe cover 90 which function as a next standby shoe cover 90 ready for use.

In other words, the length of the first stopper end portion 15 of each of the stoppers 13 and 14 is longer than the length of the second stopper end portion 16, and the first stopper end portion 15 is located on the front side of the second stopper end portion 16, so that when the rear shoe cover 90 detached from the front shoe cover, under the action of retracting elastic tension of the elastic opening edge 901 of the rear shoe cover 90, the retraction of the front end portion of the rear shoe cover 90 is first blocked by the first stopper end portion 15. If the first stopper end portion 15 does not block the backward movement of the shoe cover 90, the shoe cover 90 will encounter the second stopper end portion 16 for blocking the further retraction.

Figure 47A:
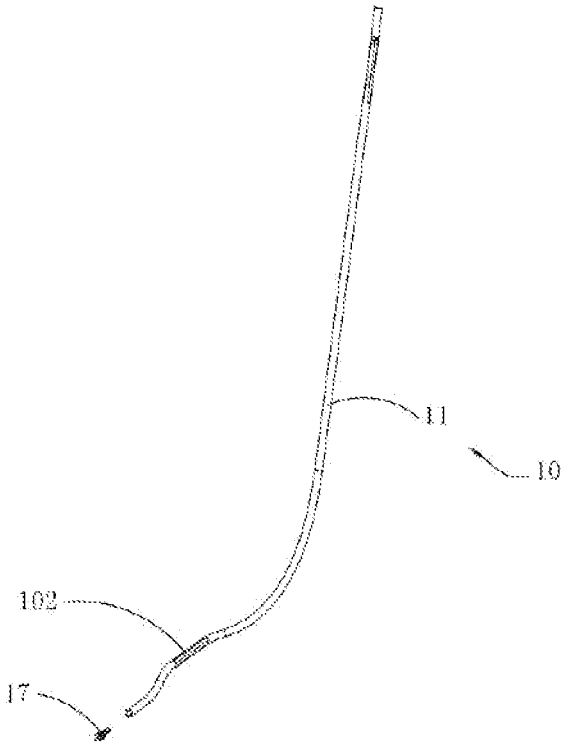
FIG. 47A to FIG. 47C are enlarged perspective views illustrating stoppers the shoe cover dispenser device according to an seventh alternative mode of the another preferred embodiment of the present invention.
Figure 47B:
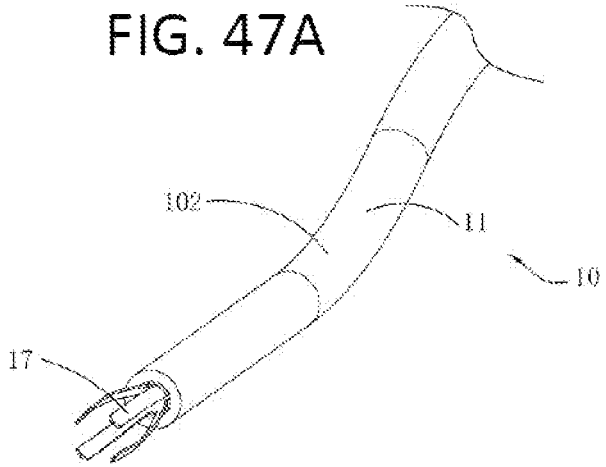
Figure 47C:
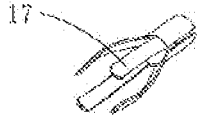

As shown in FIGS. 47A to 47C, the shoe cover dispenser device 100 according to a seventh alternative mode of the preferred embodiment of the present invention is illustrated. The difference from the above-mentioned preferred embodiment is that in this seventh alternative mode, each of the stoppers 13 and 14 comprises a plurality of stopper claws 17, and the plurality of stopper claws 17 are along a circumferential direction so that when the front standby shoe cover 90 is pulled away from the two installation arms 11 and 12 of the installation assembly 10, the front end portion of the rear subsequent shoe cover 90 can be retained by the stopper claws 17 to prevent the front end portion of the rear subsequent shoe cover 90 from retracting, so as to make the rear shoe cover 90 be in an open state under the action of the stopper claws 17.

Figure 47D:
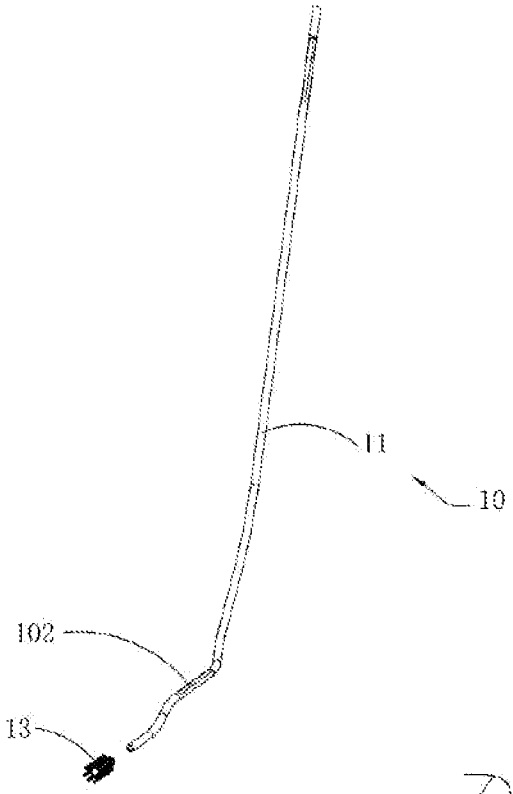
FIG. 47D to FIG. 47F are enlarged perspective views illustrating stoppers of the shoe cover dispenser device according to an eighth alternative mode of the another preferred embodiment of the present invention
Figure 47E:
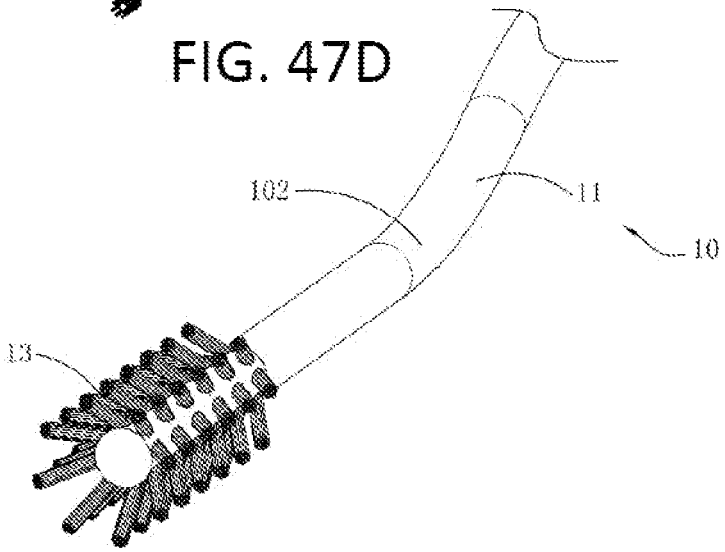
Figure 47F:
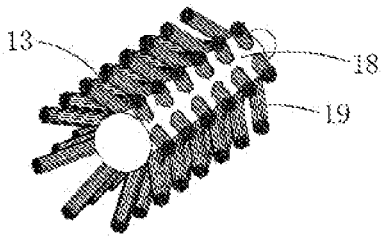

As shown in FIGS. 47D to 47F, the cover dispenser device 100 according to an eighth alternative mode of the preferred embodiment of the present invention is illustrated. The difference from the above-mentioned preferred embodiment is that in this eighth alternative mode, each of the stoppers 13 and 14 comprises a stopper head body 18, and a plurality of stopper protrusions 19 extended from the stopper head body 18, so that after the front standby shoe cover 90 is taken out, the stoppers 13 and 14 can prevent the rear subsequent shoe cover 90 from retracting from multiple angles, and can make the rear subsequent shoe cover 90 be in an open state under the action of the stoppers 13 and 14.

As shown in FIG. 32 to FIG. 47F of the drawings, the frame 20 has a L-shaped configuration and each of the two installation arms 11 and 12 of the installation assembly may comprise a downward curved portion and a horizontal portion. The downward curved portion and the horizontal portion are integrated with each other, or two portions that are assembled with each other.

Figure 48A:
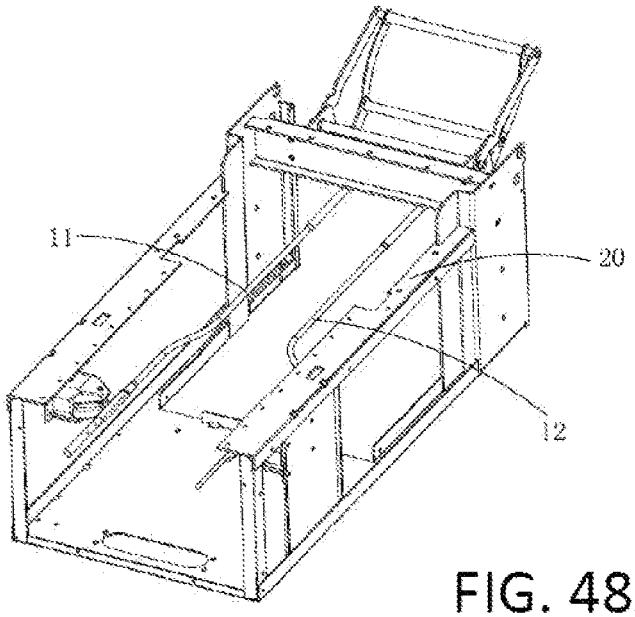
FIG. 48A to FIG. 48C are perspective views of the shoe cover dispenser device according to a ninth alternative mode of the another preferred embodiment of the present invention.
Figure 48B:
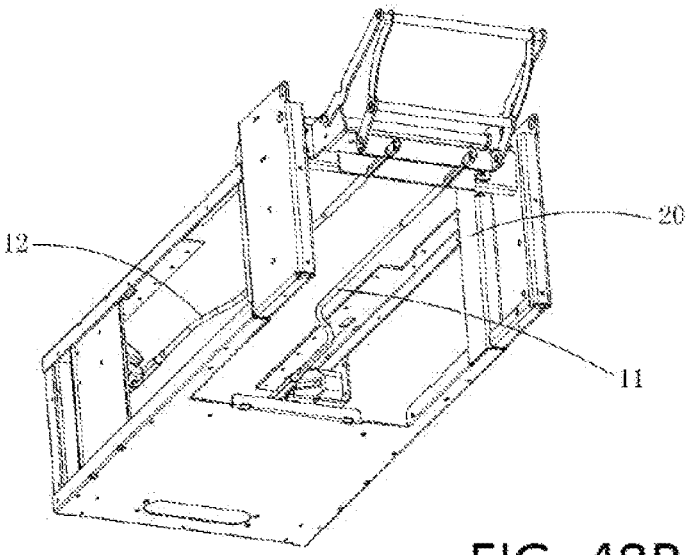
Figure 48C:
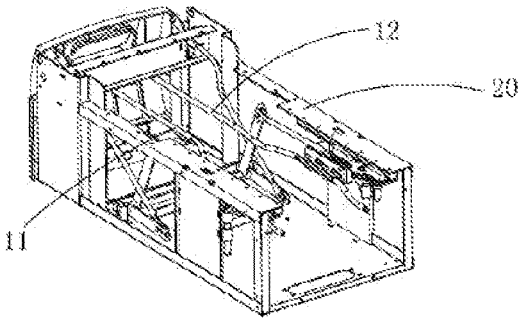

FIGS. 48A to 48C, the shoe cover dispenser device 100 according to a ninth alternative mode of the preferred embodiment of the present invention is illustrated. The difference from the above-mentioned preferred embodiment is that in this ninth alternative mode, the frame 20 is arranged horizontally, and the installation assembly 10 is also arranged horizontally, so that a plurality of the shoe covers 90 are installed horizontally on the two installation arms 11 and 12 of the installation assembly 10, and when the user uses them, a plurality of the shoe covers 90 moves in the horizontal direction and are used in sequence.

The difference from the above-mentioned preferred embodiment is that in the ninth alternative mode, since the frame 20 is horizontally arranged, it has a regular structure as a whole and saves a certain amount of space in height. Therefore, the use of the frame 20 in the ninth alternative mode can facilitate the packaging and transportation of the shoe cover dispenser device 100, and can also save the space for using the shoe cover dispenser device 100.

The present invention further provides a shoe cover assembly 800. The shoe cover assembly 800 comprises a plurality of shoe covers 90. The plurality of shoe covers 90 are connected in series and the adjacent shoe covers 90 are removable connected to each other.

Figure 49:
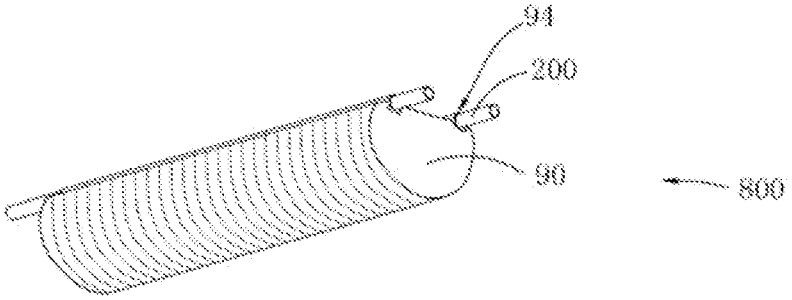
FIG. 49 is perspective view of a shoe cover assembly according to the another preferred embodiment of the present invention.
Figure 50:
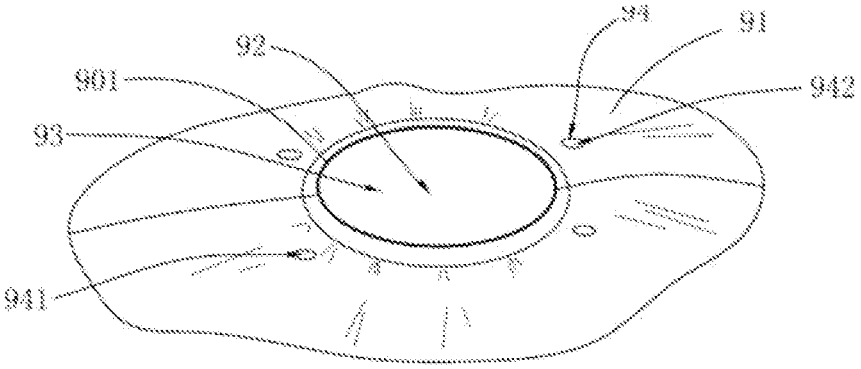
FIG. 50 is an enlarged perspective view of a single shoe cover according to the another preferred embodiment of the present invention.
Figure 51A:
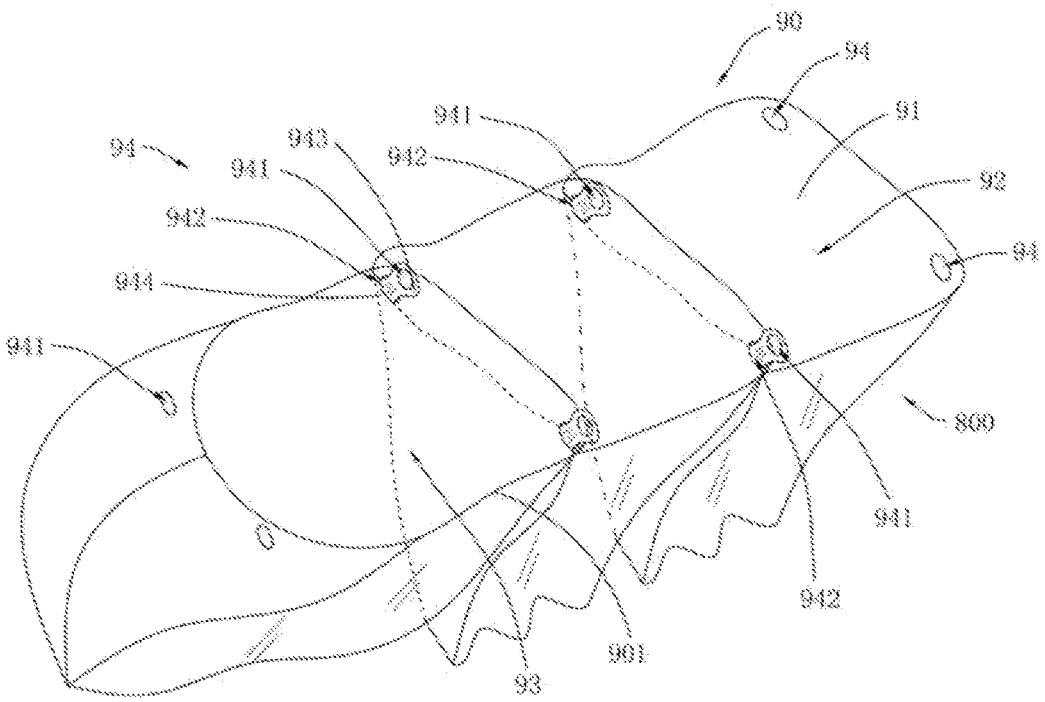
FIG. 51A and FIG. 51B are perspective views illustrating the joined connection between shoe covers of the shoe cover assembly according to the another preferred embodiment of the present invention
Figure 51B:
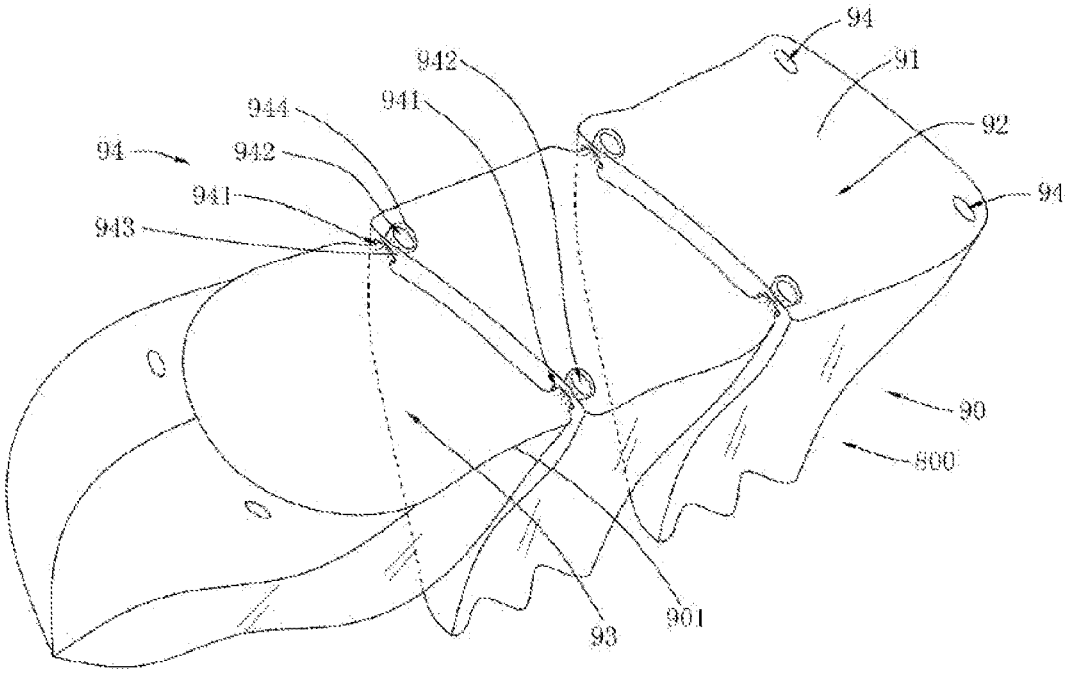

As shown in FIG. 49 to FIG. 51, in the preferred embodiment of the shoe cover assembly 800 of the present invention, the shoe cover assembly 800 comprises a plurality of shoe covers 90. Before the plurality of shoe covers 90 are assembled and installed on the two installation arms 11 and 12, two connecting rods 200 can be arranged for connecting the plurality of shoe covers 90.

Each of the shoe covers 90 comprises a shoe cover main body 91 having a receiving cavity 92 and an elastic opening edge 901 defining the opening 93, the opening 93 is arranged on the upper part of the shoe cover main body 91 so that the user's shoe can extend into the receiving cavity 92 of the shoe cover main body 91 through the opening 93.

As shown in FIG. 50 to FIG. 51, the shoe cover main body 91 is provided with four joint perforations 94, and the four joint perforations 94 are formed in the shoe cover main body 91 which defines the receiving cavity 92. The four joint perforations 94 are divided into two front joint perforations 941 formed in two front perforation portions 943 and two rear joint perforations 942 formed in two rear perforation portions 944. The front perforation portions 943 and the rear perforation portions 944 are integral parts of the shoe cove main body 91 defining the boundaries of the joint perforations 941 and 942.

As shown in FIG. 51, each row of two front perforation portions 943 of a rear shoe cover 90 pass through a row of two rear joint perforations 942 of an adjacent front shoe cover to expose the row of two front joint perforations 941 each of the connecting rods 200 to pass through the front joint perforations 941, so that a plurality of the shoe covers 90 are connected and joined by the two connecting rods 200 in series. Accordingly, the installation of the shoe covers 90 on the two connecting rods 20 only requires the two connecting rods 200 to pass through the rows of the front joint perforations 941, but not require to pass through the row of rear joint perforations 942, so that the installation of the shoe coves on the two connecting rods 200 is simplified.

In the preferred embodiment of the shoe cover assembly 800 of the present invention, the two connecting rods 200 are respectively flexible hollow tubular rods. When the shoe cover assembly 800 is installed on the shoe cover dispenser device 100, the two connecting rods 200 are inserted with the two installation arms 11 and 12 of the installation assembly 10 of the shoe cover dispenser device 100, and then the two connecting rods 200 are pulled out to leave the plurality of shoe covers 90 on the installation arms 11 and 12 of the shoe cover dispenser device 100.

Since the two connecting rods 200 are respectively flexible hollow tubes, it is convenient to match the shape and structure of the two installation arms 11, 12 of the shoe cover device during the installation of the shoe cover assembly 800. In addition, since the two connecting rods 200 respectively penetrate through the rear joint perforations 942 in the plurality of shoe covers 90 in sequence, when the plurality of shoe covers 90 are installed on the installation arms 11, 12, the two connecting rods 200 are easy to be removed from the installation arms 11, 12.

In detail, as a modification of the preferred embodiment of the shoe cover assembly 800 of the present invention, in the shoe cover assembly 800, the connection mode of the two front and rear shoe covers 90 is changed to the following manner that the rear perforation portions 944 of a front shoe cover 90 pass through the front joint perforations 941 of a rear shoe cover 90 and the two connecting rods 200 pass through the rear joint perforations 942 to allow the plurality of shoe covers be slidable along the two connecting rods 200.

Next, the installation process and working principle of the shoe cover assembly 800 and shoe cover dispenser device 100 of the present invention will be further briefly described referring to FIGS. 52A to 52H.

Figure 52A:
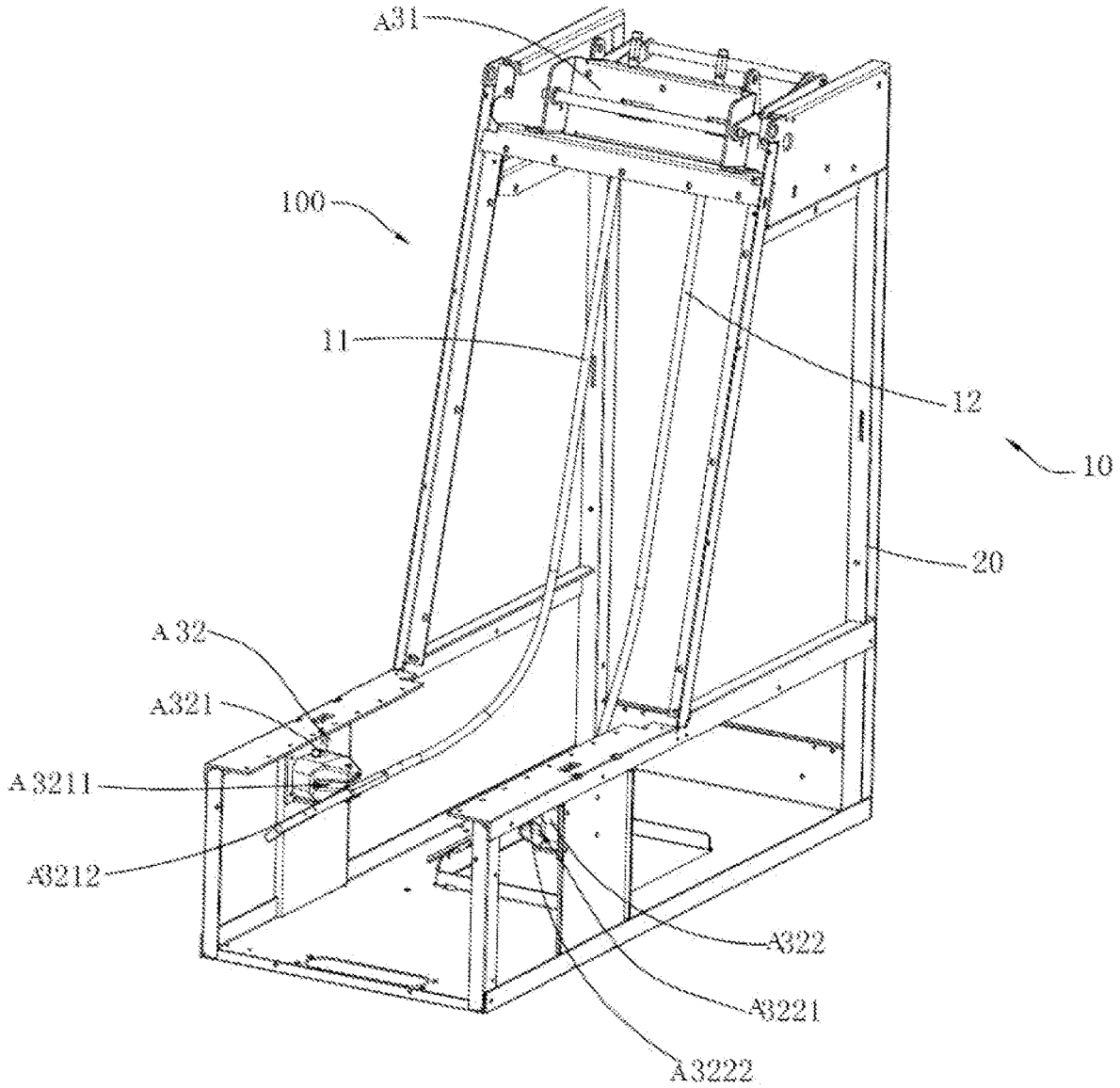
FIG. 52A to FIG. 52D are perspective views illustrating the installation of the shoe cover assembly on the shoe cover dispenser device according to the another preferred embodiment of the present invention.
Figure 52B:
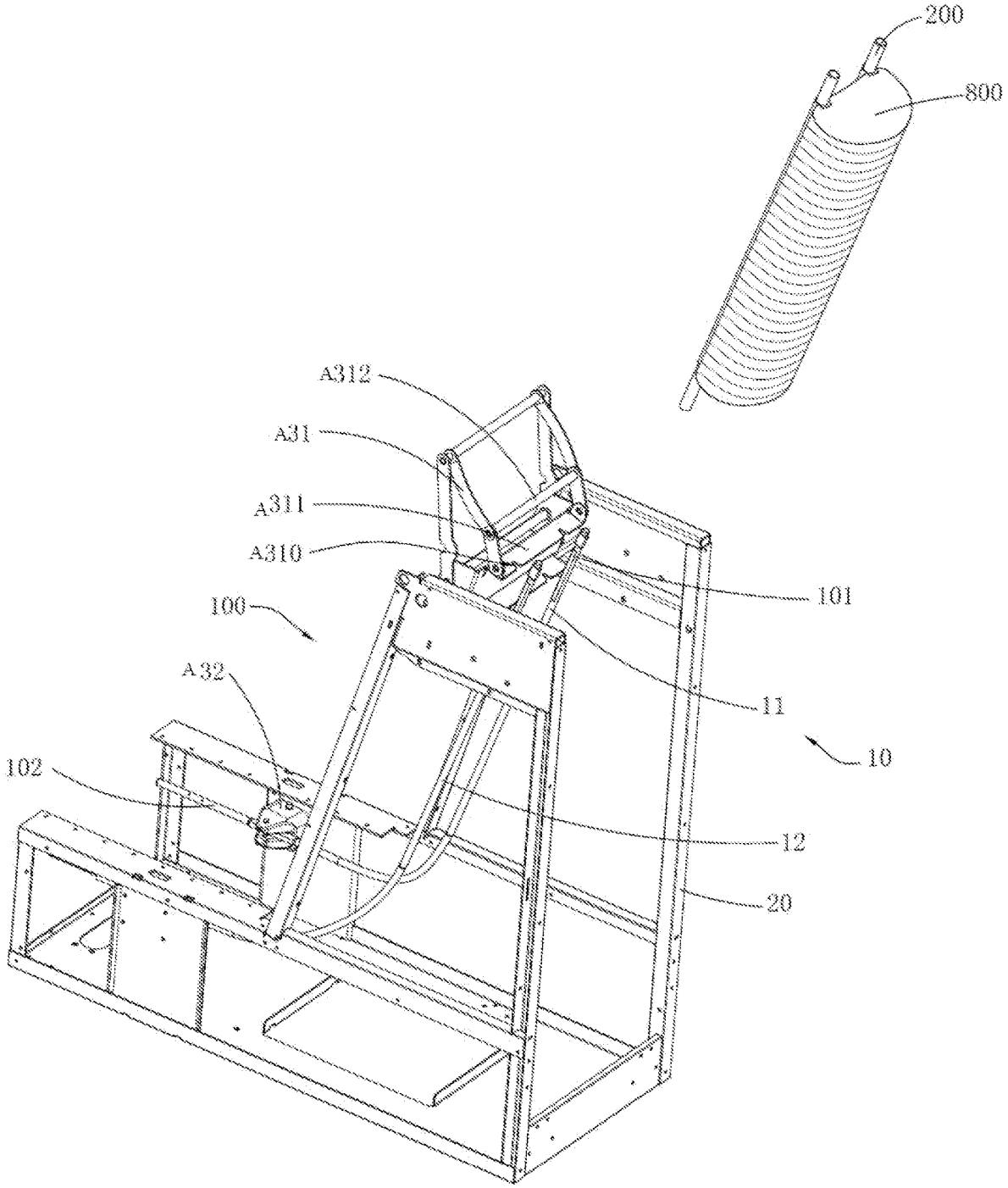
Figure 52C:
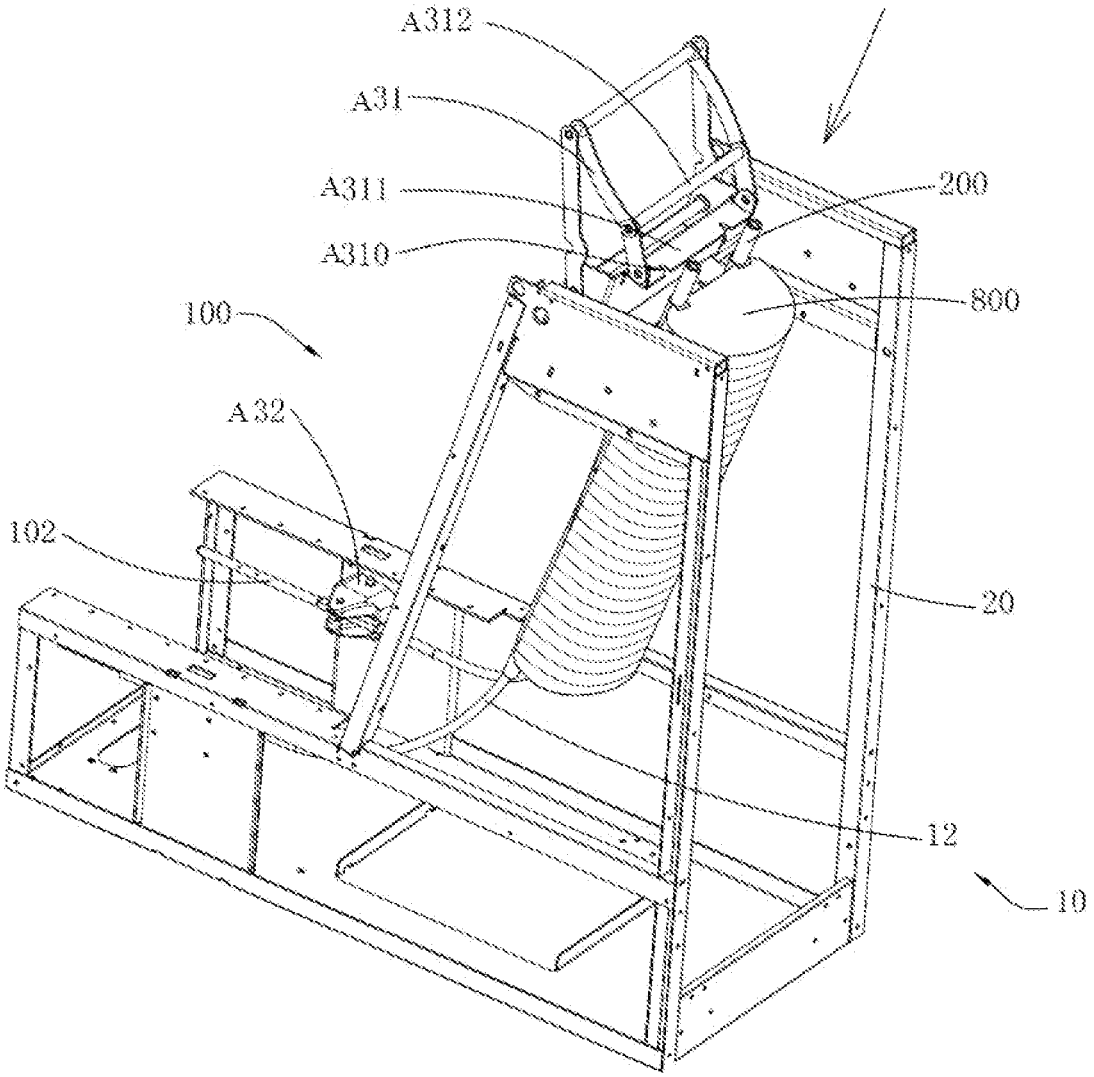
Figure 52D:
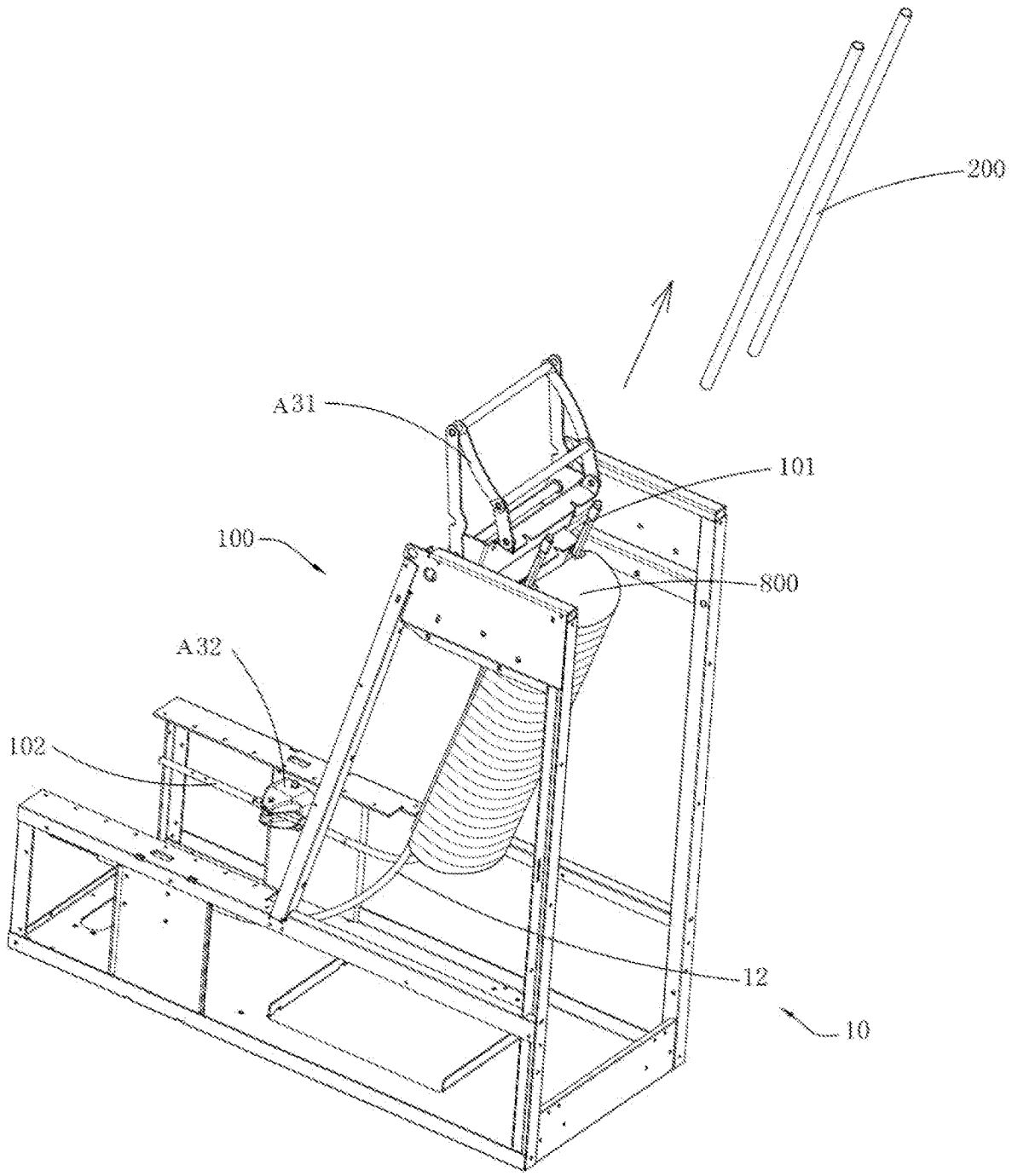

As shown in FIG. 52A, the two second end portions 102 are free end portions while the two first end portions 101 are locked by the first locking member A31. As shown in FIGS. 21B to 21D, the two second end portions 102 of the two installation arms 11 and 12 are first locked by the second locking member A32, so that the two installation arms 11 and 12 are fixed to the frame 20 of the shoe cover dispenser device 100, then the two first end portions 101 of the two installation arms 11 and 12 are released from the first locking member A31 to become free end portions.

Then connect the two connecting rods 200 of the shoe cover assembly 800 with the two installation arms 11 and 12 of the shoe cover dispenser device 100, and install the shoe covers 90 to the installation arms 11 and 12, and then remove the two connecting rods 20 to leave the plurality of shoe covers 90 on the two installation arms.

Figure 52E:
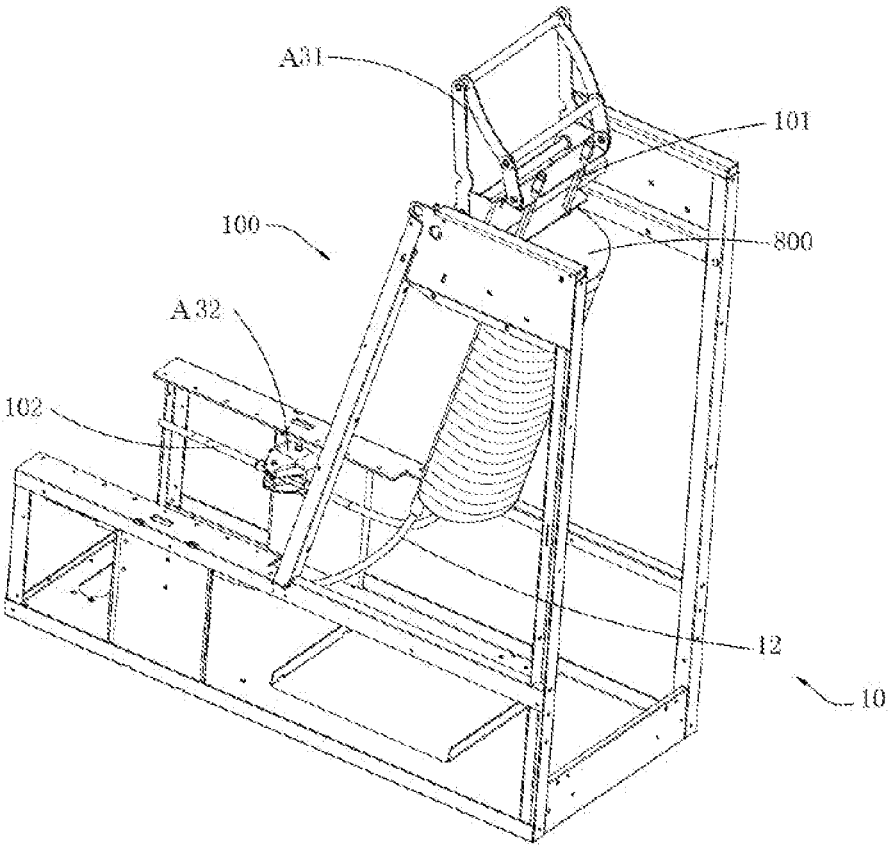
FIG. 52E to FIG. 52H are perspective views illustrating the locking of the first end portion of the two installation arms by the first locking member and releasing of the second end portions of the two installation arms by the second locking member to prepare the shoe covers ready for dispensing through the shoe cover dispenser device according to the another preferred embodiment of the present invention.
Figure 52F:
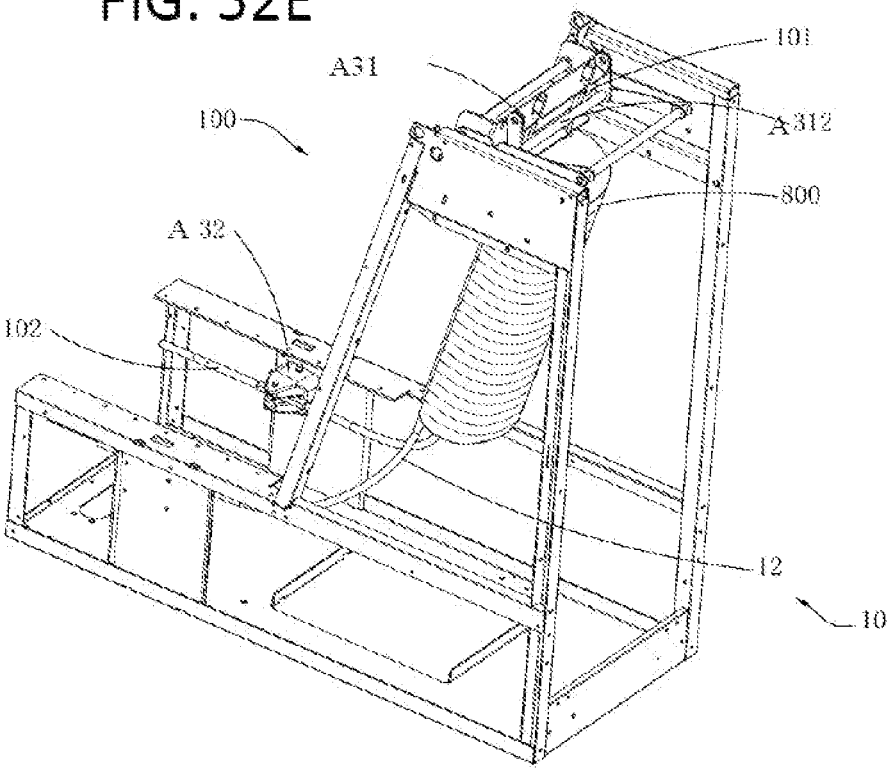
Figure 52G:
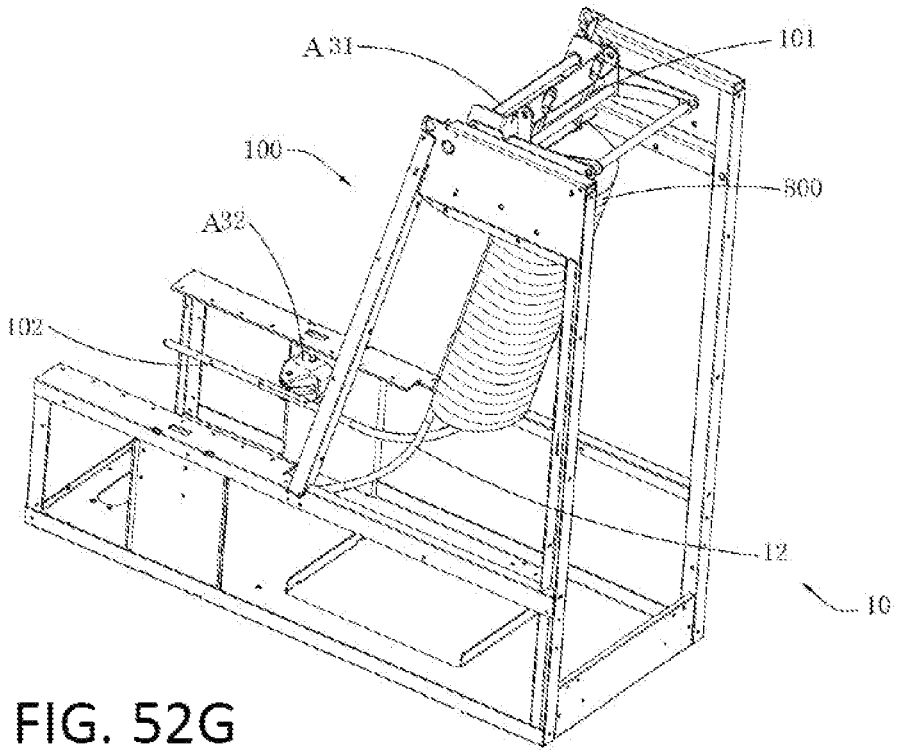
Figure 52H:
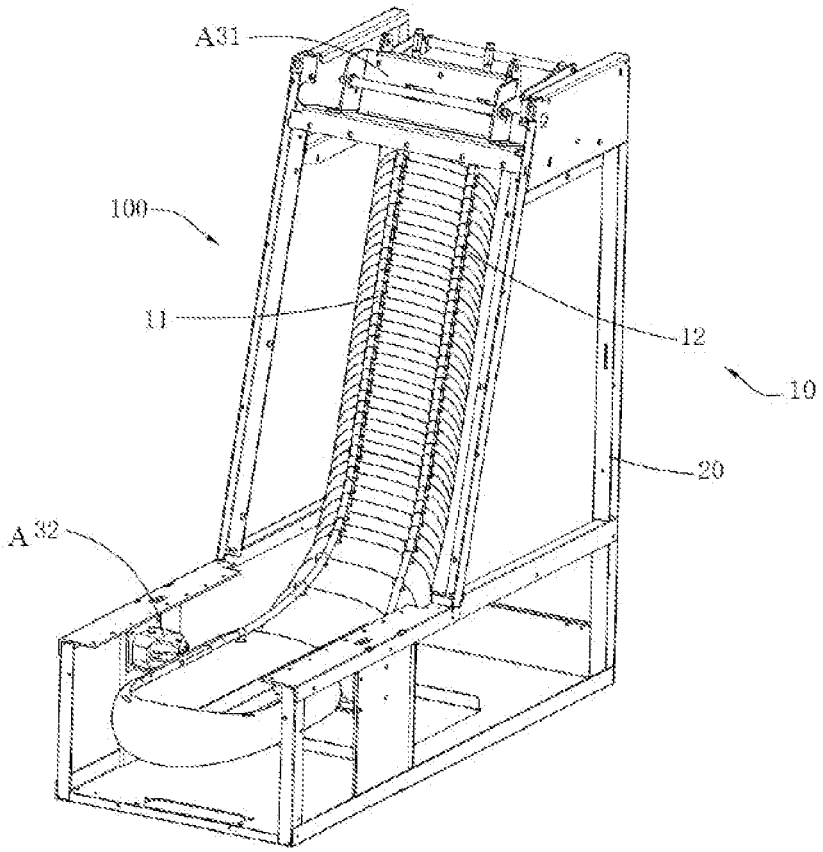

Afterwards, as shown in FIGS. 52E and 52F, the two first end portions 101 of the two installation arms 11 and 12 are respectively locked by the first locking member A31, and then as shown in FIG. 52G, the second end portions 102 of the two installation arms 11 and 12 are released from the second locking member A32, so that the plurality of shoe covers can be ready for dispensing from the second end portions 102 of the two installation arms 11 and 12, as shown in FIG. 52H.

Figure 53A:
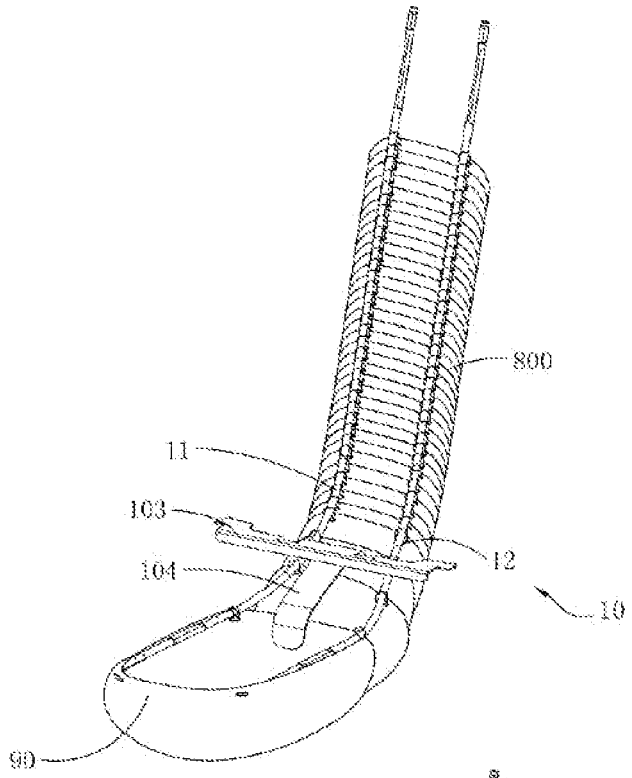
FIG. 53A and FIG. 53B are perspective views illustrating a retaining element of the shoe cover dispenser device according to the another preferred embodiment of the present invention.
Figure 53B:
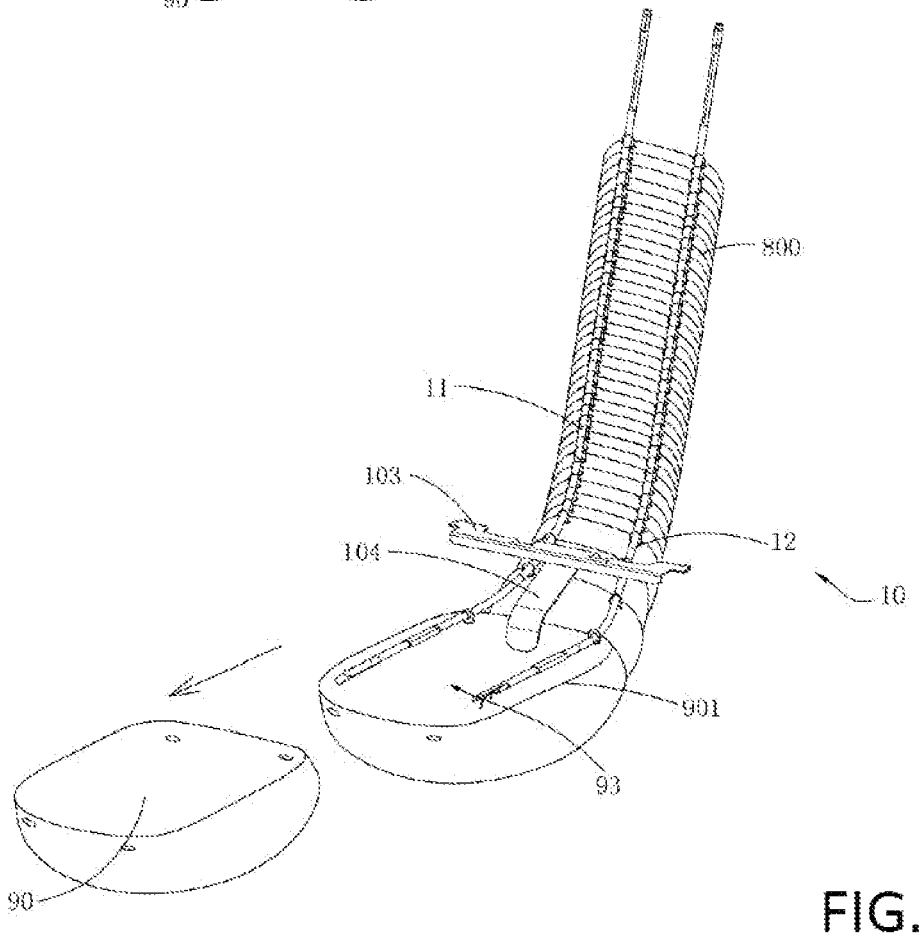

As shown in FIGS. 53A to 53B which illustrate a retention element 40 of the shoe cover dispenser device 100 of the present invention. More specifically, the retention element 40 comprise a mounting frame 41 and a retention member 42 which can be a retention piece. The mounting frame 41 is connected to the frame 20, the retention member 42 is fixedly connected to the mounting frame 41 and is located between the two installation arms 11 and 12.

Specifically, the retention member 42 is implemented as an elastic material sheet with an arc-shaped structure, and the retention member 42 provide a one-way damping function, so as to prevent the retention member 42 from being affected by the inertial force of the shoe covers 90. As the shoe covers 90 are driven to move, and the retention member 42 can realize the effect of enlarge the openings 93 of the shoe covers 90 through the deformation and rebound of the elastic material sheet.

As a modification of this alternative mode of the present invention, the retention member 42 may also be a metal sheet with other structural shapes, and a torsion spring or tension spring may be provided to generate damping functions, so as to facilitate to keep the standby shoe cover 90 having the enlarged opening 93.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A dispenser device for detachable shoe covers, comprising:

a frame;

an installation assembly, being installed on the frame, comprising a pair of installation arms for installing the detachable shoe covers, wherein the frame is configured to support the pair of the installation arms extending from a rear end to a front end of the frame in parallel manner to define an installation arrangement and a dispenser arrangement, the pair of the installation arms having two parallel front end portions and being arranged and configured to provide the dispenser arrangement at the two parallel front end portions; and a pair of separators respectively arranged at the two parallel front end portions of the pair of the twe installation arms to form the dispenser arrangement;

wherein the detachable shoe covers are stacked together one-by-one in series and held there along to form the installation arrangement, wherein each of the detachable shoe covers comprises:

a shoe cover main body having a receiving cavity and an opening edge portion defining an opening; and an interconnection arrangement arranged to interconnect the detachable shoe covers one-by-one in series along the pair of the installation arms of the installation assembly, wherein the interconnection arrangement of each of the detachable shoe covers consists of a front portion of the shoe cover main body, a rear portion of the shoe cover main body, two front joint perforations provided in the front portion, and two rear joint perforations provided in the rear portion, for interconnecting each of the detachable shoe covers with another adjacent detachable shoe cover of the detachable shoe covers along the pair of the installation arms, wherein the detachable shoe covers installed in the installation arrangement of the installation assembly are stacked one-by-one in series along the pair of the installation arms of the installation assembly, wherein to interconnecting the detachable shoe covers one-by-one in series with the pair of the installation arms, the two rear portion of each of the detachable shoe covers is extended in the receiving cavity and positioned behind the front portion of the subsequent detachable shoe cover of the detachable shoe covers, wherein the two rear joint perforations of each of the detachable shoe cover is aligned with the two front joint perforations of the subsequent detachable shoe cover of the detachable shoe covers allowing the pair of the installation arms to penetrate through respectively so as to interconnecting the detachable shoe covers along the pair of the installation arms of the installation assembly, wherein each of the detachable shoe covers is able to be stretched out the opening end portion to an open state by the pair of the installation arms in the dispenser arrangement of the installation assembly to enlarge the opening, wherein the pair of the separators is configured to detach a frontmost detachable shoe cover of the detachable shoe covers from the subsequent detachable shoe cover of the detachable shoe covers by separating the interconnection arrangement and the interconnection arrangement is configured to be separated by the pair of the separators, such that the frontmost detachable shoe cover is detached from the installation arms of the dispenser device, wherein when the frontmost detachable shoe cover is continuously moving forwards until the two front joint perforations reach the pair of the separators, a frontward pulling force of the frontmost detachable shoe cover separates the frontmost detachable shoe cover from the pair of the installation arms of installation arrangement by the pair of the separators.

2. The shoe cover dispenser device, as recited in claim 1, wherein each of the plurality of detachable shoe covers is broken away from the installation assembly by the pair of the separators while moving frontwards away from the installation assembly.

3. The dispenser device, as recited in claim 2, wherein the interconnection arrangement is arranged for interconnecting each of the detachable shoe covers with another adjacent detachable shoe cover of the detachable shoe covers along the pair of the installation arms so as to installed in the installation assembly of the dispenser device.

4. The dispenser device, as recited in claim 3, wherein the interconnection arrangement further consists of two interconnection members connected to the rear portion of the opening edge portion and the two rear joint perforations of each of the detachable shoe covers are formed in the two interconnection members, such that the two interconnection members are hanged to the two installation arms respectively by penetrating the pair of the installation arms through the two rear joint perforations formed in the two interconnection members respectively.

5. The dispenser device, as recited in claim 4, wherein the two interconnection members of each of the plurality of detachable shoe covers are configured to penetrate through the two front joint perforations of the subsequent detachable shoe cover of the detachable shoe covers from an outer side to an inner side thereof respectively, such that the plurality of detachable shoe covers are installed along the two installation arms of the installation assembly of the dispenser device.

6. The dispenser device, as recited in claim 5, wherein a detachable line is extended from an edge of each of the two interconnection members to the front joint perforation thereof.

7. The dispenser device, as recited in claim 6, wherein each of the detachable lines is made to have a plurality of tiny perforations formed in the interconnection member.

8. The dispenser device, as recited in claim 6, wherein each of the detachable shoe covers further comprises a ring shape elastic element provided around an open edge of the opening edge portion to provide an elastic effect for being stretch to open the opening for wearing on a shoe and to retracted to reduce a size of the opening for holding on the shoe, wherein the two front joint perforations are formed below the elastic element and the two interconnection members are connected to a position below the elastic element.

9. The dispenser device, as recited in claim 3, wherein the two rear joint perforations are formed in the rear portion of the opening edge portion and the two front joint perforations are formed in the front portion of the opening edge portion of each of the plurality of detachable shoe covers.

10. The dispenser device, as recited in claim 9, wherein the rear portion of each of the plurality of detachable shoe covers is extended in the receiving cavity of the subsequent detachable shoe cover of the detachable shoe covers and positioned behind the front portion of the subsequent detachable shoe cover, wherein the two rear joint perforations of each of the detachable shoe covers is aligned with the two front joint perforations of the subsequent detachable shoe cover allowing the two installation arms to penetrate through respectively so as to interconnecting the plurality of detachable shoe covers along the two installation arms of the installation assembly.

11. The dispenser device, as recited in claim 10, wherein a detachable line is extended from an opening edge of the opening edge portion to each of the two front joint perforations and the two rear joint perforations of each of the plurality of detachable shoe covers.

12. The dispenser device, as recited in claim 11, wherein each of the detachable lines is made to have a plurality of tiny perforations formed in the interconnection member.

13. The dispenser device, as recited in claim 11, wherein each of the detachable shoe covers further comprises a ring shape elastic element provided around the opening edge portion to provide an elastic effect for being stretch to open the opening for wearing on a shoe and to retracted to reduce a size of the opening for holding on the shoe, wherein the two front joint perforations and the two rear joint perforations are formed below the elastic element.

14. The dispenser device, as recited in claim 13, wherein a sealing portion is provided between the opening edge portion and each of the two front joint perforations and the two rear joint perforations of each of the detachable shoe covers.

15. The dispenser device, as recited in claim 11, wherein each of the detachable shoe covers further comprises a ring shape elastic element provided around the shoe cover main body at a position below the two front joint perforations and the two rear joint perforations to provide an elastic effect for being stretch to open the opening for wearing on a shoe and to retracted to reduce a size of the opening for holding on the shoe.

16. The dispenser device, as recited in claim 3, wherein the interconnection arrangement comprises two rear interconnection members connected to the rear portion of the opening edge portion and two front interconnection members connected to the front portion of the opening edge portion, wherein the two rear joint perforations are formed in the two rear interconnection members respectively and the two front joint perforations are formed in the two front interconnection members respectively.

17. The dispenser device, as recited in claim 16, wherein the two rear interconnection members of each of the plurality of detachable shoe covers are configured to respectively penetrate through the two front joint perforations of the two front interconnection members of the subsequent detachable shoe cover of the detachable shoe covers, such that the two rear interconnection members of each of the detachable shoe covers are hanged to the two installation arms respectively by penetrating the two installation arms through the two rear joint perforations of the two rear interconnection members respectively, such that the detachable shoe covers are installed along the two installation arms of the installation assembly.

18. The dispenser device, as recited in claim 17, wherein a detachable line is extended from an edge of each of the two front interconnection members and the two rear interconnection members to one of the respective front joint perforation and the respective rear joint perforation.

19. The dispenser device, as recited in claim 18, wherein each of the detachable lines is made to have a plurality of tiny perforations formed in each of the front interconnection members and the rear interconnection members.

20. The dispenser device, as recited in claim 18, wherein each of the detachable shoe covers further comprises a ring shape elastic element provided around an open edge of the opening edge portion to provide an elastic effect for being stretch to open the opening for wearing on a shoe and to retracted to reduce a size of the opening for holding on the shoe.

21. The dispenser device, as recited in claim 9, wherein the interconnection arrangement further comprises an interconnection member connected between the rear portion of each of the detachable shoe covers and the front portion of the subsequent detachable shoe cover of the detachable shoe covers.

22. The dispenser device, as recited in claim 21, wherein a detachable line is extended across each of the interconnection members.

* * * * *